US007348482B2

(12) United States Patent
Ishii et al.

(10) Patent No.: US 7,348,482 B2
(45) Date of Patent: Mar. 25, 2008

(54) DISCRIMINATOR FOR DIFFERENTLY MODULATED SIGNALS, METHOD USED THEREIN, DEMODULATOR EQUIPPED THEREWITH, METHOD USED THEREIN, SOUND REPRODUCING APPARATUS AND METHOD FOR REPRODUCING ORIGINAL MUSIC DATA CODE

(75) Inventors: Jun Ishii, Hamamatsu (JP); Takashi Tamaki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1041 days.

(21) Appl. No.: 10/052,838

(22) Filed: Jan. 17, 2002

(65) Prior Publication Data

US 2003/0061931 A1 Apr. 3, 2003

(30) Foreign Application Priority Data

Jan. 23, 2001 (JP) ..... 2001-015099

(51) Int. Cl.
*G10H 7/00* (2006.01)

(52) U.S. Cl. ..... 84/616; 84/604; 84/609; 84/615; 84/649; 84/653; 84/654

(58) Field of Classification Search ..... 84/600–606, 84/609, 615–616, 618, 649, 653–654, 656, 84/678, 681, 684
See application file for complete search history.

(56) References Cited

U.S. PATENT DOCUMENTS 4,377,961 A * 3/1983 Bode ..... 84/681
4,395,931 A * 8/1983 Wachi ..... 84/603
5,054,359 A 10/1991 Hikawa
5,065,451 A * 11/1991 Leveque ..... 455/72
5,298,674 A * 3/1994 Yun ..... 84/616
5,337,196 A * 8/1994 Kim ..... 386/39
5,416,843 A * 5/1995 Hopkins ..... 381/7
5,450,597 A 9/1995 Klappert et al.
5,636,250 A 6/1997 Scarpa
5,670,732 A 9/1997 Utsumi et al.
5,689,816 A 11/1997 Lee et al.
5,726,373 A * 3/1998 Choi et al. ..... 84/609
6,037,835 A 3/2000 Smith et al.
6,346,667 B2 * 2/2002 Ishii ..... 84/645
6,462,264 B1 * 10/2002 Elam ..... 84/645

(Continued)

FOREIGN PATENT DOCUMENTS

EP 544 991 A2 7/1992

(Continued)

*Primary Examiner*—Marlon T Fletcher
(74) *Attorney, Agent, or Firm*—Morrison & Foerster LLP

(57) ABSTRACT

A nibble stream containing MIDI music data words and synchronous nibbles and an external audio signal are selectively converted to an audio-frequency signal, which in turn is converted to a set of PCM codes for storing it in a compact disc; and the audio frequency signal, which is demodulated from the PCM data codes, is analyzed to see which is the origin of the audio frequency signal on the basis of the signal level and what sort of modulation technique was employed on the basis of features of the audio frequency signal such as peak-to-peak intervals and similarity to reference waveforms so that the nibble stream or the external audio signal is exactly reproduced from the audio frequency signal.

42 Claims, 32 Drawing Sheets

U.S. PATENT DOCUMENTS

| | | | | |
|---|---|---|---|---|
| 2002/0012437 | A1* | 1/2002 | Murata et al. | 381/98 |
| 2002/0059312 | A1 | 5/2002 | Ishii | |

FOREIGN PATENT DOCUMENTS

| | | |
|---|---|---|
| JP | 55-070905 | 5/1980 |
| JP | 62-128247 | 6/1987 |
| JP | 07-334152 | 12/1995 |
| JP | 2000-156049 | 6/2000 |
| JP | 2002-094593 | 3/2002 |

* cited by examiner

| ITEM | DESIGN | UNIT | NOTE |
|---|---|---|---|
| Recording channel for modulated signal | R | Channel | Audio signal is recorded in L-channel. |
| Bit rate | 12.6 | kbps (kilobits/sec.) | |
| Carrier frequency | 6.30 | KHz | |
| Symbol Velocity | 3.15 | K baud (kilo symbols /sec.) | |
| Bits of Symbol | 4 | bits/symbol | |
| Coding | 4 – bit gray code | | |
| Modulation | 16 DPSK | | |
| Demodulation | Synchronous detection | | |
| Synchronization | Synchronous nibble | | |
| Delay time of audio signal in recording | 0 | msec | |
| Delay time of audio signal in playback | 500 | msec | |
| Recording Level | – 6.0 to – 12.0 | dB | Relative value with respect to full range. |
| Silent period | 2.0 ≦ | second | Necessary for symchronization. |

Fig. 5

| BIT STRING OF STATUS BYTE BEFORE DATA CONVERSION | BIT STRING AFTER DATA CONVERSION | DEFINITION OF STATUS BYTE |
|---|---|---|
| C0 | C40 | PROGRAM CHANGE AT CHANNEL 0 |
| C1 | C41 | PROGRAM CHANGE AT CHANNEL 1 |
| C2 | C42 | PROGRAM CHANGE AT CHANNEL 2 |
| ⋮ | ⋮ | ⋮ |
| CF | C4F | PROGRAM CHANGE AT CHANNEL F |
| F0 | C0 | EXCLUSIVE |
| F1 | C1 | TIME CODE QUARTER FRAME |
| F2 | C2 | SONG POSITION POINTER |
| F3 | C3 | SONG SELECT |
| F4 | C54 | ( NOT DEFINED ) |
| F5 | C55 | ( NOT DEFINED ) |
| F6 | C6 | TUNE REQUEST |
| F7 | C7 | END OF EXCLUSIVE |
| F8 | C8 | TIMING CLOCK |
| F9 | C9 | ( NOT DEFINED ) |
| FA | CA | START |
| FB | CB | CONTINUE |
| FC | CC | STOP |
| FD | CD | ( NOT DEFINED ) |
| FE | CE | ACTIVE SENSING |
| FF | CF | SYSTEM REQUEST |

Fig. 7

| Gray Code Data | POSITION [Dec] | PHASE [rad] | I – COMPONENT | Q – COMPONENT |
|---|---|---|---|---|
| 1000 | 0 | 0 | 1 | 0 |
| 1010 | 1 | 0.392699 | 0.92388 | 0.382683 |
| 1110 | 2 | 0.785398 | 0.707107 | 0.707107 |
| 0110 | 3 | 1.178097 | 0.382683 | 0.92388 |
| 0010 | 4 | 1.570796 | 0 | 1 |
| 0011 | 5 | 1.963495 | -0.38268 | 0.92388 |
| 0111 | 6 | 2.356194 | -0.70711 | 0.707107 |
| 1111 | 7 | 2.748894 | -0.92388 | 0.382683 |
| 1011 | 8 | 3.141593 | -1 | 0 |
| 1001 | 9 | 3.534292 | -0.92388 | -0.38268 |
| 1101 | 10 | 3.926991 | -0.70711 | -0.70711 |
| 0101 | 11 | 4.31969 | -0.38268 | -0.92388 |
| 0001 | 12 | 4.712389 | 0 | -1 |
| 0000 | 13 | 5.105088 | 0.382683 | -0.92388 |
| 0100 | 14 | 5.497787 | 0.707107 | -0.70711 |
| 1100 | 15 | 5.890486 | 0.92388 | -0.38268 |

Fig. 14

| AUDIO FRQ.S. | Y-MOD. DISCRIM. | Q-MOD. DISCRIM. | P-MOD. DISCRIM. | L Level | R Level | L WAVE DISCRIM. | R WAVE DISCRIM. | Time-out | JUDGE |
|---|---|---|---|---|---|---|---|---|---|
| NIBBLE STREAM (ANALYZE HEADPORTION ONLY OTHER IS SILENT) | cnt_y>=TH_YH | – | – | SL | – | – | wav_r<TH_SINR | NO | Y-MOD. |
| | – | cnt_qp>=TH_QPH | – | – | SL | wav_l<TH_SINL | – | NO | Q-MOD. WHEN BOTH ARE SATIS-FIED. |
| | – | cnt_qc>=TH_QCH | – | – | SL | wav_l>=TH_SQRL | – | NO | |
| | – | – | cnt_p>=TH_PH | SL | – | – | wav_r>=TH_SQRR | NO | P-MOD. |
| | cnt_y<=TH_YL | cnt_qp<=TH_QPL && cnt_qc<=TH_QCL | cnt_p<=TH_PL | – | – | – | – | NO | Audio |
| | – | – | – | – | – | – | – | YES | Audio |
| EXTERNAL AUDIO SIGNAL | cnt_y>=TH_YH | – | – | – | – | – | wav_r<TH_SINR | NO | Y-MOD. |
| | – | cnt_qp>=TH_QPH | – | – | SL | wav_l<TH_SINL | – | NO | Q-MOD. |
| | – | cnt_qc>=TH_QCH | – | – | – | wav_l>=TH_SQRL | – | NO | Q-MOD. |
| | – | – | cnt_p>=TH_PH | – | – | – | wav_r>=TH_SQRR | NO | P-MOD. |
| | cnt_y<=TH_YL | cnt_qp<=TH_QPL && cnt_qc<=TH_QCL | cnt_p<=TH_PL | – | – | – | – | NO | Audio |
| | – | – | – | – | – | – | – | YES | Audio |

Fig. 34

DISCRIMINATOR FOR DIFFERENTLY MODULATED SIGNALS, METHOD USED THEREIN, DEMODULATOR EQUIPPED THEREWITH, METHOD USED THEREIN, SOUND REPRODUCING APPARATUS AND METHOD FOR REPRODUCING ORIGINAL MUSIC DATA CODE

FIELD OF THE INVENTION

This invention relates to a signal discriminating technique for differently modulated signals and, more particularly, to a discriminator for discriminating analog signals differently modulated, a method used in the discriminator, a demodulator for reproducing a digital signal from the modulated signals, a method used in the demodulator, a sound reproducing apparatus for reproducing original music data codes from the modulated signals through the demodulation and a method used in the data reproducing apparatus.

DESCRIPTION OF THE RELATED ART

The MIDI (Musical Instrument Digital Interface) standards are well known to a person skilled in the art. Music data codes formatted in accordance with the MIDI standards are hereinbelow referred to as "MIDI music data codes", and "MIDI musical instrument" is defined as a musical instrument to produce tones from MIDI music data codes.

A player performs a piece of music on the MIDI musical instrument, and the MIDI musical instrument produces tones on the basis of the MIDI music data codes in a real time fashion. The player may wish to record his or her performance in a suitable information storage medium such as a floppy disc. The MIDI music data codes are directly written into the floppy disc. The player reproduces his or her performance through reading out the MIDI music data codes from the floppy disc whenever he or she wants.

A CD-DA (Compact Disc Digital Audio) is a compact disc for recording pieces of music in the form of digital signal, and music data codes are stored in one of the right and left channels of the compact disc. The music data codes are formatted in accordance with the CD-DA standards. The music data codes recordable in the CD-DA are hereinbelow referred to as "audio data codes".

Users may want to record their performance on a MIDI musical instrument in the compact disc. The MIDI music data codes are to be converted to the audio data codes through a prior art converter. The prior art converter firstly modulates a carrier signal in the audio frequency band with the MIDI music data codes. A two-value frequency shift keying may be used in the modulation, and an audio-frequency signal is output from the modulator. The modulated signal is converted to the audio data codes through the pulse code modulating technique. The audio data codes are written into either right or left channel of the CD-DA.

When the user wants to reproduce the performance, he or she instructs a prior art data reproducing apparatus to reproduce the MIDI music data codes from the audio data codes. The prior art data reproducing apparatus firstly demodulates the audio data codes to the audio-frequency signal, and, thereafter, the audio-frequency signal to the MIDI music data codes through the demodulating technique corresponding to the two-value frequency shift keying. However, the modulating technique from the MIDI music data codes to the audio-frequency signal is not limited to the two-value frequency shift keying. This means that the prior art data reproducing apparatus can not respond to an audio-frequency signal modulated through a modulation technique different from the two-value frequency shift keying. Nevertheless, the electronic device manufacturers employ various kinds of modulation/demodulation technologies, and sell the data converters/data reproducers in the market. If the user personally recorded his or her performance in the CD-DA and reproduces his or her performance from his or her own CD-DA, there is no problem. However, when the user wants to reproduce a performance from the audio data codes stored in unknown CD-DA, the he or she needs to confirm what kind of modulating technique was employed in the data converter. Thus, the users feel the compatibility poor.

The audio data codes may be distributed to users through a public communication network or broadcasting. The same problem is encountered in the prior art data converters.

SUMMARY OF THE INVENTION

It is therefore an important object of the present invention to provide a discriminator, which discriminates analog signals modulated through different technologies from one another.

It is also an important object of the present invention to provide a method employed in the discriminator for discriminating analog signals modulated through different technologies from one another.

It is another important object of the present invention to provide a demodulator, which demodulates analog signals modulated through different technologies to a digital signal through the discrimination of the different technologies.

It is also an important object of the present invention to provide a method employed in the demodulator for demodulating the analog signals modulated through different technologies to the digital signal.

It is yet another important object of the present invention to provide a data reproducing apparatus, which reproduces a first kind of digital signal from a second kind of digital signal through a demodulation from the second kind of digital signal to the analog signal and through a demodulation from the analog signal to the first kind of digital signal.

It is also an important object of the present invention to provide a method employed in the data reproducing apparatus for reproducing the first kind of digital signal from the second kind of digital signal.

In accordance with one aspect of the present invention, there is provided a discriminator for discriminating a sort of modulation technique to produce an information carrying signal comprising an analyzer supplied with the information carrying signal and evaluating at least one feature of the information carrying signal found in a waveform of the information carrying signal, and a judging unit connected to the analyzer, and investigating the evaluation supplied from the analyzer to see what sort of modulation technique is to exhibit the at least one feature so as to determine the sort of modulation technique employed in the information carrying signal.

In accordance with another aspect of the present invention, there is provided a method for discriminating a sort of modulation technique employed in an information carrying signal from other sorts of modulation techniques comprising the steps of a) receiving the information carrying signal, b) analyzing the information carrying signal so as to evaluate at least one feature of a waveform of the information carrying signal and c) investigating the evaluation to see what sort of modulation technique is to exhibit the at least one feature so as to determine the sort of modulation technique employed in the information carrying signal.

In accordance with yet another aspect of the present invention, there is provided a signal demodulator for reproducing an original signal from an information carrying signal comprising a detector supplied with the information carrying signal and including an analyzer supplied with the information carrying signal and evaluating at least one feature of the information carrying signal found in a waveform of the information carrying signal and a judging unit connected to the analyzer and investigating the evaluation supplied from the analyzer to see what sort of modulation technique is to exhibit at least one feature so as to produce a control data signal representative of the sort of modulation technique employed in the information carrying signal, and a demodulator responsive to the control data signal so as to select one of plural function planes respectively assigned to plural sorts of demodulation techniques and reproducing the original signal from the information carrying signal through the demodulation technique on the aforesaid one of the plural function planes.

In accordance with still another aspect of the present invention, there is provided a method for reproducing an original signal from an information carrying signal comprising the steps of a) receiving the information carrying signal, b) analyzing the information carrying signal so as to evaluate at least one feature of a waveform of the information carrying signal, c) investigating the evaluation to see what sort of modulation technique is to exhibit the aforesaid at least one feature so as to determine the sort of modulation technique employed in the information carrying signal, d) selecting a demodulation technique corresponding to the sort of modulation technique from plural candidates and e) reproducing the original signal from the information carrying signal through the demodulation technique.

In accordance with yet another aspect of the present invention, there is provided a sound reproducing apparatus for reproducing an original signal carrying pieces of music data information from an information carrying signal comprising a detector supplied with the information carrying signal and including an analyzer supplied with the information carrying signal and evaluating at least one feature of the information carrying signal found in a waveform of the information carrying signal and a judging unit connected to the analyzer and investigating the evaluation supplied from the analyzer to see what sort of modulation technique is to exhibit the aforesaid at least one feature so as to produce a control data signal representative of the sort of modulation technique employed in the information carrying signal, a demodulator connected to the detector, responsive to the control data signal so as to select one of plural function planes respectively assigned to plural sorts of demodulation techniques, and reproducing a continuous signal containing a first sub-signal representative of the pieces of music data information and a second sub-signal supplemented in the absence of the first sub-signal from the information carrying signal through the demodulation technique on the aforesaid one of the plural function planes, a data converter connected to the demodulator, and eliminating the second sub-signal from the continuous signal so as to reproduce the original signal from the continuous signal, and a signal converter connected to the data converter, and producing an analog audio signal carrying the pieces of music data information from the original signal.

In accordance with still another aspect of the present invention, there is provided a method for reproducing an original signal representative of pieces of music data information from an information carrying signal comprising the steps of a) receiving the information carrying signal, b) analyzing the information carrying signal so as to evaluate at least one feature of a waveform of the information carrying signal, c) investigating the evaluation to see what sort of modulation technique is to exhibit the aforesaid at least one feature so as to determine the sort of modulation technique employed in the information carrying signal, d) selecting a demodulation technique corresponding to the sort of modulation technique from plural candidates, e) reproducing a continuous signal containing a first sub-signal representative of the pieces of music data information and a second sub-signal supplemented in the absence of the first sub-signal from the information carrying signal through the demodulation technique, f) eliminating the second sub-signal from the continuous signal for reproducing the original signal and g) producing an analog audio signal carrying the pieces of music data information from the continuous signal.

BRIEF DESCRIPTION OF THE DRAWINGS

The features and advantages of will be more clearly understood from the following description taken in conjunction with the accompanying drawings in which:

FIG. 5 is a view showing a specification for a sound recorder manufactured by an electronic device manufacturing company;

FIG. 7 is a view showing data nibbles of MIDI status bytes and quasi MIDI status codes corresponding thereto;

FIG. 14 is a view showing relation among gray codes, positions assigned to the gray codes, a relative phase and an I-Q coordinate system;

FIG. 34 is a view showing contents of a data table;

DESCRIPTION OF THE PREFERRED EMBODIMENTS

System Configuration

Figure 1:
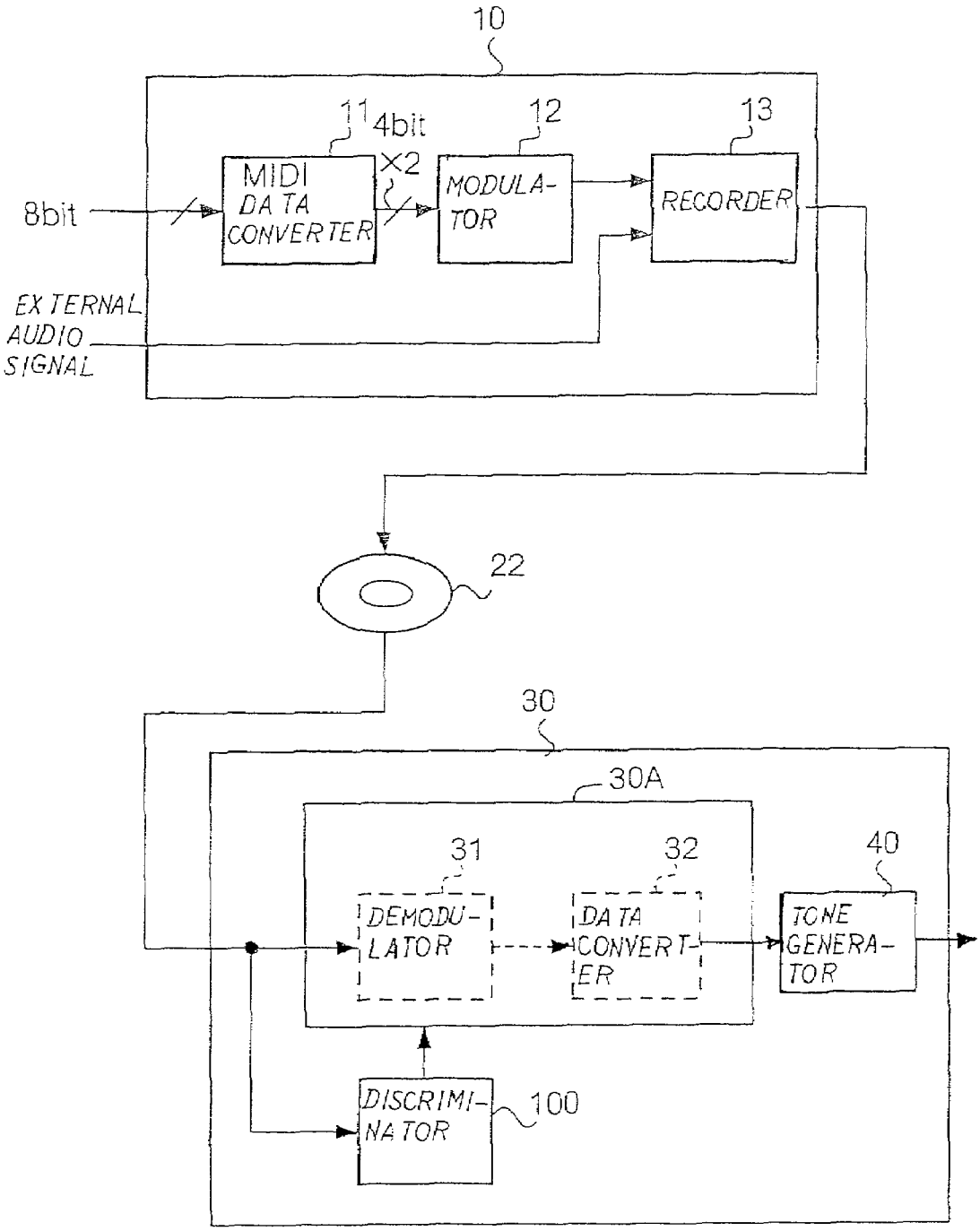
FIG. 1 is a block diagram showing the system configuration of an information processing system according to the present invention.

Referring to FIG. 1 of the drawings, an information processing system embodying the present invention largely comprises a data recorder 10, an information storage medium 22 and a data reproducer 30. A CD-R (Compact Disc Recordable) or DVD-R (Digital Versatile Disc Recordable) is, by way of example, employable as the information storage medium. The recordable compact disc is hereinbelow simply referred to as "compact disc".

The data recorder 10 comprises a MIDI data converter 11, a modulator 12 and a recorder 13. The MIDI data converter 11 supplements synchronous nibbles to the spaces each between MIDI music data codes, and produces a nibble stream or a base band signal from the MIDI music data codes. The MIDI music data codes are 8-bit codes representative of MIDI messages, and are supplied from a MIDI data source such as, for example, a MIDI musical instrument to the input data port of the MIDI data converter 11. The base band signal or nibble stream contains pulse trains representative of the MIDI messages.

A certain modulation technique is employed in the modulator 12. Any sort of modulation technique is employable in the modulator 12. A carrier signal in the audio-frequency band is generated in the modulator 12, and is modulated to an audio-frequency signal with the base band signal. The audio-frequency signal is supplied from the modulator 12 to the recorder 13.

The recorder 13 includes a pulse-code modulator and a suitable optical recording system. The audio-frequency signal is modulated through the PCM technique to a digital audio signal containing audio data codes. The pieces of music data information representative of the MIDI messages are stored in the audio data codes. The digital audio signal is supplied to the optical recording system, and is stored in either right or left channel of the compact disc 22 by means of the optical recording system. An external audio signal is directly supplied to the recorder 13. The recorder 13 is further responsive to the external audio signal so as to produce the digital audio signal through the PCM (Pulse Code Modulation) and store them into the compact disc 22.

On the other hand, the data reproducer 30 includes a demodulating unit 30A, a discriminator 100 and a tone generator 40. The demodulating unit 30A includes a demodulator 31 and a data converter 32. Though not shown in FIG. 1, a pulse-code demodulator reads out the digital audio signal from the compact disc 22, and demodulates the digital audio signal to an audio-frequency signal. The audio-frequency signal is supplied to the demodulator 31 and the discriminator 100. The audio-frequency signal was modulated from the nibble stream, or was equivalent to the external audio signal. In other words, the audio-frequency signal contains the MIDI music data codes, or not contains any MIDI data code.

The discriminator 100 analyzes the audio-frequency signal so as to determine whether the audio-frequency signal was produced from the nibble stream or the external audio signal and what sort of modulating technique was employed in the modulator 12 on the basis of features of the waveform found in the audio frequency signal. One of the features is similarity to reference waveforms, and another feature is the peak-to-peak intervals. Although the discriminator 100 can determine the origin of the audio-frequency signal and the modulation technique on the basis of only the similarity. It is preferable to take the peak-to-peak intervals into account, because the determination on the basis of more than one feature is more reliable. However, it is less preferable to determine the origin and the modulation technique on the basis of only the peak-to-peak intervals, because the audio-frequency signal may accidentally have peak-to-peak intervals identical with those of the waveform obtained through a certain modulation technique.

When the discriminator 100 determines the modulating technique employed in the modulator 12, the discriminator 100 supplies a control signal representative of the modulating technique to the demodulator 31. The demodulator 31 includes plural demodulating circuits different in demodulating technique from one another, and is responsive to the control signal for selecting a suitable demodulating circuit. Thus, the audio-frequency signal is supplied to the selected demodulating circuit, and is demodulated to the nibble stream or the base band signal. The nibble stream is supplied from the demodulator 31 to the data converter 32.

The data converter 32 eliminates the synchronous nibble from the nibble stream so as to restore the MIDI music data codes. The MIDI music data codes are supplied from the data converter 32 to the tone generator 40. The tone generator 40 produces an audio signal from the MIDI data codes, and supplies the audio signal to a sound system (not shown).

Recorder 10

Electronic device manufacturers supply the market with their data recorders. As described hereinbefore, the manufacturers employ different modulation technologies in the data recorders to produce the digital audio signal from the MIDI music data codes. Followings are the specifications of the manufacturers for the data recorders.

Specification of Manufacturer A

Figure 2:
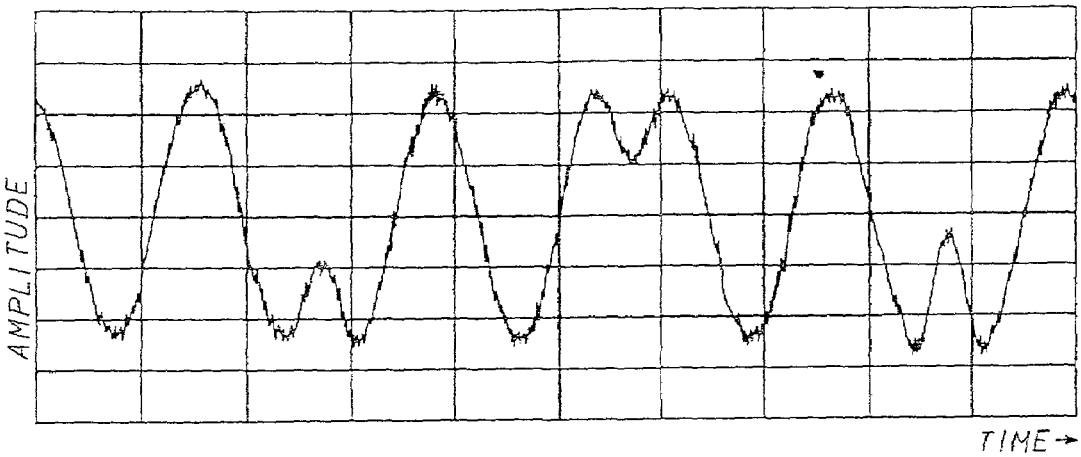
FIG. 2 is a diagram showing a waveform of an audio-frequency signal modulated through a 16 differential phase shift keying.

1. MIDI music data codes are modulated to the audio-frequency signal through a 16 DPSK (Differential Phase-Shift Keying), and the modulation technique is categorized in Y-modulation. An example of the modulated signal is shown in FIG. 2.
2. When an information storage medium used for the system is of the type storing a 2-channel audio signal, the digital audio signal is written in the right channel of the information storage medium.
3. The base band signal for the modulated signal or the audio frequency signal is in the form of pulse train, which has the edge-to-edge intervals expressed as 317.5×n μs where n is a positive integer.

Specification of Manufacturer B

Figure 3A:
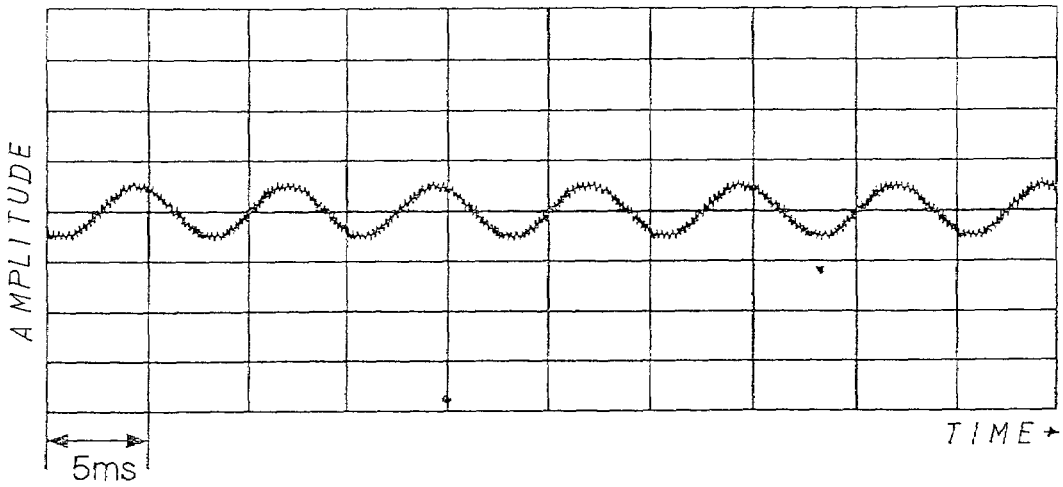
FIGS. 3A and 3B are diagrams showing a waveform of an audio-frequency signal modulated through a binary frequency shift keying of a P-modulation technique.
Figure 3B:
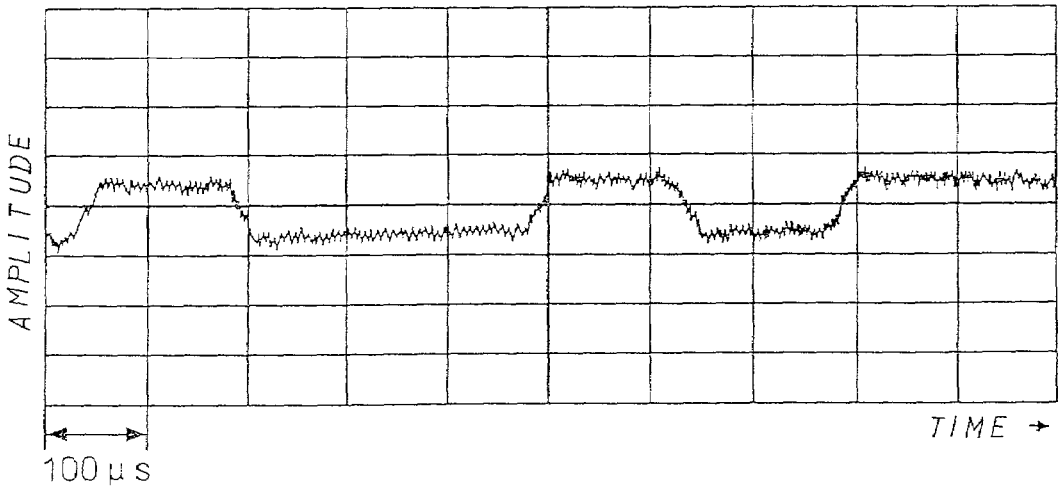

1. MIDI music data codes are modulated to the audio-frequency signal through a binary FSK (Frequency Shift Keying), and the modulation technique is categorized in Q-modulation. The head portion of the audio-frequency signal follows a sine wave signal, which is shown in FIG. 3A. FIG. 3B shows an example of the audio-frequency signal.
2. When an information storage medium used in the system is of the type storing a 2-channel audio signal, the digital audio signal is supplied to the left channel of the information storage medium.
3. The base-band signal for the modulated signal or the digital audio signal is in the form of pulse train, which has the edge-to-edge intervals selected from the group consisting of 145 μs, 290 μs, 581 μs and 3855 μs.

Specification of Manufacturer C

Figure 4:
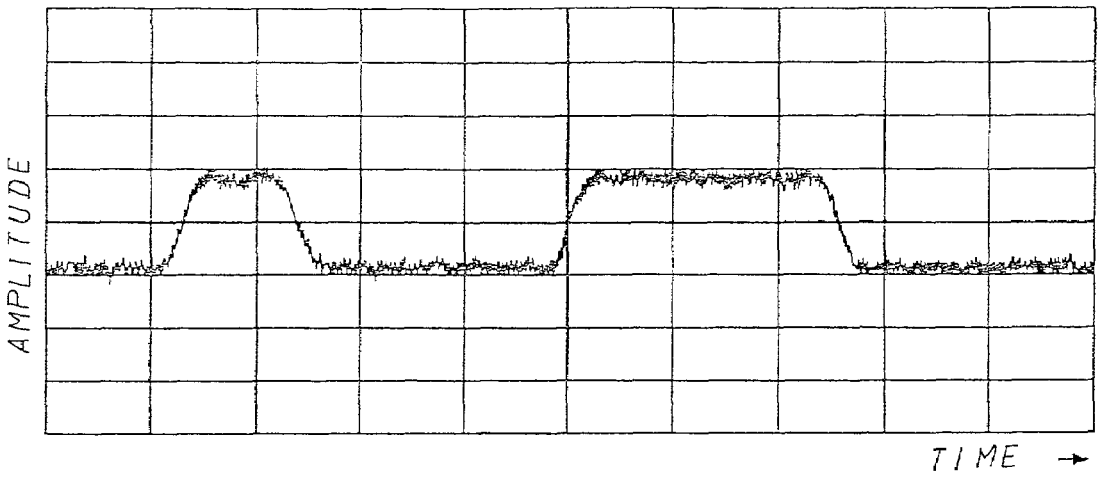
FIG. 4 is a diagram showing a waveform of an audio-frequency signal modulated through a binary frequency shift keying of a Q-modulation technique.

1. MIDI music data codes are modulated to the audio-frequency signal through a binary FSK (Frequency Shift Keying), and the modulation technique is categorized in P-modulation, which is different from the Q-modulation. FIG. 4 shows an example of the waveform of the audio-frequency signal.
2. When an information storage medium used in the system is of the type storing a 2-channel audio signal, the digital audio signal is supplied to the right channel of the information storage medium.
3. The base-band signal for the modulated signal or the digital audio signal is in the form of pulse train, which has the edge-to-edge intervals selected from the group consisting of 259 μs and 129.5 μs.

Since the Q-modulation and the P-modulation, in which the binary FSK is employed, are well known, description is hereinbelow made on the Y-modulation through the 16 DPSK employed in the specification of manufacturer A.

FIG. 5 illustrates details of the specification employed by manufacturer A. The modulated signal is assigned to the right channel R. If the compact disc 22 is used as the information storage medium, an audio signal is recorded in the left channel L. The bit rate is 12.6 kbps. Although the start/stop commands are required for pieces of music data information stored in the form of MIDI music data codes, the bit rate of 12.6 kbps is large enough to transfer the MIDI music data codes. The carrier frequency is 6.30 kHz, and the symbol velocity is 3.15 kbaud. Each symbol is expressed by 4 bits. The symbols are converted to 4-bit gray codes, and the 4-bit gray codes are modulated through the 16-DPSK. A synchronous detection is employed to demodulate the audio signal. Synchronization is achieved by inserting synchronous nibbles into the spaces each between MIDI music data codes. The audio-signal delay time is zero millisecond in the recording, and is 500 milliseconds in the reproduction. The dynamic range is from −6.0 dB to −12.0 dB with respect to the full range. Silence is continued for at least two seconds until a piece of music starts, and the silent time period is necessary for synchronization. In other words, the manufacturer designs the silent time period to achieve the synchronization. A base-band filter is prepared for the modulated signal, and a fourteenth-order cosine roll-off low-pass filter is employed as the base-band filter. The 14-order cosine roll-off low-pass filter has the cut-off frequency corresponding to the carrier frequency at 6.3 kHz.

Turning back to FIG. 1, the data recorder 10 is assumed to be a product of manufacturer A. The sound recorder 10 includes the MIDI data converter 11, the modulator 12 and the recorder 13. The MIDI music data codes are asynchronously supplied from the data source, i.e., the MIDI musical instrument to the MIDI data converter 11. In other words, the MIDI music data codes representative of pieces of MIDI music data information are supplied from the data source to the sound recorder 10 at irregular intervals.

According to the MIDI standards, the MIDI messages are stored in 8-bit data codes. Plural 8-bit data codes are required for transferring each MIDI message. In other words, each MIDI message is represented by using a status byte and data bytes. The status byte is, by way of example, representative of an instruction for an event such as a note-on/note-off and a channel to be assigned. Each of the note-on/note-off event and the channel to be assigned are represented by higher 4 bits and lower 4 bits. Thus, the nibble is the unit of the MIDI music data code. On the other hand, the data bytes give details of the instruction. The number of data bytes is determined for each of the status bytes in the MIDI standards. The status byte representative of a note-on event is, by way of example, followed by two data bytes. The first data byte is indicative of the pitch of the tone to be generated, and the second data byte is indicative of the loudness of the tone to be generated. Thus, the MIDI message is an instruction for generating the tone with a pitch at certain loudness. In the following description, a set of status/data bytes representative of a MIDI message is referred to as "MIDI data word", and the status byte and the data byte defined in the MIDI standards are referred to as "MIDI status byte" and "MIDI data byte", respectively.

The 8-bit MIDI status/data is divisible into two data nibbles. The MIDI data converter 11 checks the MIDI data words to see whether or not the MIDI status bytes are discriminative after insertion of the 4-bit synchronous nibble or nibbles. The synchronous nibble will be hereinbelow described in detail. When the MIDI data converter 11 notices a MIDI status byte which loses the peculiarity after the insertion of the synchronous nibble, the MIDI data converter 11 replaces the MIDI status byte with a quasi MIDI status code. The other MIDI status bytes are not replaced with any quasi MIDI status code, and the data bytes are transferred without any replacement. Subsequently, the MIDI data converter 11 inserts the synchronous nibbles into the irregular intervals, and produces the nibble stream DS1. Thus, the nibble steam DS1 is divisible into a series of nibbles, and, for this reason, each nibble is referred to as "symbol". Although the synchronous nibbles are inserted into the irregular intervals, the MIDI data converter 11 keeps the MIDI status bytes, quasi MIDI status bytes and MIDI data bytes discriminative. The nibble stream DS1 is supplied from the MIDI data converter 11 to the modulator 12.

The modulator 12 modulates a carrier signal with the nibble stream DS1, and produces the audio-frequency signal AD1. The carrier signal is fallen within the audio frequency band. The audio-frequency signal AD1 is supplied from the modulator 12 to the recorder 13. The recorder 13 converts the audio-frequency signal AD1 to the digital audio signal DA1 through the pulse code modulation, and writes the digital audio signal DA1 into a track in the compact disc 22.

MIDI Data Converter 11

Figure 6:
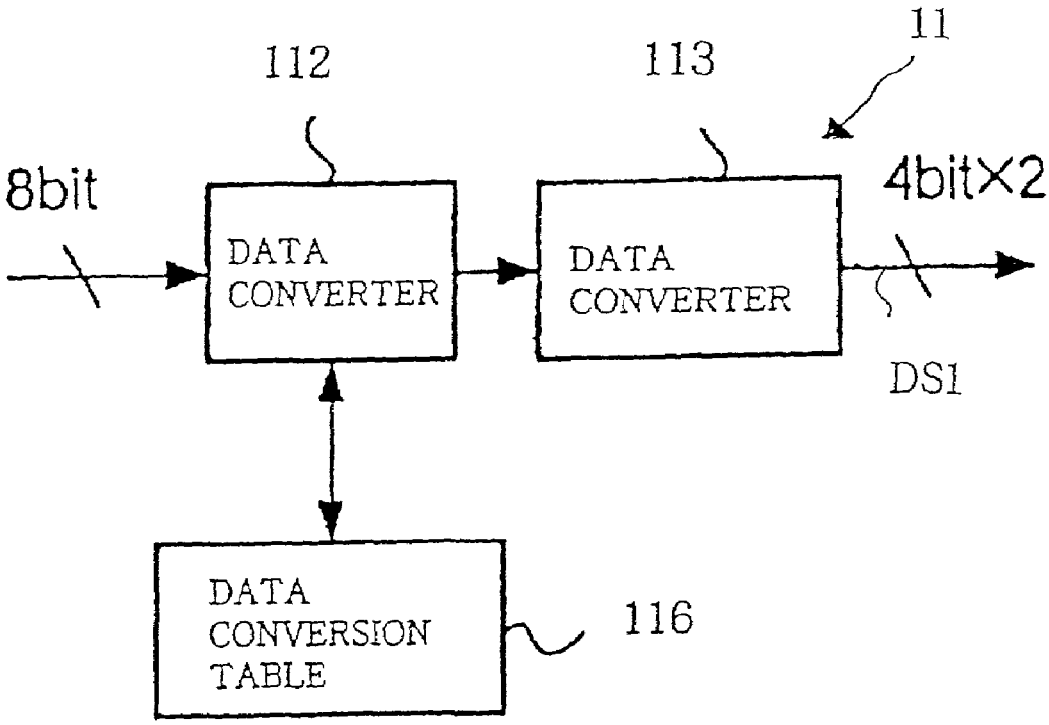
FIG. 6 is a block diagram showing the circuit configuration of a MIDI data converter incorporated in the data recorder.

Turning to FIG. 6 of the drawings, the function of the MIDI data converter 11 is equivalent to functions of two data converters 112/113 and a data conversion table 116. The data converter 112 replaces confusing MIDI status bytes with quasi MIDI status codes with the assistance of the data conversion table 116, and the data converter 113 produces the nibble stream DS1.

In detail, the MIDI data words are asynchronously produced in the MIDI musical instrument, and are supplied from the MIDI musical instrument to the data converting module 11 at irregular intervals. The data converter 112 receives the MIDI music data words, and checks the MIDI data words to see whether or not any one of the MIDI status bytes contains a nibble to be confused with the synchronous nibble or a nibble forming a part of another MIDI status byte. If the MIDI status byte does not contain the synchronous nibble and the confusing nibble, the answer is given negative, and the data converter 112 passes the MIDI status byte and associated MIDI data bytes to the data converter 113. However, if the MIDI status byte contains the synchronous nibble or the confusing nibble, the answer is given affirmative, and the data converter 112 accesses the data conversion table 116, and searches the data conversion table 116 for an appropriate quasi MIDI status byte. When the data converter 112 finds the appropriate quasi MIDI status byte in the data conversion table 116, the data converter 112 fetches the quasi MIDI status code corresponding to the MIDI status byte, and supplies the quasi MIDI status code and the MIDI data bytes to the data converter 113.

The data converter 113 supplements the synchronous nibbles in the irregular intervals between the MIDI data words, and produces the nibble stream DS1. In this instance, the synchronous nibble has the bit string (1111). The bit string (1111) is equivalent to hexadecimal number F.

FIG. 7 shows the data conversion table 116. The data conversion table 116 is stored in a memory device. The data conversion table 116 defines relation between MIDI status bytes and quasi MIDI status codes. The quasi MIDI status codes are different from the definitions in the MIDI standards. However, the quasi MIDI status codes convey the pieces of status data information stored in the corresponding MIDI status bytes from the data converter 112 to the data reproducer 30.

The data conversion table 116 shown in FIG. 7 includes the leftmost column assigned to the MIDI status bytes and the central column assigned to the quasi MIDI status codes and the rightmost column assigned to the definition of the MIDI status bytes. The actual data conversion table 116 relates the most significant nibbles of the MIDI status bytes to the quasi MIDI status codes, only. The rightmost column is added for the sake of reference. When the MIDI status bytes are replaced with the quasi MIDI status codes, the quasi MIDI status codes form the quasi MIDI data words together with the associated MIDI data bytes. In the following description, hexadecimal numbers are respectively placed in pairs of brackets.

The particular MIDI status bytes are expressed by the bit strings equivalent to hexadecimal numbers [C0] to [CF] and [F0] to [FF], respectively. These MIDI status bytes have the most significant nibble expressed by hexadecimal number [F] or [C]. The most significant nibble [F] is changed to the bit string equivalent to [C], and, accordingly, the most significant nibble [C] is changed to the bit string equivalent to [C4]. The MIDI status bytes [F4] and [F5] are changed to the quasi MIDI status data codes [C54] and [C55], respectively.

Thus, the most significant nibble [F] is removed from the quasi MIDI status codes through the data conversion. The reason why the most significant nibble [F] is replaced with the data nibble [C] is that only a small number of MIDI status bytes have the most significant nibble [F] and that the MIDI status bytes with the most significant nibble [F] represent system messages which do not frequently appear in a series of MIDI data words representative of a performance. In order to discriminate the converted data nibble [C] from the data nibble [C] originally incorporated in other MIDI status bytes, the most significant nibble [C] of the MIDI status bytes is replaced with the data code equivalent to hexadecimal numbers [C4]. The MIDI status bytes with the most significant nibble [C] represent the program change, and the program change does not frequently occur. The MIDI status byte with the most significant nibble [C] is prolonged by adding the nibble [4] thereto, and the data processing is a little bit delayed due to the added nibble [4]. However, the real time data processing is not required for the program change. A piece of music data information seldom follows the program change, and the delay is ignoreable. Moreover, the added nibble [4] is so short that the quasi MIDI data words do not lower the transfer efficiency.

The MIDI status bytes [F4] and [F5] are further changed to the quasi MIDI status codes [C54] and [C55], respectively, because the MIDI status bytes [C0] to [CF] have been already changed to the quasi MIDI status data codes [C4x] (x=0, 1, 2, . . . F). As will be seen in the table shown in FIG. 7, the status bytes [F4] and [F5] are not defined in the MIDI standards. There is little possibility to transmit the MIDI data words qualified with the status bytes [F4] and [F5]. However, those status bytes [F4] and [F5] may be defined in future. Moreover, it is desirable to make the conversion table clear, and the added data nibble [5] is ignoreable in the data transmission. For this reason, the MIDI status bytes [F4] and [F5] are respectively changed to the quasi MIDI status codes [C54] and [C55].

While the MIDI musical instrument is transferring the MIDI data words to the data converter 112 at irregular intervals, the data converter 112 checks each MIDI music data word to see whether or not the MIDI status byte is fallen within the prohibited range between [C0] and [CF] and between [F0] and [FF]. If the MIDI music data word has the MIDI status byte fallen within the prohibited range, the data converter 112 accesses the data conversion table 116, and reads out the corresponding quasi MIDI status data byte from the data conversion table 116 for replacing the prohibited MIDI status byte with the quasi MIDI status code read out from the data conversion table 116. Upon completion of the data conversion, the MIDI data words are out of the definition of the MIDI standards. However, the quasi MIDI data codes still represent the MIDI message, because the quasi MIDI status codes are discriminative from each other and from the other MIDI status bytes. The MIDI data word is converted to the quasi MIDI data word through the data conversion. The data converter 112 supplies the quasi MIDI data word to the data converter 13.

On the other hand, when a MIDI status byte is out of the prohibited range, the data conversion is not required for the MIDI status byte. This means that the data converter 112 does not replace the MIDI status byte with any quasi MIDI status code. The data converter 112 transfers the MIDI data word to the data converter 13 without the data conversion. Nevertheless, the MIDI data words are also referred to as "quasi MIDI data word" between the data converter 112 and the data reproducer 30.

The data converter 113 receives the quasi MIDI data words from the data converter 12, and forms the nibble stream DS1 for the synchronous data transmission. Since the quasi MIDI data words intermittently reach the data converter 113, the data converter 113 supplements the synchronous nibble or nibbles [F] into the irregular intervals among the quasi MIDI data words. As described hereinbefore, the hexadecimal number [F] has been already eliminated from the MIDI status bytes, and the synchronous data nibble [F] is never confused with the most significant nibble of the MIDI status bytes. The nibble stream DS1 is supplied to the modulator 11.

Assuming now that a musician is playing a tune on the MIDI musical instrument, the MIDI musical instrument produces MIDI data words representative of the performance in response to the finger work. The MIDI data words are asynchronously transferred from the MIDI musical instrument to the data recorder 10, and, accordingly, are a kind of asynchronous data.

Figure 8:
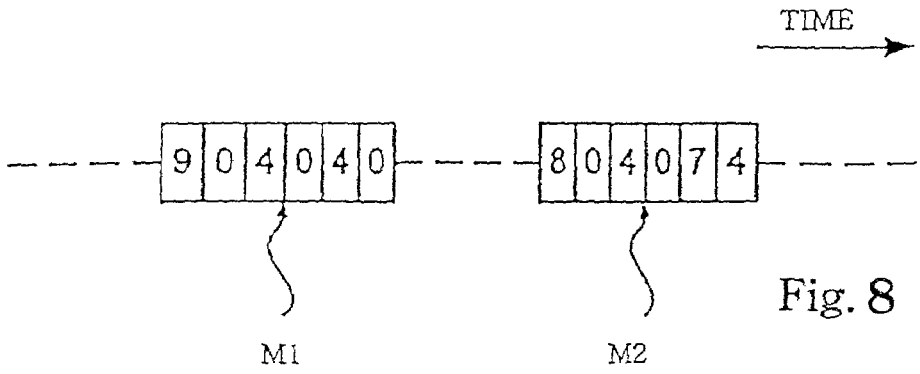
FIG. 8 is a view showing MIDI data words produced in a performance on a MIDI musical instrument.
Figure 9:
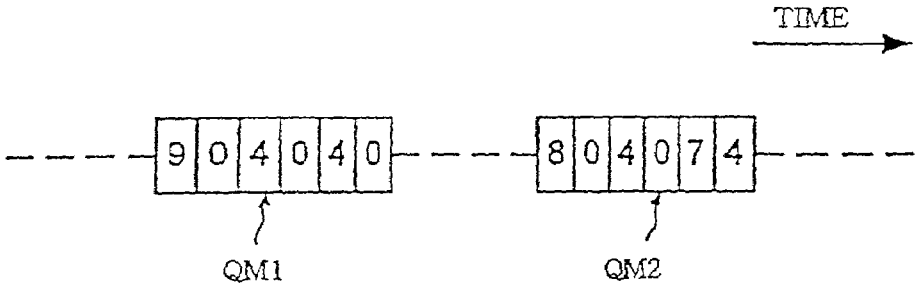
FIG. 9 is a view showing quasi MIDI data words produced from the MIDI data words through a data conversion.

FIG. 8 shows two of the MIDI data words representative of the MIDI messages. Time runs as indicated by an arrow. The first MIDI data word M1 is equivalent to hexadecimal number [904040], and the second MIDI data word M2 is equivalent to hexadecimal number [804074]. The MIDI data words M1 and M2 are spaced from each other and further from other MIDI music data words on both sides thereof, and broken lines represents the irregular time intervals. The data converter 112 checks each MIDI music data word M1/M2 to see whether or not the MIDI status byte has the most significant nibble equal to hexadecimal numbers [F] or [C]. The most significant nibbles of the MIDI music data words M1 and M2 are [9] and [8], respectively, and the answer is given negative. The data converter 112 does not access the data conversion table 116, and transfers the MIDI data words M1 and M2 to the next data converter 113 as the quasi MIDI music data words QM1 and QM2 (see FIG. 9). The quasi MIDI music data words QM1 and QM2 are also spaced from each other and further from the other quasi MIDI music data words as indicated by broken lines.

Figure 10:
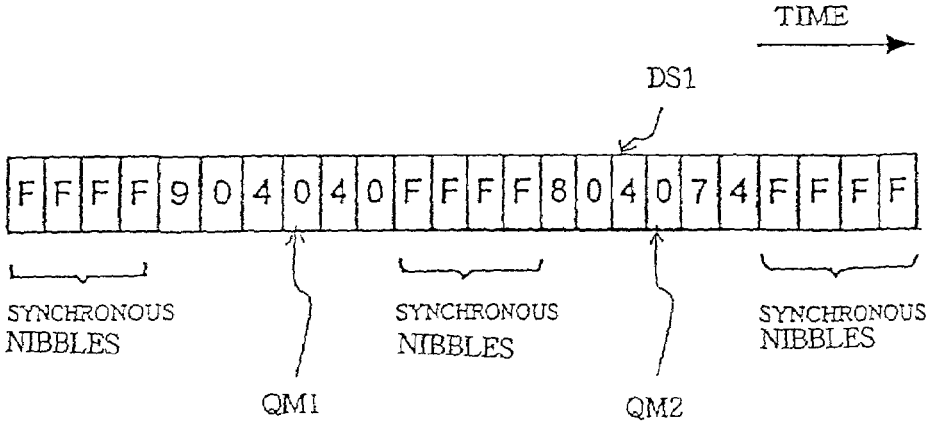
FIG. 10 is a view showing a nibble stream output from the MIDI data converter.

The data converter 113 supplements the synchronous nibbles [F] between the adjacent two quasi MIDI music data words, and converts the quasi MIDI data words . . . , QM1, QM2, . . . to the nibble stream DS1 as shown in FIG. 10. The synchronous data nibbles [F] serve as the stuffing pulses in a justification technique, and the nibble stream DS1 is a kind of synchronous data.

Figure 11:
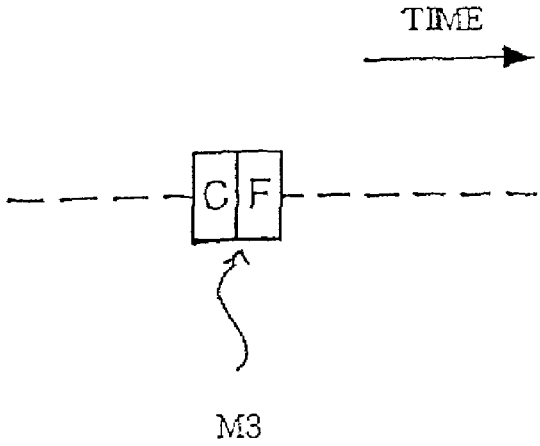
FIG. 11 is a view showing another MIDI data word produced in the performance on the MIDI musical instrument.
Figure 12:
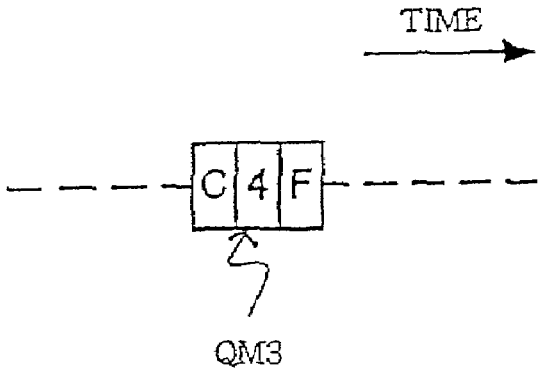
FIG. 12 is a view showing a quasi MIDI data word produced from the MIDI data word.
Figure 13:
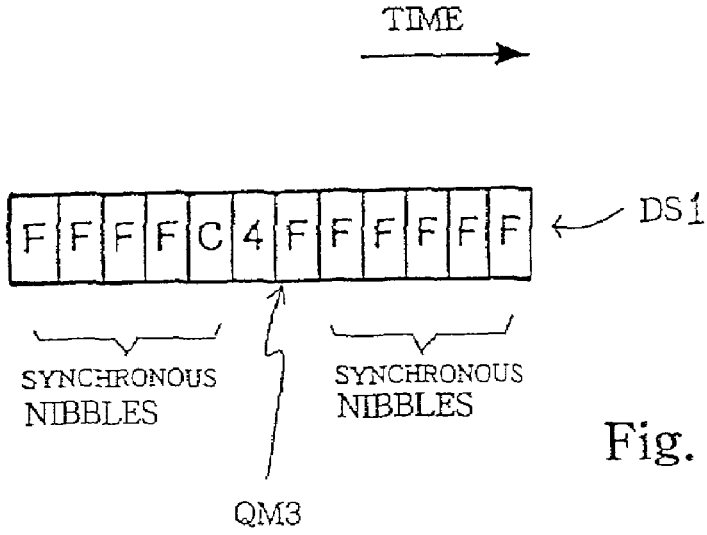
FIG. 13 is a view showing the quasi MIDI data word taken into the data stream.

After the MIDI music data word M2, the MIDI musical instrument is assumed to produce another MIDI data word M3 (see FIG. 11), and supplies the MIDI data word M3 to the data converter 112. The MIDI data words M3 contains the status byte [CF] representative of the program change at channel F (see FIG. 7). The data converter 112 checks the MIDI data word M3 to see whether or not the MIDI status byte is to be converted to a quasi MIDI status code. The MIDI status byte [CF] is fallen within the prohibit range, and the answer is given affirmative. Then, the data converter 112 accesses the data conversion table 116, and fetches the quasi MIDI status code [C4F] from the data conversion table 116. The data converter 112 replaces the MIDI status byte [CF] with the quasi MIDI status code [C4F], and produces a quasi MIDI music data word QM3 as shown in FIG. 12. The data converter 112 supplies the quasi MIDI data word QM3 to the data converter 113, and the data converter 113 supplements the synchronous nibble [F] into the irregular time intervals between the previous quasi MIDI data word and the quasi MIDI data word QM3 and between the quasi MIDI data word QM3 and the next quasi MIDI data word as shown in FIG. 13. Thus, the quasi MIDI music data word QM3 is taken into the nibble stream DS1.

Modulator 12

The modulator 12 successively changes the nibbles in the nibble stream DS1 to corresponding gray codes, and repeatedly adds a phase equivalent to the present gray code to the phase equivalent to the previous gray code for producing a modulating signal representative of the phase of the present data nibble. In other words, the modulator 12 accumulates the values of the phase for producing the modulating signal. The reason for the accumulation is that, even if the synchronous nibbles [F] are continued, the data reproducer 30 achieves the synchronization by using the phase continuously varied. Thus, the modulator 12 produces the modulating signal representative of the phase of the present nibble. Subsequently, the modulator 12 modulates the carrier signal with the modulating signal, and produces the audio-frequency signal AD1.

Figure 15:
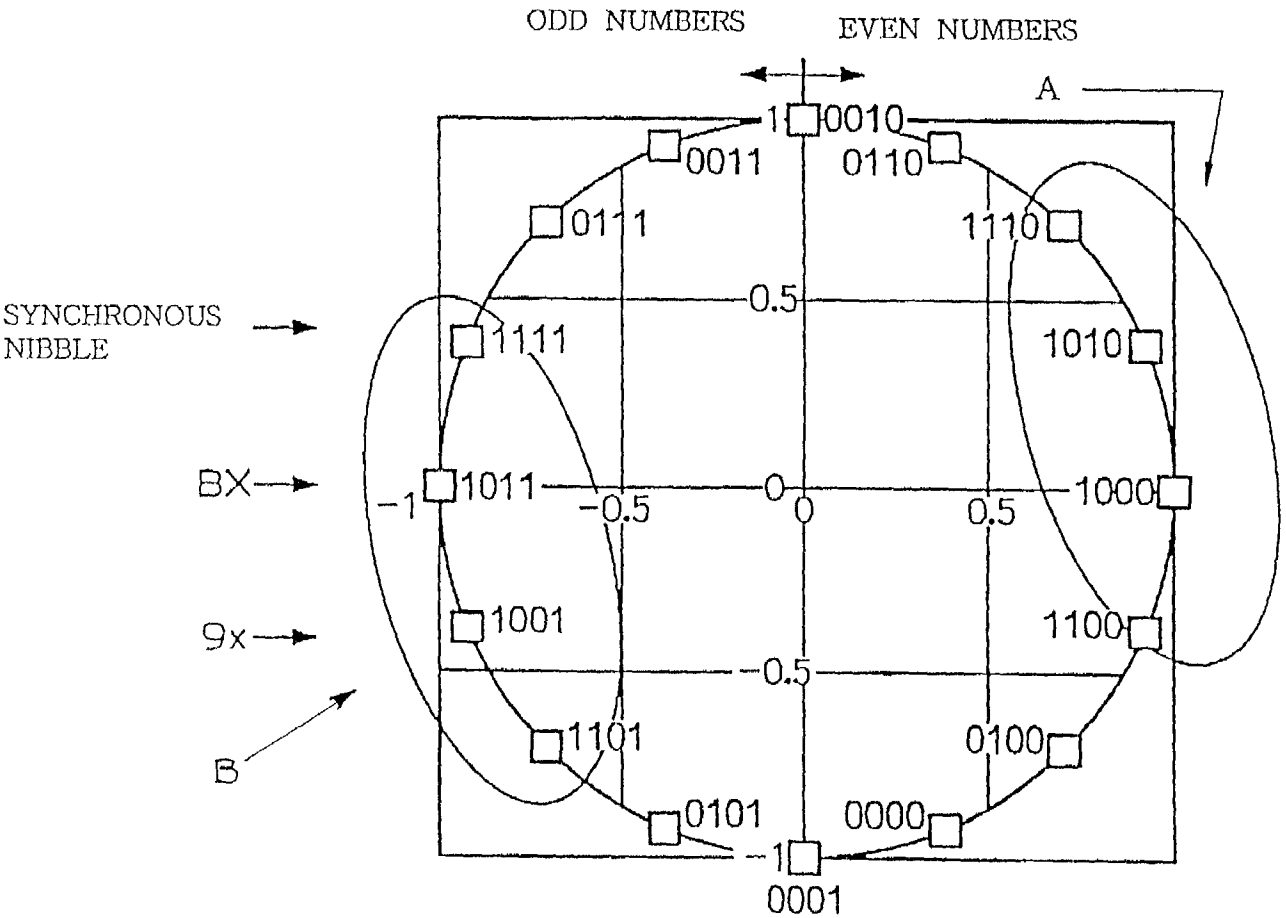
FIG. 15 is a graph showing a spacious arrangement of the gray codes.

FIG. 14 shows the relation among sixteen 4-bit gray codes, relative phase or the phase differences and I and Q components of Q-I coordinate system. FIG. 15 shows the relation between I-component and Q-component in the Q-I coordinate system. The second column from the left side in FIG. 14 is assigned to the position on the circle shown in FIG. 15.

In the Q-I coordinate system, 157.5 degrees is assigned to the gray code (1111) equivalent to the hexadecimal number [F], and the gray codes are arranged on the circle in the counter clockwise direction. Since the gray code [F] is positioned at 157.5 degrees, it is guaranteed that the phase is stepwise varied during the reception of the synchronous nibbles [F]. This means that the synchronization is surely achieved in the data reproducer 30. In case where the MIDI status bytes are alternated with the MIDI data bytes, it is appropriate to make the relative phase between the gray codes as large as possible. The MIDI status byte is usually alternated with the MIDI status data byte or bytes. For this reason, the gray codes greater than [8] and the gray codes less than [8] are appropriately assigned in the vicinity of 0/180 degrees and in the vicinity of 90/270 degrees in the Q-I coordinate system. The relative phase of zero is assigned to the gray code [8]. The phase is surely varied in so far as the gray code is not changed as [8]-[8]-[8]-[8]-[8]. These patterns are seldom in the data stream DS1 containing the MIDI music data words. For this reason, any scramble is not required.

In detail, the MIDI status byte and the MIDI data byte or bytes alternately appear in the nibble stream DS1. The MIDI status byte has the first nibble the bit 3 of which is value 1. On the other hand, the MIDI data byte has the first nibble the bit 3 of which is value 0. When the MIDI music data words are separated into nibbles, it is guaranteed that the most significant bits or bits 3 do not continuously take value 1. In the spacious arrangement for the modulating signal shown in FIGS. 14 and 15, the nibbles with bit 3 of 1 are assigned the positions in the vicinity of relative phase 0 so as not to continue relative phases around zero degree (see zone A in FIG. 15). If the data are continued to be around zero degrees, it is difficult to detect the boundary between the nibbles. This results in that the demodulated signal is liable to be out of the synchronization. The demodulated signal is less liable to be out of the synchronization by virtue of the above-described spacious arrangement for the modulating signal. The silent signal (1111) in the nibble stream DS1 has the most significant nibble corresponding to the gray code (1011), and the MIDI message representative of the control change [Bxxxxx] where x is indefiniteness also has the most significant nibble corresponding to the gray code (1011). The MIDI status byte representative of the note-on [90xxxx] has the most significant nibble corresponding to the gray code (1001). These are frequently generated in a performance. In order to clearly discriminate the boundaries in the data stream DS1, the corresponding gray codes are located in the vicinity of 180 degrees (see zone B).

Circuit Configuration of Modulator

Figure 16:
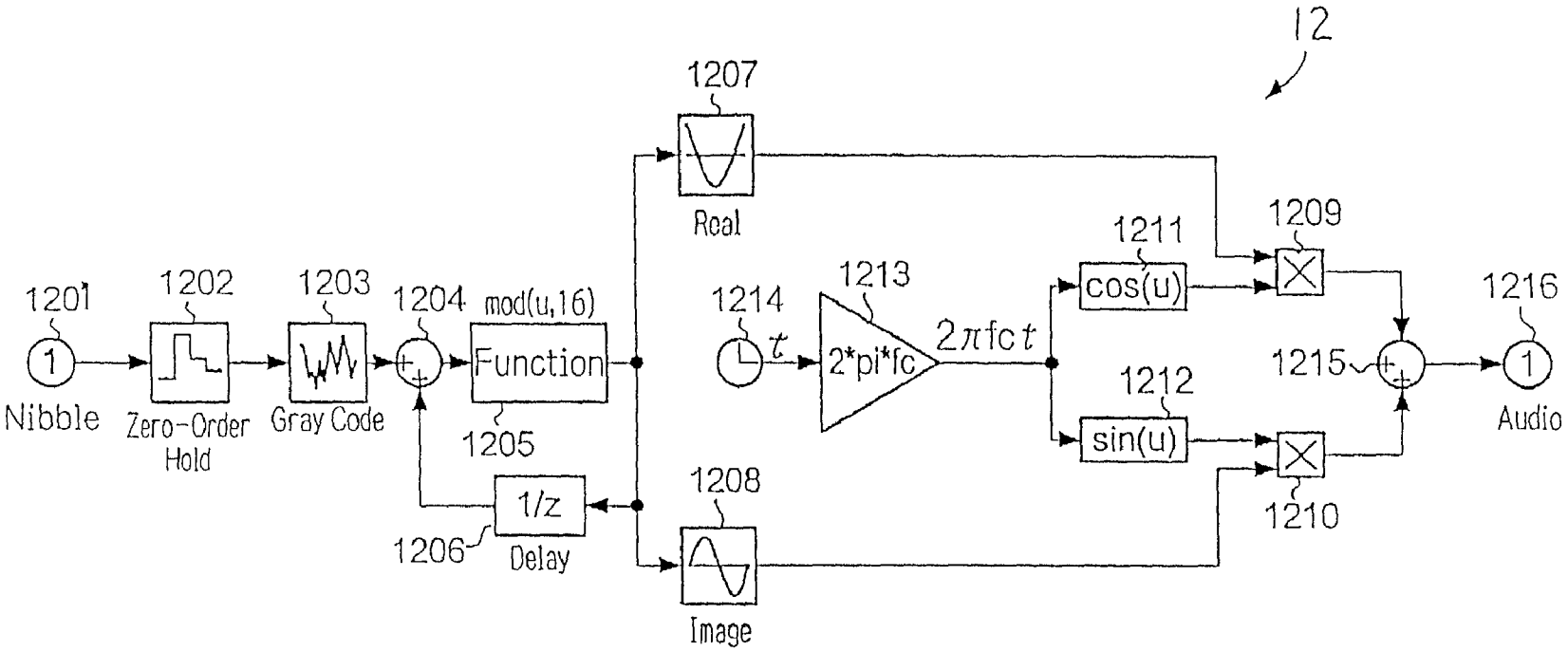
FIG. 16 is a block diagram showing the circuit configuration of a modulator incorporated in the data recorder.

The modulator 12 is hereinbelow described in detail with reference to FIG. 16. FIG. 16 shows the circuit configuration of the modulator 12. The modulator 12 includes a zero-order hold circuit 1202 and a gray code generator 1203. The zero-order hold circuit 1202 is connected to an input port 1201 of the signal modulation module 12, and the nibble stream DS1 is supplied from the input port 1201 to the zero-order hold circuit 1202. The zero-order hold circuit 1202 latches each data nibble, and maintains the data nibble until the next data nibble reaches. While the zero-order hold circuit 1202 holds a data nibble, the data nibble is supplied to the gray code generator 1203. The gray code generator 1203 converts the data nibble to the 4-bit gray code corresponding thereto. The 4-bit gray code is representative of the relative phase as described hereinbefore.

The modulator 12 further includes an adder 1204, a modulo function unit 1205 and a delay circuit 1206. The gray code generator 1203 is connected to the first input port of the adder 1204, and the output port of the adder 1204 is connected to the modulo function unit 1205. The output port of the modulo function unit 1205 is connected through the delay circuit 1206 to the second input port of the adder 1204. Thus, the adder 1204, the modulo function unit 1205 and the delay circuit 1206 form an accumulation loop for producing a 4-bit data code representative of an absolute phase from the given 4-bit gray codes representative of the relative phases. In detail, the modulo function unit 1205 divides the sum by sixteen, and outputs a 4-bit data code representative of the remainder. The remainder is representative of the absolute phase. The delay circuit 1206 introduce a time delay into the propagation of the 4-bit data code representative of the remainder from the modulo function unit 1205 to the second input port of the adder 1204. The next gray code reaches the first input port of the adder 1204, and the remainder is added to the value of the next gray code. Thus, the values of the relative phase or the phase differences are accumulated through the accumulation loop 1204, 1205 and 1206, and the 4-bit data code representative of the absolute phase is output from the modulo function unit 1205. The zero-order hold circuit 1202 and the gray code generator 1203 as a whole constitute a code converter for converting the binary code to the gray code. The accumulation loop 1204, 1205 and 1206 serves as a relative phase-to-absolute phase converter.

The modulator 11 further includes a real axis converter 1207 and an imaginary axis converter 1208 and multipliers 1209 and 1210. The 4-bit data code representative of the absolute phase is supplied to the real axis converter 1207 and the imaginary axis converter 1208. The real axis converter 1207 calculates an in-phase component, and outputs a data code representative of the in-phase component. On the other hand, the imaginary axis converter 1208 calculates a quadrature-phase component, and outputs a data code representative of the quadrature-phase component. The data codes are supplied from the real axis converter 1207 and the imaginary axis converter 1208 to the multipliers 1209 and 1210, respectively.

The modulator 12 further includes a cosine wave component generator 1211, a sine wave component generator 1212, a multiplier 1213, a clock circuit 1214 and an adder 1215. The clock circuit 1214 generates a time signal representative of the elapsed time t from the sampling timing. In other words, the elapsed time is reset at time intervals each equal to the sampling period. The time signal is supplied from the clock circuit 1214 to the multiplier 1213. A reference signal is representative of $2\pi fc$ where fc is the frequency of the carrier signal, and is supplied from a signal source (not shown) to the multiplier 1213. The multiplier 1213 multiplies the value of the reference signal $2\pi fc$ by the elapsed time t, and generates a reference phase signal $2\pi fct$. The reference phase signal $2\pi fct$ is supplied from the multiplier 1213 to the cosine wave component generator 1211 and the sine wave component generator 1212. The cosine wave component generator 1211 generates a cosine wave component signal representative of the cosine wave component of the carrier signal with unit amplitude, and the sine wave component generator 1212 generates a sine wave component signal representative of the sine wave component of the carrier signal with unit amplitude. The cosine wave component signal is supplied from the cosine wave component generator 1211 to the multiplier 1209, and the in-phase component is multiplied by the cosine wave component in the multiplier 1209. On the other hand, the sine wave component signal is supplied from the sine wave component generator 1212 to the multiplier 1210, and the quadrature-phase component is multiplied by the sine wave component. The multiplier 1209 outputs a product signal, and the product signal is supplied to the first input port of the adder 1215. On the other hand, the multiplier 1210 outputs a product signal, which is supplied to the second input port of the adder 1215. The product signals are added to each other in the adder 1215, and the audio-frequency signal AD1 is supplied from the adder 1215 to an output port 1216 of the modulator 12. The real axis converter 1207, the imaginary axis converter 1208, the multipliers 1209, 1210, the cosine wave component generator 1211, the sine wave component generator 1212, the clock circuit 1214, the multiplier 1213 and the adder 1215 as a whole constitute a quadrature modulation circuit. Thus, the signal modulation module 12 is broken down into the code converter 1202/1203, the relative phase-to-absolute phase converter 1204/1205/1206 and the quadrature modulation circuit 1207/1208/1209/1210/1211/1212/1213/1214/1215.

Data Reproducer 30

Turning back to FIG. 1 of the drawings, the data reproducer 30 includes the detector 100 and the demodulating unit 30A and the tone generator 40 as described hereinbefore. The detector 100 is hereinbelow described in detail.

Figure 17:
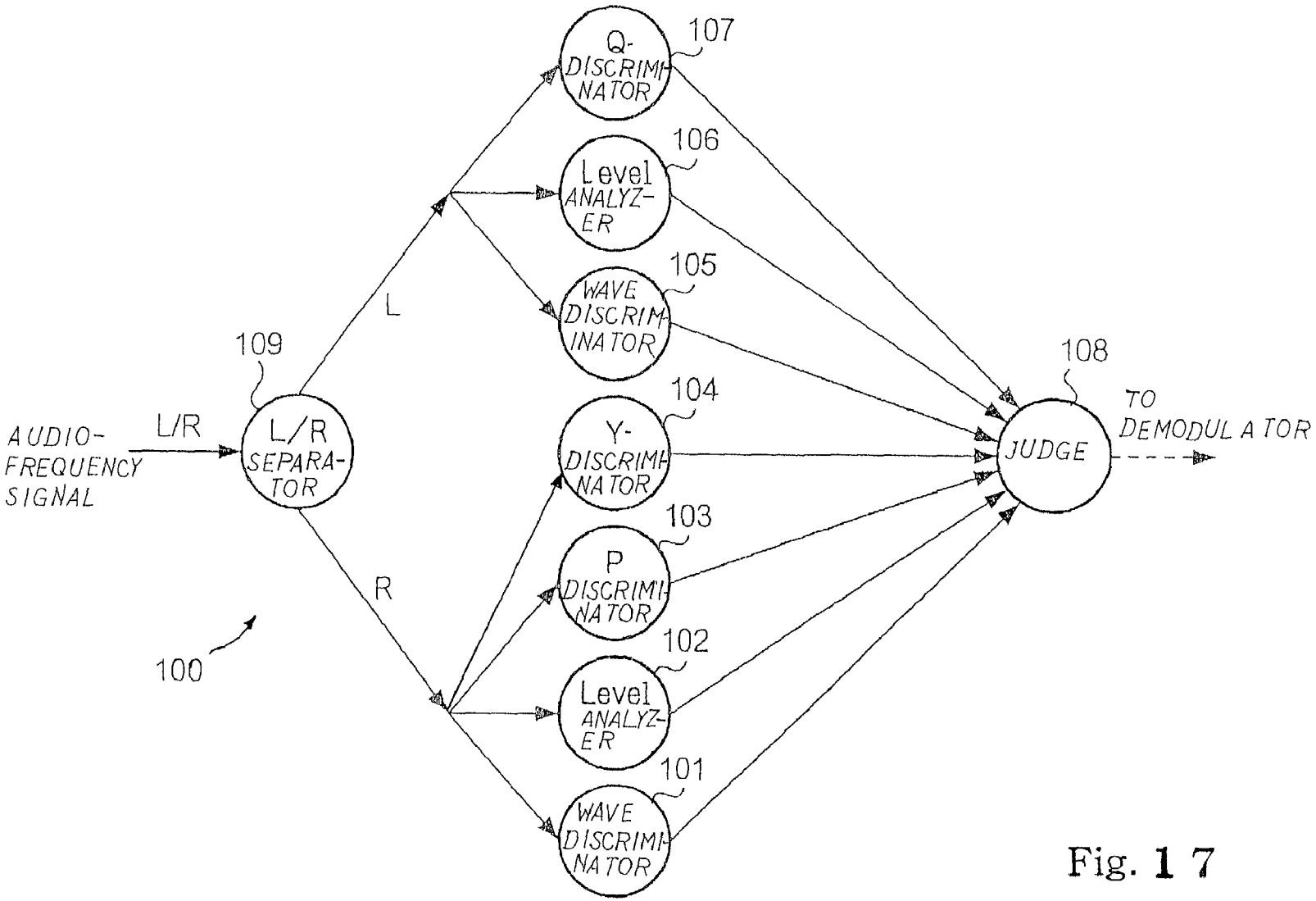
FIG. 17 is a block diagram showing the circuit configuration of a detector incorporated in the data reproducer.

FIG. 17 shows the circuit configuration of the detector 100. The digital audio signal is read out from the compact disc 22, and is demodulated to the audio-frequency signal. The audio frequency signal is supplied to the detector 100.

Circuit Configuration of Detector 100

The detector 100 includes a signal separator 109, two wave discriminators 101/105, two level analyzers 102/106, a P-modulation discriminator 103, a y-modulation discriminator 104, a Q-modulation discriminator 107 and a judging circuit 108. The signal separator 109 separates the audio-frequency signal to a right-channel signal R and a left-channel signal L. The right-channel signal R is supplied from the signal separator 109 to the wave discriminator 101, the level analyzer 102, the P-modulation discriminator 103 and the Y-modulation discriminator 104. On the other hand, the left-channel signal L is supplied from the signal separator 109 to the wave discriminator 105, the level analyzer 106 and the Q-modulation discriminator 107.

The wave discriminator 101 determines the average of the amplitude of the right-channel signal R and an amplitude range measured from the average by a certain value on both sides of the average. The wave discriminator 101 checks the right-channel signal R to see how long the right-channel signal is fallen within the amplitude range in a single period, and calculates the ratio of the time period fallen within the amplitude range to the time period out of the amplitude range. Finally, the wave discriminator 101 discriminates features of the waveform of the right-channel signal R, and supplies an output signal representative of the features or the sort of the right-channel signal R to the judging circuit 108. Similarly, wave discriminator 105 determines the average of the amplitude of the left-channel signal L and an amplitude range measured from the average by a certain value on both sides of the average. The wave discriminator 105 checks the left-channel signal to see how long the left-channel signal is fallen within the amplitude range, and calculates the ratio of the time period fallen within the amplitude range to the time period out of the amplitude range. Finally, the wave discriminator 105 discriminates features of the waveform of the left-channel signal L, and supplies an output signal representative of the features or the sort of the left-channel signal L to the judging circuit 108.

The level analyzers 102/106 compare the right-channel/left-channel signals R/L with a reference level to see the right-channel/left-channel signals R/L exceed the reference level. When the right-channel/left-channel signals R/L keep the amplitudes thereof under the reference level, the level analyzers 102/106 determine that the right-channel/left-channel signals represent the silence. On the other hand, when the level analyzers 102/105 notifies the right-channel/left-channel signals R/L exceeds the reference level, the level analyzers 102/105 determine that the right-channel/left-channel signals R/L carry pieces of music data information. The level analyzers 102/106 supply output signals representative of the meaningful or meaningless to the judging circuit 108.

The P-modulation discriminator 103, Y-modulation discriminator 104 and Q-modulation discriminator 107 analyze the right-channel signal R and the left-channel signal L, and determine whether or not the audio-frequency signal was modulated through the p-modulation, Y-modulation and Q-modulation in the data recorder 10. When the P-modulation discriminator 103, Y-modulation discriminator 104 or Q-modulation discriminator 107 discriminates the P-modulation, Y-modulation or Q-modulation from the other modulation technologies, the discriminator 103, 104 or 107 supplies a set of output signals representative of the modulation technique to the judging circuit 108. The other discriminators 104/107, 107/103 or 103/104 supply output sets of output signals each representative of the failure in the discrimination to the judging circuit 108.

Figure 18:
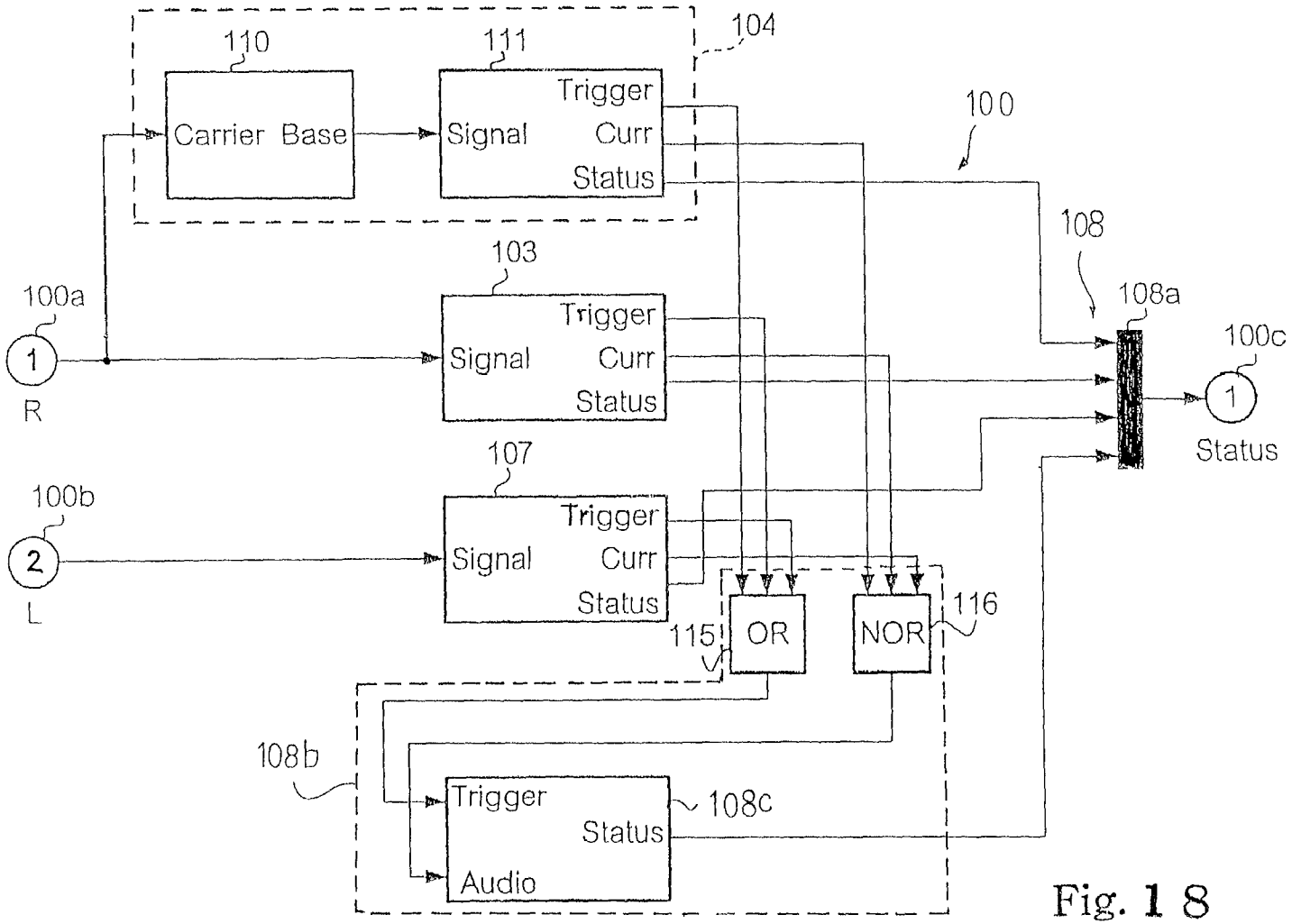
FIG. 18 is a block diagram showing the circuit configuration of a judging circuit together with modulation discriminators.

The judging circuit 108 includes a data processing unit 108*a* and an A-discriminator 108*b* (see FIG. 18). In order to show the relation between the modulation discriminators 103/104/107 and the judging circuit, the other components are deleted from FIG. 18. The output signals are supplied from the modulation discriminators 103/104/107 to the A-discriminator 108*b*, and the A-discriminator 108*b* carries out logic functions on the output signals to see whether or not the audio-frequency signal is equivalent to the external audio frequency signal. The A-discriminator 108*b* supplies an output signal representative of the equivalence to the external audio signal or the failure in the discrimination to the data processing unit 108*a*.

The data processing unit 108*a* receives the output signals from the discriminators 103/104/107/108*b*, and judges the sort of the original signal from which the audio-frequency signal was produced. A data table is incorporated in the data processing unit 108*a*. When the data processing unit 108*a* analyzes the output signals supplied from the discriminators 103/104/107/108*b*, the data processing unit 108*a* accesses the data table to see what is the most appropriate interpretation.

The Y-modulation discriminator 104 includes a demodulator 110 and a detector 111. The right-channel signal R is supplied to the input node Carrier of the demodulator 110, and a base band signal is eliminated from the right-channel signal R. Namely, the right-channel signal R is demodulated by the demodulator 110. The base band signal is supplied form the output node Base to the input node Signal of the detector 111. The detector 111 checks the base band signal to see whether or not the signal amplitude is varied on a certain pattern. When the answer is given affirmative, the detector changes the first output signal to logic "1" level representative of the certain pattern, and supplies the first output signal from the output node Trigger to the A-discriminator 108*b*. The detector 111 further checks the base band signal to see whether or not the certain pattern is nearly equal to 317.5 μs or a multiple of 317.5 μs, i.e., 317.5×n μs, which is unique to the Y-modulation. When the answer is given affirmative, the detector 111 changes the second output signal to logic "1" level, and supplies the second output signal from the output node Curr to the A-discriminator 108*b*. The detector 111 further checks the right-channel signal R to see whether or not the time period unique to the Y-modulation is repeated predetermined times. When the answer is given affirmative, the detector 111 changes the third output signal to logic "1" level, and supplies the third output signal from the output node Status to the data processing unit 108*a*. On the other hand, if the answer or answers are given negative, the detector supplies the output signal or signals of logic "0" level to the A-discriminator 108*b* and/or the data processing unit 108*a*. Thus, the Y-modulation discriminator 104 supplies the set of output signals, i.e., the first, second and third output signals to the judging circuit 108.

The P-modulation discriminator 103 has an input node Signal, and the right-channel signal R is directly supplied to the input node Signal. The P-modulation discriminator 103 checks the right-channel signal R to see whether or not the signal amplitude is varied on a certain pattern. When the answer is given affirmative, the P-modulation discriminator 103 changes the first output signal to logic "1" level, and supplies the first output signal from the output node Trigger to the A-discriminator 108*b*. The P-modulation discriminator 103 further checks the right-channel signal R to see whether or not the certain pattern is nearly equal to 259 μs or 129.5 μs, which are unique to the P-modulation. When the answer is given affirmative, the P-modulation discriminator 103 changes the second output signal to logic "1" level, and supplies the second output signal from the output node Curr to the A-discriminator 108*b*. The P-modulation discriminator 103 further checks the right-channel signal R to see whether or not the time period unique to the P-modulation is repeated predetermined times. When the answer is given affirmative, the P-modulation discriminator 103 changes the third output signal Status to logic "1" level, and supplies the third output signal from the output node Status to the data processing unit 108*a*. On the other hand, when the answer or answers are given negative, the P-modulation discriminator 103 supplies the output signal or signals of logic "0" level to the A-discriminator 108*b* and the data processing unit 108*a*. Thus, the P-modulation discriminator 103 supplies the set of output signals, i.e., the first, second and third signals to the judging circuit 108.

The Q-modulation discriminator 107 has an input node Signal, and the left-channel signal L is directly supplied to the input node Signal of the Q-modulation discriminator 107. The Q-modulation discriminator 107 checks the left-channel signal L to see whether or not the signal amplitude is varied on a certain pattern. When the answer is given affirmative, the Q-modulation discriminator 107 changes the first output signal to logic "1" level, and supplies the first output signal from the output node Trigger to the A-discriminator 108*b*. The Q-modulation discriminator 107 further checks the left-channel signal L to see whether or not the certain pattern is nearly equal to 145 μs, 290 μs, 581 μs or 3855 μs, which are unique to the Q-modulation. When the answer is given affirmative, the Q-modulation discriminator 107 changes the second output signal to logic "1" level, and supplies the second output signal from the output node Curr to the A-discriminator 108*b*. The Q-modulation discriminator 107 further checks the left-channel signal L to see whether or not the time period unique to the Q-modulation is repeated predetermined times. When the answer is given affirmative, the Q-modulation discriminator 107 changes the third output signal Status to logic "1" level, and supplies the third output signal from the output node Status to the data processing unit 108*a*. On the other hand, when the answer or answers are given negative, the Q-modulation discriminator 107 supplies the output signal or signals of logic "0" level to the A-discriminator 108*b* and the data processing unit 108*a*. Thus, the Q-modulation discriminator 107 supplies the set of output signals, i.e., the first, second and third signals to the judging circuit 108. The A-discriminator 108*b* includes a three-input OR gate 115, a three-input NOR gate 116 and a detector 108*c*. The second output signals are supplied from the modulation discriminators 104/103/107 to the three input nodes of the NOR gate 116. On the other hand, the first output signals are supplied from the modulation discriminators 104/103/107 to the three input nodes of the OR gate 115. When at least one of the modulation discriminators 104/103/107 admits the certain pattern of the base band signal, right-channel signal or the left-channel signal, the OR gate 115 changes the output signal to logic "1" level, and supplies the output signal to the input node Trigger of the detector 108*c*. On the other hand, when the certain patterns are not observed in the base band signal, right-channel signal R and the left-channel signal L, the OR gate 115 keeps the output signal in logic "0" level. The NOR gates 116 checks the second output signals to see whether or not the unique time period is observed in the base band signal, the right-channel signal or the left-channel signal. When at least one of the modulation discriminators 104/103/107 detects the time period unique to the Y-modulation, P-modulation or Q-modulation, the NOR gate 116 keeps the output signal in logic "0" level. On the other hand, when all the base-band, right-channel and left-channel signals do not vary the amplitude in the time period unique to the Y-modulation, P-modulation and Q-modulation, the NOR gate 116 changes the output signal to logic "1" level. The output signal is supplied from the NOR gate 116 to the input node Audio of the detector 108*c*. When one of the following conditions is satisfied, the detector 108*c* determines that the audio-frequency signal was equivalent to the external audio signal not containing any MIDI music data code, and supplies the output signal of logic "1" level to the data processing unit 108*a*. One of the conditions is that the NOR gate 116 keeps the output signal in the logic "1" level for a certain time period. In other words, any modulation discriminator 104/103/107 does not detect the certain patterns unique to the Y-modulation, P-modulation and Q-modulation, and the absence of certain patterns is continued a predetermined time period. Another condition is that the modulation discriminator 104/103/107 can not the modulation technique for a predetermined time period after reaching the right-channel/left-channel signals R/L to the input nodes 100*a*/100*b*. The output signal is supplied from the output node Status of the detector 108*c* to the data processing unit 108*a*.

The data processing unit 108*a* analyzes the first output signals of the modulation discriminators 104/103/107, the output signal of the A-discriminator 108*b* and the output signals of the wave discriminators 101/105 and the output signals of the level analyzers 102/106 with assistance of the data table. The data processing unit 108*a* determines the sort of the audio-frequency signal, i.e., the audio-frequency signal carrying the MIDI messages or the audio-frequency signal without any MIDI message and the modulation technique employed in the modulator 12. The data processing unit 108*a* produces the control data signal representative of the results, and supplies the output signal from the output node Status to the demodulating unit 30A.

Circuit Configuration of Wave Discriminator 101/105

Figure 19:
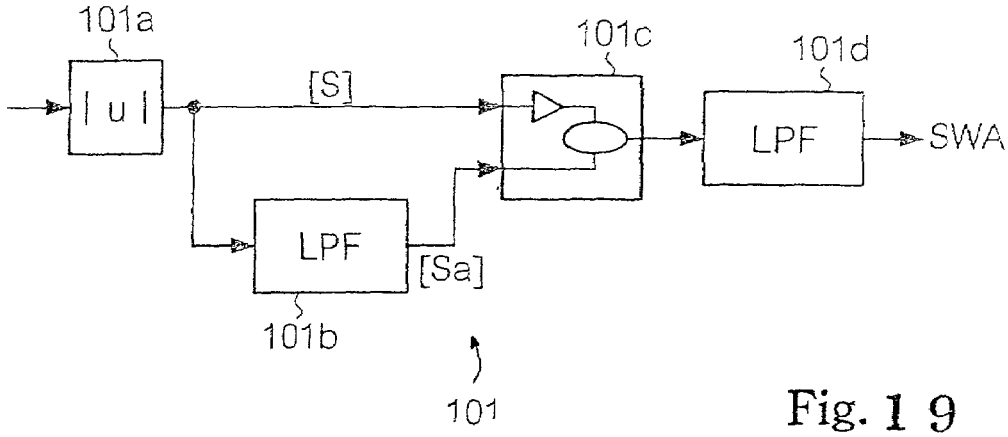
FIG. 19 is a block diagram showing the circuit configuration of a wave discriminator incorporated in the detector.

Subsequently, description is made on the circuit configuration of the wave discriminators 101/105 with reference to FIG. 19. The wave discriminator 101 is similar in circuit configuration to the wave discriminator 105, and, for this reason, description is made on the wave discriminator 101, only. The wave discriminator 101 includes an absolute value generator 101*a*, low-pass filters 101*b*/101*d* and a comparator 101*c*. The right-channel signal R is supplied to the absolute value generator 101*a*. The cut-off frequency of the low pass filter 101*b* is 50 Hz, and the low pass filter 101*d* has the cut-off frequency of 25 Hz. The absolute value generator 101*a* gives a series of instantaneous absolute values [S] to the amplitude of the right-channel signal R. In other words, while the right-channel signal R is being varied in the negative range, the negative wave portion is mirrored, and is changed to a corresponding positive wave portion. The absolute value generator 101*a* supplies an output signal representative of the instantaneous absolute values [S] to both of the low pass filter 101*b* and the comparator 101*c*. The low pass filter 101*b* averages the instantaneous absolute values [S] of the right-channel signal R, and supplies an output signal representative of the average [Sa] to the comparator 101*c*.

Figure 20:
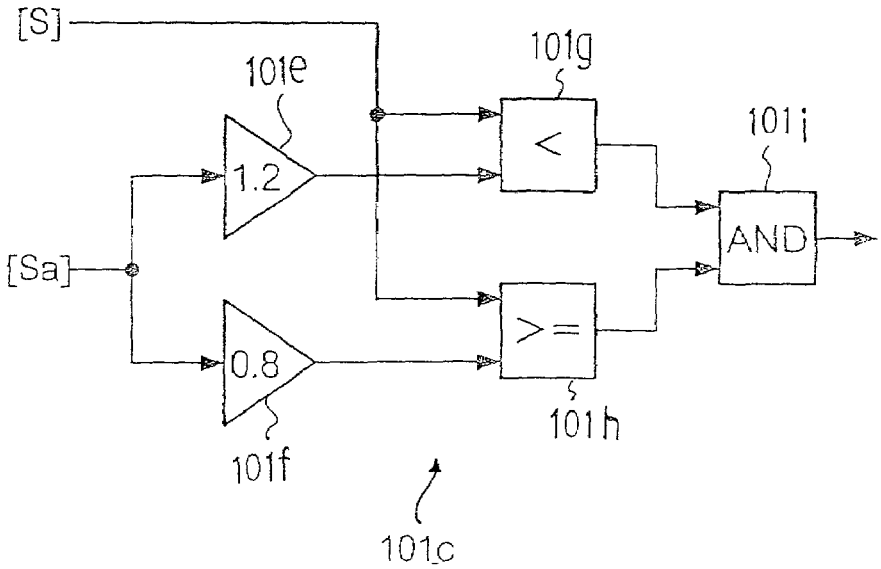
FIG. 20 is a block diagram showing the circuit configuration of a comparator incorporated in the wave discriminator.

The comparator 101*c* includes two threshold generators 101*e*/101*f*, two comparing circuits 101*g*/101*h* and an AND gate 101*i* (see FIG. 20). The output signal representative of the average [Sa] is supplied to the threshold generators 101*e*/101*f*. The threshold generator 101*e* calculates an upper threshold of the predetermined range, which is 120 percent of the absolute value [Sa], and a lower threshold of the predetermined range, which is 80 percent of the absolute value [Sa]. The threshold generator 101*e* supplies an output signal representative of the upper threshold to the comparing circuit 101*g*, and the other threshold generator 101*f* supplies an output signal representative of the lower threshold to the comparing circuit 101*h*. The comparing circuit 101*g* compares the instantaneous absolute value [S] with the upper threshold to see whether or not the instantaneous absolute value [S] is less than the upper threshold, and supplies an output signal of logic "1" level to the AND gate 101*i* when the answer is given affirmative. On the other hand, the other comparing circuit 101*h* compares the instantaneous absolute value [S] with the lower threshold to see whether or not the instantaneous absolute value [S] is equal to or greater than the lower threshold, and supplies an output signal of logic "1" level when the answer is given affirmative. The comparing circuits 101*g*/101*h* keep the output signals in logic "0" level when the answers are given negative. The output signal of the comparing circuit 101*g* is ANDed with the output signal of the other comparing circuit 101*h* through the AND gate 101*i*. Only when both of the output signals are logic "1" level, the AND gate 101*i* supplies an output signal representative of the instantaneous absolute value [S] within the predetermined range to the low pass filter 101*d*.

Figure 21:
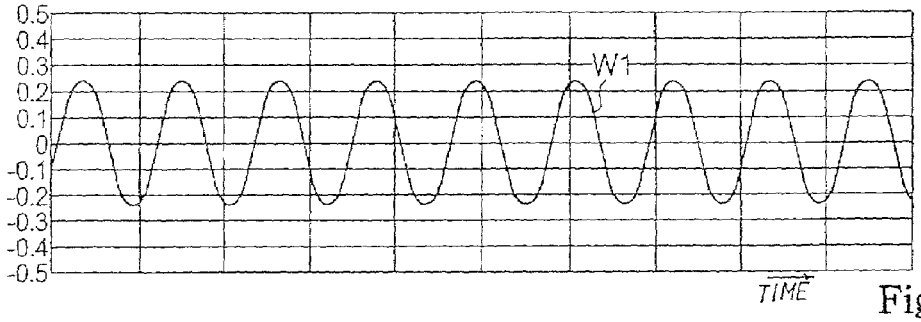
FIGS. 21 to 24 are diagrams showing the waveforms of essential signals in the wave discriminator.
Figure 22:
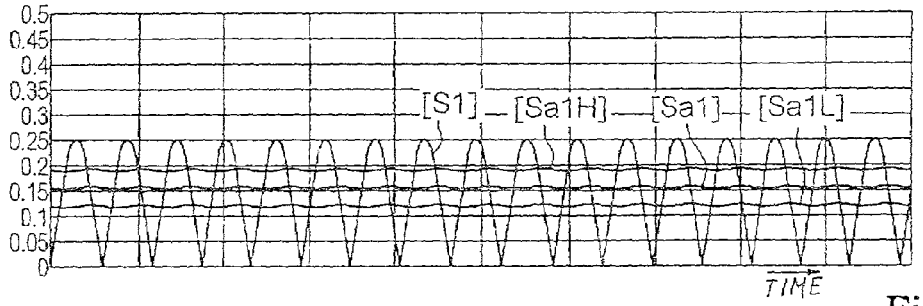
Figure 23:
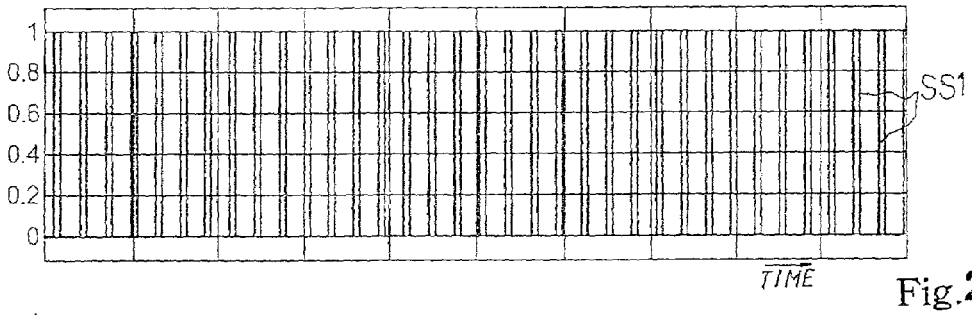

The circuit behavior of the wave generator 101 is described in detail with reference to FIGS. 21 to 24. Assuming now that the right-channel signal R is varied along the waveform W1 like a sine wave as shown in FIG. 21, the negative portions of the right-channel signal R is mirrored through the absolute value generator 101*a*. The output signal S1 is varied only in the positive range, and has the waveform [S1] shown in FIG. 22. The upper threshold is labeled with Sa1H, and the lower threshold is labeled with Sa1L. The comparing circuits 101*g*/101*h* compare the waveform S1 with the thresholds Sa1H/Sa1L, respectively, and the AND gate 101*i* changes the output signal as indicated by SS1 in FIG. 23. The low-pass filter 101*d* smoothens the output signal of the comparator 101*c*, and supplies the output signal SWA (see FIG. 24) to the judging circuit 108.

Figure 25:
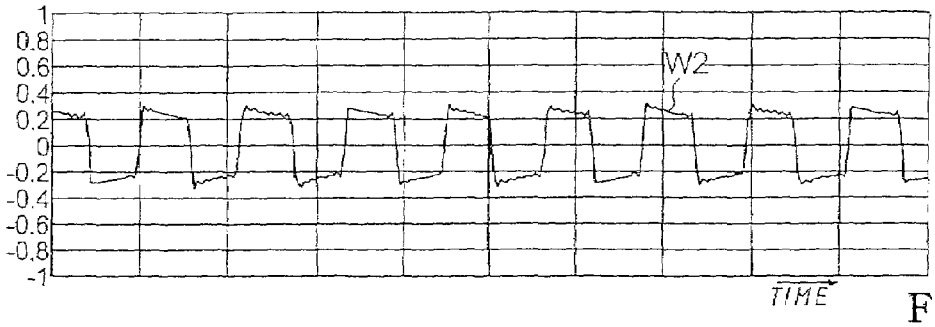
FIGS. 25 to 28 are diagrams showing the waveforms of the essential signals when a right-channel signal is differently varied.
Figure 26:
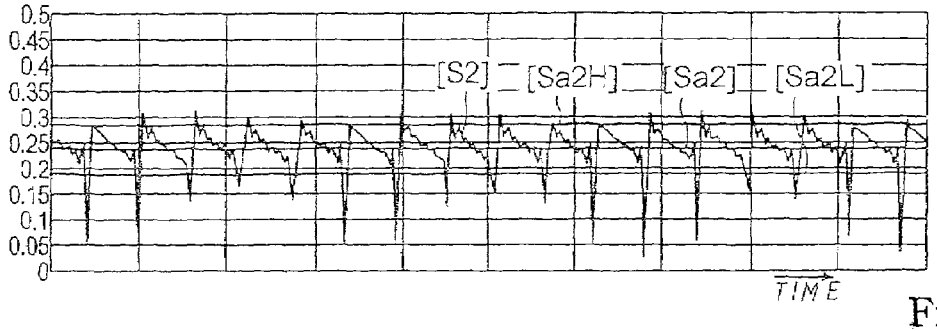
Figure 27:
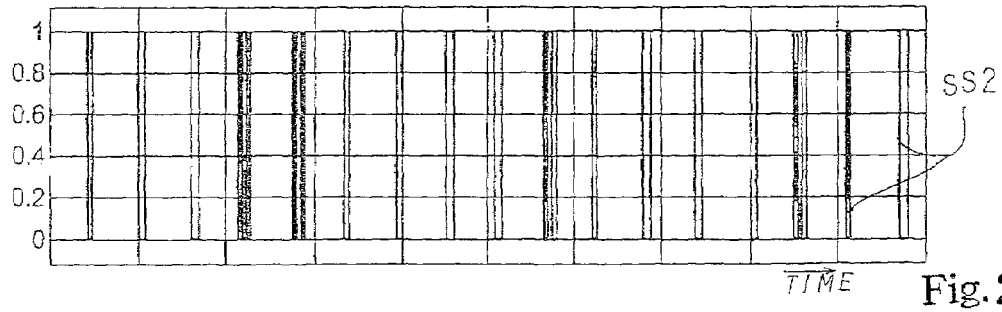

When the right-channel signal is varied like a pulse train W2 (see FIG. 25), the instantaneous absolute value is represented by plots S2 (see FIG. 26), and the threshold generators 101*e*/101*f* supply the output signals representing the waveforms Sa2H and Sa2L to the comparing circuits 101*g*/101*h*. While the instantaneous absolute value is fallen within the predetermined range, the AND gate 101*i* keeps the output signal in logic "1" level as indicated by SS2 (see FIG. 27). The low pass filter 101*d* produces the output signal SWA from the output signal SS2 as shown in FIG. 28.

Figure 24:
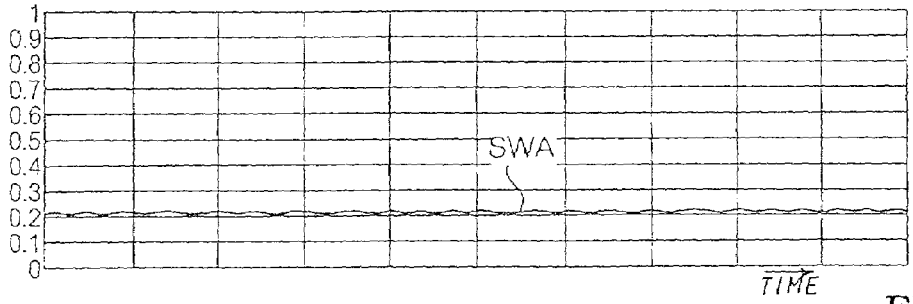
Figure 28:
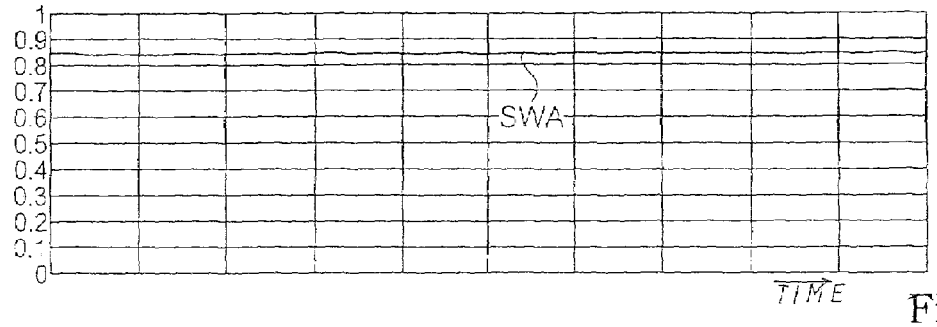

Comparing FIG. 24 with FIG. 28, the output signals SWA are different in level from each other. This is because of the fact that the right-channel signal W1 is varied widely rather than right-channel signal W2. In detail, the waveform W1 is swung widely with respect to the average S1, and the wave discriminator 101 keeps the output signal SWA relatively low, i.e., 0.2. On the other hand, the waveform W2 is swung within a relatively narrow range, and, accordingly, the wave discriminator 101 keeps the output signal SWA relatively high, i.e., 0.85. The right-channel signal R is varied within the predetermined range for a time period T1, and out of the predetermined range for a remaining time period T2. The wave discriminator 101 adjusts the potential level of the output signal to a value corresponding to the ratio T1/(T1+T2). The more analogous to the sine wave, the closer to value 0.2. When the right-channel signal is a perfect rectangular pulse, the output signal SWA is adjusted to 1. However, when the right-channel signal R contains a large mount of pulse component, the output signal SWA has a potential level nearer to 0.85. Thus, the wave discriminator 101 changes the potential level of the output signal depending upon the waveform of the right-channel signal R.

When the audio-frequency signal was produced through the Y-modulation, the output signal SWA has the level equal to or less than 0.4. On the other hand, if the Q-modulation is employed in the modulator 12, the output signal SWA has the level equal to or less than 0.3 in a certain time period from the initiation of the reproduction, and changes the level to 0.7 or more after the certain time period. This is because of the fact that the audio-frequency signal has a head portion almost like the sine wave. The audio-frequency signal produced through the P-modulation results in the output signal SWA equal to or greater than 0.8.

Circuit Configuration of Level Analyzer 102/106

Figure 29:
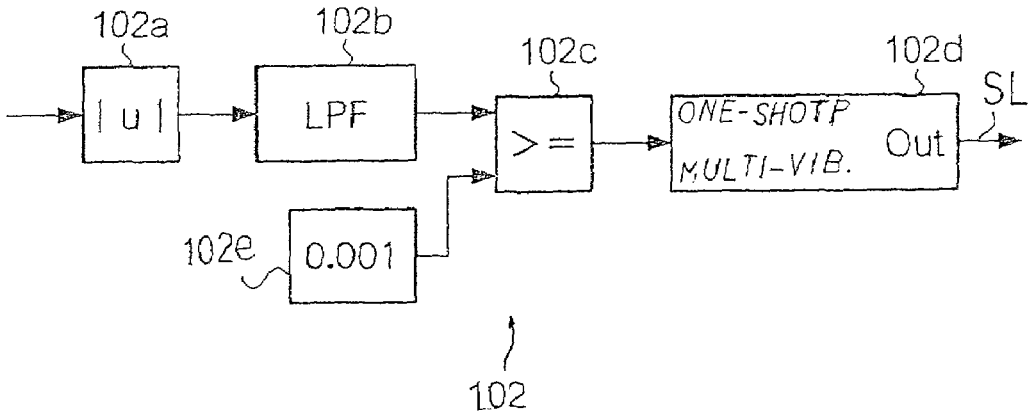
FIG. 29 is a block diagram showing the circuit configuration of a level analyzer incorporated in the detector.

FIG. 29 shows the circuit configuration of the level analyzers 102/106. The level analyzer 102 is similar in circuit configuration to the level analyzer 106, and, for this reason, only the level analyzer 102 is described hereinbelow.

The level analyzer 102 includes an absolute value generator 102*a*, a low pass filter 102*b*, a comparator 102*c*, a one-shot multi-vibrator 102*d* and a threshold generator 102*e*. The low-pass filter 102*b* has the cut-off frequency of 100 Hz. The right-channel signal R is supplied to the absolute value generator 102*a*. The absolute value generator 102*a* gives a series of instantaneous absolute values to the amplitude of the right-channel signal R. In other words, while the right-channel signal R is being varied in the negative region, the absolute value generator 102*a* mirrors the negative portion of the waveform, and changes the negative portion to the corresponding positive portion. The absolute value generator 102*a* supplies an output signal representative of the instantaneous absolute value to the low pass filter 102*b*. The low pass filter 102*b* eliminates the high-frequency components from the output signal, and supplies an output signal representative of the low-frequency component to the comparator 102*c*. The threshold generator 102*e* generates a reference signal representative of an extremely small threshold, and supplies the reference signal to the comparator 102*c*. When the low frequency component is equal to or greater than the threshold, the comparator 102*c* supplies an output signal of logic "1" level to the one-shot muti-vibrator 102*d*. On the other hand, if the low frequency component is less than the threshold, the comparator 102*c* supplies the output signal of logic "0" level to the one-shot multi-vibrator 102*d*. The threshold is so small that the threshold generator 102*c* changes the output signal to logic "1" level in so far as the right-channel signal R does not respond the silence. The one-shot multi-vibrator is responsive to the pulse rise of the output signal so as to change an output signal SL of logic "1" level. When the output signal of the comparator 102*c* is decayed, the one-shot multi-vibrator 102*d* changes the output signal SL to logic "0" level upon expiry of a predetermined time period. Thus, the output signal SL of logic "0" level is representative of the silence or the absence of any piece of music data information, and the output signal SL of logic "1" level is representative of the right-channel signal R carrying pieces of music data information.

Circuit Configuration of Demodulator 110

Figure 30:
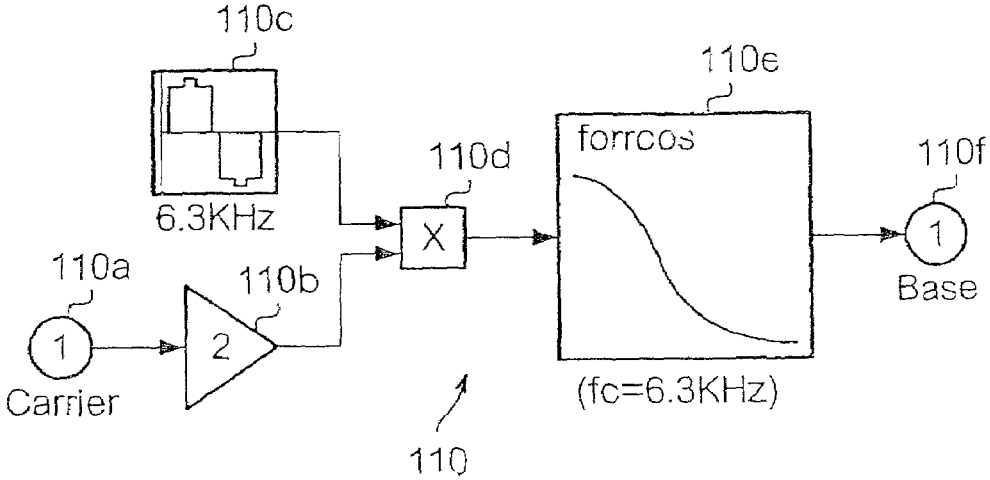
FIG. 30 is a block diagram showing the circuit configuration of a demodulator incorporated in a Y-modulation discriminator.

FIG. 30 shows the circuit configuration of the demodulator 110 (see FIG. 18). The demodulator 110 includes the signal input port 110*a*, an amplifier 110*b*, a sine wave generator 110*c*, a multiplier 110*d*, a low-pass filter 110*e* and a signal output port 110*f*. The right-channel signal R is supplied to the signal input port 110*a*, and is transferred to the amplifier 110*b*. The right-channel signal R is increased in magnitude by the amplifier 110*b*, and the amplified signal is supplied to the first input port of the multiplier 110*d*. The sine wave generator 110*c* produces a sine wave signal, and supplies the sine wave signal to the second input port of the multiplier 110*d*. The sine wave signal is equal in frequency to the carrier signal. In this instance, the carrier frequency is 6.3 kHz, and, accordingly, the sine wave signal is produced at 6.3 kHz. The amplified signal is multiplied with the sine wave signal, and the multiplier 110*b* produces an output signal representative of the product, and supplies the output signal to the low-pass filter 110*e*. The low-pass filter 110*e* is implemented by $14^{th}$-order cosine roll-off filter, and fc is 6.3 kHz. The output signal of the multiplier 110*d* is filtered, and the base-band signal is extracted therefrom, if any.

Circuit Configuration of Detector 111

Figure 31:
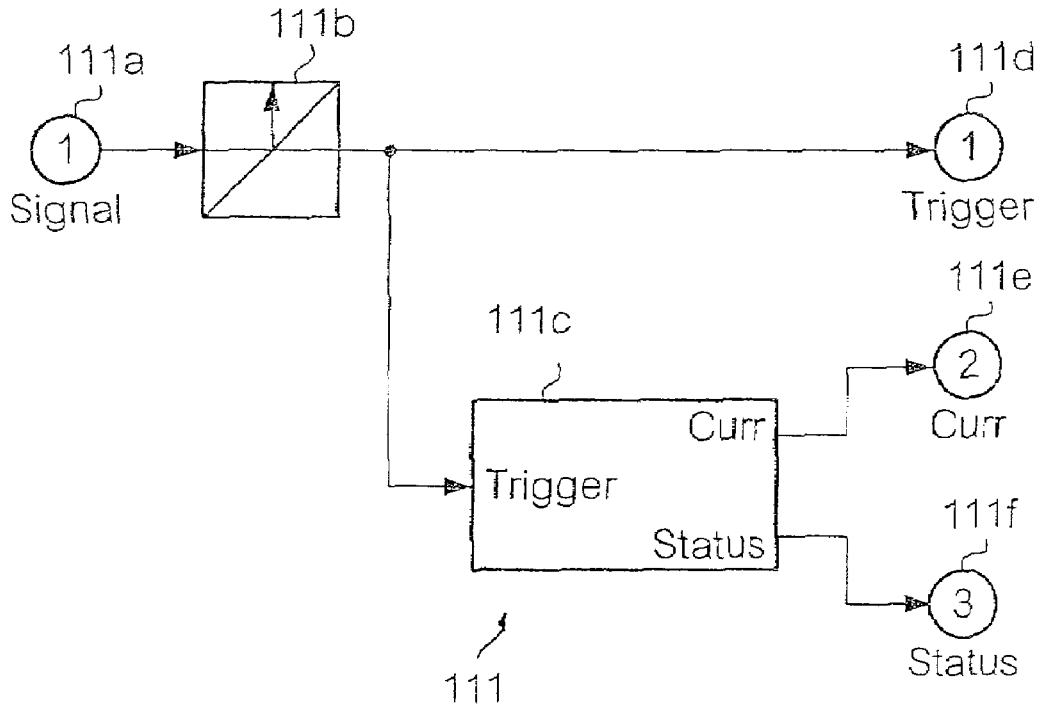
FIG. 31 is a block diagram showing the circuit configuration of a detector incorporated in the Y-modulation discriminator.

FIG. 31 shows the circuit configuration of the detector 111. The detector 111 has an input port 111*a* and output ports 111*d*, 111*e* and 111*f*, and a zero-crossing detector 111*b* and an interval discrimination circuit 111*c* are connected between the input port 111*a* and the output ports 111*d*/111*e*/111*f*. The zero-crossing detector 111*b* exhibits hysteresis characteristics. The baseband/non-base-band signal is supplied from the output port 110*f*, i.e., Base to the input port 111*a*, and is transferred to the zero-crossing detector 111*b*. The zero-crossing detector 111*b* checks the base-band/non-base-band signal to see whether or not the potential level crosses zero, i.e., from logic "0" level to logic "1" level and vice versa. Half-amplitude levels are determined on both sides of zero level. When the demodulator 110 changes the base-band/non-base-band signal from a positive level over one of the half-amplitudes level in the positive region to a negative level under the other half-amplitude level at every time interval equal to the sampling period, the zero-crossing detector admits a certain waveform, and produces the output signal of logic "1" level at the output node thereof. On the other hand, if the base-band/non-baseband signal is not changed across the half-amplitude levels, the zero-crossing detector 111*b* does not admit the certain waveform, and keeps the signal in logic "0" level. The zero-crossing detector 111*b* supplies the signal from the output node thereof to the output port 111*d* and the input port Trigger of the interval discriminating circuit 111*c*.

The interval discriminating circuit 111*c* includes the first counter responsive to the sampling clock signal so as to increment the value stored therein. The first counter is reset to zero when the signal of logic "1" level reaches the input port Trigger. While the zero-crossing detector 111*b* is keeping the signal in logic "0" level, the first counter increments the value at every sampling timing. This means the first counter measures the period of the base-band/non-base-band signal. When the zero-crossing detector 111*b* changes the signal to logic "1" level, the interval discriminating circuit 111*c* checks the value to see whether or not the base-band/non-base-band signal continuously varies the amplitude at the time intervals approximated to 317.5×n μs unique to the Y-modulation. If the interval discriminating circuit 111*c* finds the time interval to be unique to the Y-modulation, the interval discriminating circuit 111*c* changes the signal at the output port 111*e*, i.e., Curr to logic "1" level.

The interval discriminating circuit 111*c* further has the second counter. When the interval discriminating circuit 111*c* finds the time interval to be different from that unique to the Y-modulation, the interval discriminating circuit 111*c* presets the second counter to a predetermined value. On the other hand, if the time interval is unique to the Y-modulation, the interval discriminating circuit 111*c* decrements the predetermined value. When the second counter reaches zero, the interval discriminating circuit 111*c* decides that the audio-frequency signal was modulated through the Y-modulation, and changes the signal at the output port 111*f*, i.e., Status to logic "1" level.

The sampling period is assumed to be 22.68 μs. When the zero-crossing detector 111*b* changes the signal at the output port 111*d*, i.e., Trigger to logic "1" level, the interval discriminating circuit 111*c* divides the value stored in the first counter by 14, and checks the calculating result to see whether or not the remainder is any one of 13, 0 and 1. The remainders "13", "0" and "1" are resulted from calculations (22.68 μs×(14n−1)=(317.5n−22.68)μs), (22.68 μs×14n=317.5 μs) and (22.68 μs×(14n+1)=(317.5n+22.68) μs) where n is a natural number. If the remainder is either 13, 0 or 1, the baseband signal has the edge-to-edge interval equivalent to 317.5×n μs.

The predetermined value is assumed to be 8. The second counter is preset to 8. When the remainder is 13, 0 or 1, the predetermined value is decremented by 1. If the division continuously results in the remainder 13, 0 or 1 eight times, the second counter reaches zero, and the interval discriminating circuit 111*c* decides that the audio-frequency signal R was modulated through the Y-modulation technique.

Circuit Configuration of Modulation Discriminators 103/107

The modulation discriminators 103 and 107 are similar in circuit configuration to the detector 111, and the modulation discriminators 103, 107 are responsive to the sampling clock signal same as the sampling clock supplied to the detector 111. For this reason, the components of each modulation discriminator 103/107 are labeled with the references designating the corresponding components of the detector 111. The signal input port 111*a* is replaced with the signal port 100*a* in the P-modulation discriminator 103 and with the signal port 100*b* in the Q-modulation discriminator 107.

The right-channel signal R is directly supplied to the P-modulation discriminator 103, and the left-channel signal L is directly supplied to the Q-modulation discriminator 107. The zero-crossing detectors 111*b* of the modulation discriminators 104/107 are different in detecting level from the zero-crossing detector 111 b incorporated in the detector 111, and the interval discriminating circuits 111*c* of the modulation discriminators 103/107 are different in criteria for the period and the preset value from the interval discriminating circuit 111*c*.

The sampling period is assumed to be 22.68 μs. The interval discriminating circuit of the P-modulation discriminator 103 behaves as follows. The first counter is incremented in response to the sampling clock signal. When the signal at the port Trigger is changed to logic "1" level, the interval discriminating circuit 111*c* of the modulation discriminator 103 checks the first counter to see whether or not the value stored therein is equal to 5, 6, 11 or 12. If the answer is positive, the interval discriminating circuit 111*c* decides that the edge-to-edge interval is equal to 129.5 μs or 259 μs, and the interval discriminating circuit 111*c* changes the signal at the port Curr to logic "1" level. The second counter is preset to 16, and the value stored in the second counter is decremented by one when the first counter outputs the signal of logic "1" level to the port Curr. When the value stored in the second counter reaches zero, the interval discriminating circuit 111*c* decides that the audio-frequency signal was modulated through the P-modulation technique.

The sampling period is also assumed to be 22.68 μs. The interval discriminating circuit 111*c* incorporated in the Y-modulation discriminator 107 behaves as follows. The first counter is also incremented in response to the sampling clock signal. When the signal at the port Trigger is changed to logic "1" level, the interval discriminating circuit 111*c* checks the first counter to see whether or not the value stored therein is equal to 6, 7, 12, 13, 14, 26, 27 or 166 to 174. If the answer is positive, the interval discriminating circuit 111*c* decides that the edge-to-edge interval is equal to 145 μs, 290 μs, 581 μs or 3855 μs, and the interval discriminator 111*c* changes the signal at the port Curr to logic "1" level. The second counter is also preset to 16, and the value stored in the second counter is decremented by one when the first counter outputs the signal of logic "1" level to the port Curr. When the value stored in the second counter reaches zero, the interval discriminator decides that the audio-frequency signal was modulated through the Q-modulation technique.

Software Implementation

Interval Discriminating Circuits 111*c*

Figures 32A, 32B:
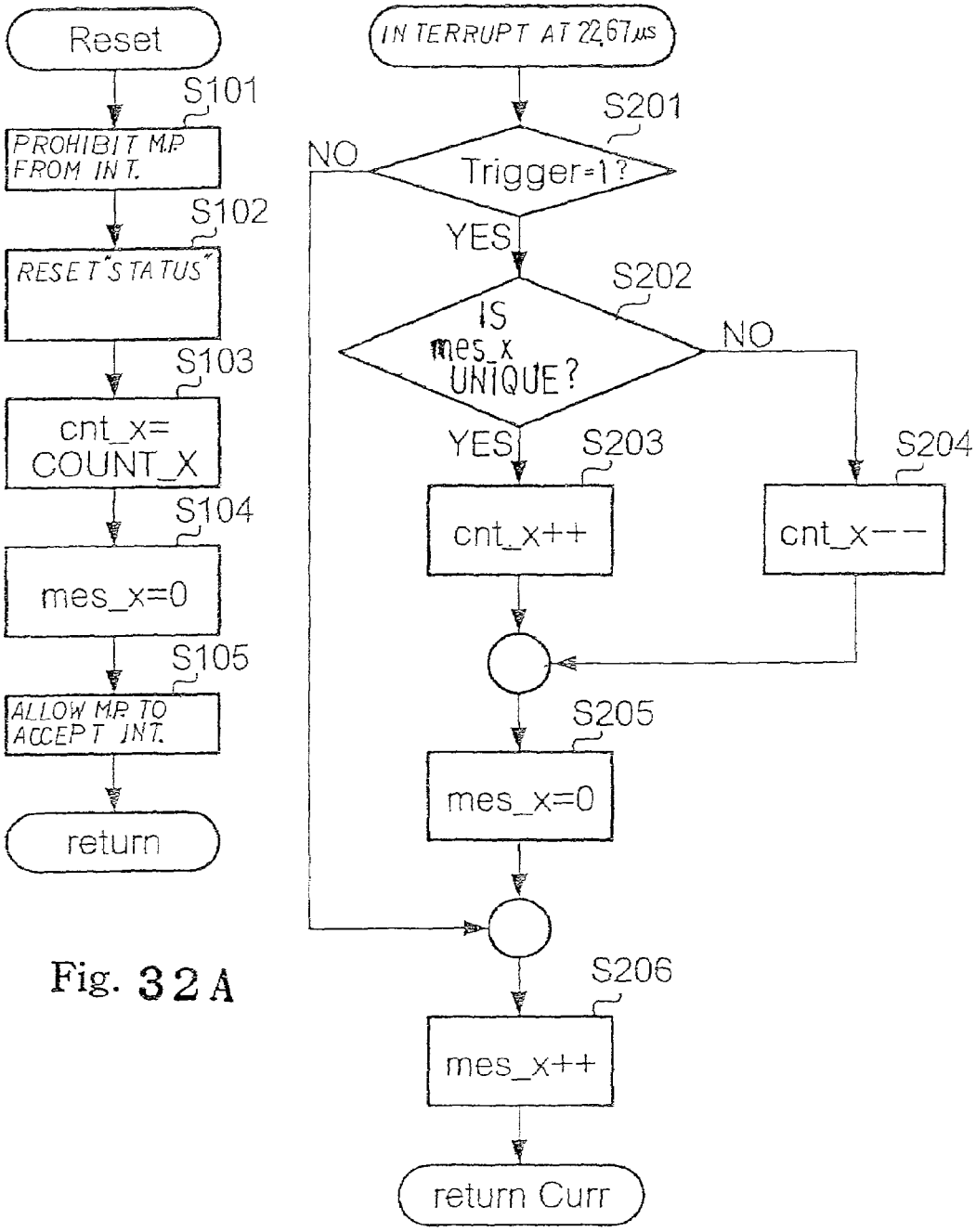
FIGS. 32A and 32B are flowcharts showing P-modulation/Q-modulation discriminators and the detector implemented by software.

The interval discriminating circuits 111*c* of the modulation discriminators 104, 103 and 107 may be implemented by software. In this instance, the detector 100 includes a microprocessor, a program memory, a working memory, an interface and a bus system connected to the other components. FIGS. 32A and 32B show a computer program running on the microprocessor. In the flowcharts shown in FIGS. 32A and 32B and the following description, a constant and a variable are expressed as "_X" and "_x", which are common for the three modulation discriminators 104, 103 and 107. When focusing the description and the flowcharts on the detector 111, "_X" and "_x" are to be read as "_Y" and "_y". Similarly, when focusing the description and the flowcharts on the P-modulation discriminator 103 or Q-modulation discriminator 107, "_X" and "_x" are to be read as "_P" and "_p" or "_Q" and "qp and qc". Variable cnt_qp is used in a job in an interruption at intervals equal to the edge-to-edge intervals of the sine wave in the head portion of the right-channel signal, and variable cnt_qc is used in a job in an interruption at intervals equal to the edge-to-edge intervals in the base-band signal of the right-channel signal R.

In the flowcharts, mes_x and cont_x are corresponding to the value stored in the first counter and the value stored in the second counter. The microprocessor periodically increments mes_x, and checks the first counter to see whether or not mes_x reaches 22.67 μs. When the answer is given affirmative, the interruption takes place. A flag "Status" is corresponding to the port Status.

First, an initialization is carried out as shown in FIG. 32A for the variables. The microprocessor prohibits itself from interruptions as by step S101, and the flag "Status" is reset as by step S102. Subsequently, the microprocessor makes the variable cnt_x equal to constant_X, i.e., zero as by step S103, and changes the variable mes_x to zero as by step S104. Finally, the microprocessor allows itself to accept a request for the interruption as by step S105.

After the interruption is allowed. The microprocessor repeats the program sequence shown in FIG. 32B at every interruption. The interruption takes place at intervals of 22.67 μs. When the interruption takes place, the microprocessor checks the interface to see whether or not the signal at the interface corresponding to the port Trigger is in logic "1" level as by step S201. If the signal still stays in logic "0" level, the microprocessor proceeds to step S206, and the variable mes_x is incremented by one. Thereafter, the microprocessor exits from the interruption sub-routine.

On the other hand, when the microprocessor finds the signal to be in logic "1" level, the microprocessor checks the variable mes_x to see whether or not the variable is equal to any one of the values unique to the given modulation technique, i.e., the Y-modulating technique, the P-modulating technique or the Q-modulating technique as by step S202. The values unique to the Y-modulating technique are equivalent to the remainder "13" in the division by 14 or remainders "0" and "1" in the case where the count value is equal to or greater than 14.

When the variable mes_x is equal to the value unique to the given modulation technique, the answer is given affirmative "YES", and the microprocessor adds 1 to cnt_x as by step S203. If, on the other hand, the variable mes_x is different from the values unique to the given modulation technique, the answer is given negative "NO", and the microprocessor subtracts 1 from con_x as bys step S204. The microprocessor resets mes_x to zero as by step S205, and adds 1 to mes_x as by step S206. Thereafter, the microprocessor exits from the interruption subroutine. Thus, the microprocessor achieves the functions of the first and second counters through the software.

A-Discriminator 108*b*

Figure 33A:
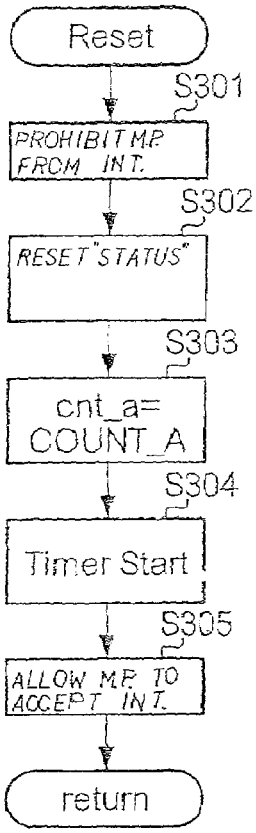
FIGS. 33A and 33B are flowcharts showing an A-discriminator implemented by software.
Figure 33B:
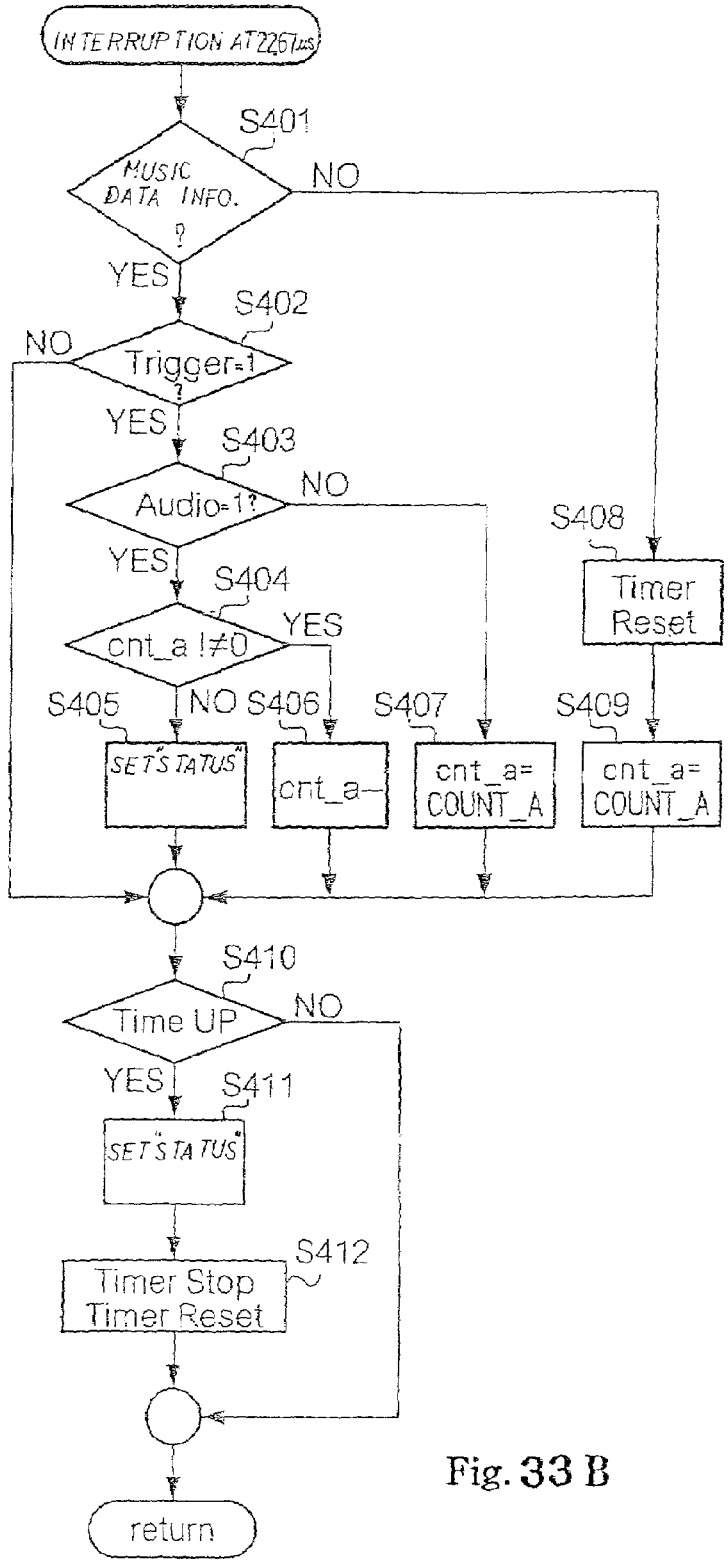

The A-discriminator 108*b* may be implemented by software. FIGS. 33A and 33B show a computer program realizing the function of the A-discriminator 108*b*. Variable cnt_is indicative of a lapse of time, and the unit time is 22.67 μs. The interruption takes place at intervals of 22.67 μs. A timer is implemented by a counter. The timer automatically increments the value stored therein.

First, the microprocessor carries out an initialization as shown in FIG. 33A. The microprocessor prohibits itself from the interruption as by step S301. Subsequently, the microprocessor resets the flag "Status" as by step S302, and makes the variable cnt_a equal to a constant COUNT_A, which is, by way of example, 32, as by step S303. The microprocessor starts the timer as by step S304, and the timer automatically increments the lapse of time. Finally, the microprocessor allows itself to accept a request for interruption as by step S305.

The interruption takes place at intervals of 22.67 μs. When the interruption takes place, the microprocessor checks the interface to see whether or not the audio-frequency signal carries pieces of music data information as by step S401. If the microprocessor finds the regenerative signal to be representative of silence, the answer at step S401 is given negative, and the microprocessor resets the timer as by step S408, and makes the variable cnt_a equal to the constant COUNT_A as by step S409. The microprocessor checks the timer to see whether or not the value has been incremented for a predetermined time period as by step S410. The timer may be expected to increment the value to 4000. Since the timer was reset at step S408, the answer at step S410 is given negative, and the microprocessor exits from the routine shown in FIG. 33B.

On the other hand, when the audio frequency signal is representative of sound, i.e., the pieces of music data information, the answer at step S401 is given affirmative, and the microprocessor checks the interface corresponding to the port "Trigger", i.e., the output signal of the OR gate 115 to see whether or not the signal is in logic "1" level as by step S402. If the answer at step S402 is given negative, the microprocessor proceeds to step S410, and checks the timer to see whether or not the value has been incremented for the predetermined time at step S410. If the answer at step S410 is given affirmative, the microprocessor sets the flag "Status" as by step S411. The microprocessor stops the timer and resets it as by step S412.

On the other hand, If the answer at step S402 is given affirmative, the microprocessor checks the interface corresponding to the port "Audio", i.e., the output signal of the NOR gate 116 to see whether or not the signal is in logic "1" level as by step S403. If the answer at step S403 is given negative, the microprocessor makes the variable cnt_a equal to constant COUNT_A as by step S407, and proceeds to step S410.

On the contrary, if the answer at step S402 is given affirmative, the microprocessor checks the variable cnt_a to see whether or not the variable does not reach zero as by step S404. If the variable cnt_a has not reached zero, yet, the answer at step S404 is given affirmative, and the microprocessor decrements the variable cnt_a by one. On the other hand, if the answer at step S404 is given negative, the microprocessor sets the flag "Status", and proceeds to step S410.

Data Table

The data table is created in the judging circuit 108 for discriminating the origin of the audio-frequency signal and the modulation technique employed in the modulator 12. The data processing unit 108*b* accesses the data table so as to determine the origin of the audio-frequency signal and the modulation technique. FIG. 34 shows the data table. The data table has two stages. The upper stage is assigned to the audio-frequency signal carrying MIDI messages, and the lower stage is assigned to the audio-frequency signal equivalent to the external audio signal. Ten columns are shared between the two stages. The leftmost column is indicative of the origin of the audio-frequency signal, i.e., the nibble stream containing MIDI music data codes and the external audio frequency signal. The other columns are assigned to the output signal of the Y-modulation discriminator 104, the output signal of the Q-modulation discriminator 107, the output signal of the P-modulation discriminator 103, the output signal of the level analyzer 106, the output signal of the right-channel signal 102, the output signal of the wave discriminator 105, the output signal of the wave discriminator 101, the output signal representative of "time-out" and the judge, respectively. In the fifth and sixth columns, "SL" stands for the output signal representative of the silence. In the ninth column, word "Yes" means that the time-out takes place, and word "No" is representative of the opposite meaning. In the second to fourth columns, "cnt_y" represents the signal level of the output signal from the Y-modulation discriminator 104, "cnt_qp" and "cnt_qc" represent the signal levels of the output signal from the Q-modulation discriminator 107, and "cnt_p" stands for the signal level of the output signal from the P-modulation discriminator 103. In the seventh and eighth columns, "wav_l" and "wav_r" are representative of the signal level of the output signal from the wave discriminator 105 and the output level of the output signal from the wave discriminator 101, respectively. In the second, third, fourth, seventh and eighth columns, "TH" stands for a value determined by the manufacturer. Thus, the data processing unit 108*a* discriminates the audio-frequency signal modulated from the nibble stream and the audio-frequency signal equivalent to the external audio signal from each other, and the Y-modulation technique, Q-modulation technique and P-modulation technique from one another on the basis of the output signals from the wave discriminators 101/105, the output signals from the level analyzers 102/106 and the output signals from the Y-modulation/Q-modulation/P-modulation discriminators 104/107/103. If the modulation discriminators 103/104/107, level analyzers 102/106 and wave discriminators 101/105 have kept the output signals in the meaningless level for a predetermined time period such as, for example, 4 seconds, the data processing unit 108*a* declares "time-out", and judges the audio-frequency signal to be equivalent to the external audio signal.

Circuit Configuration of Demodulating Unit 30A

As described hereinbefore, the demodulating unit 30A includes the demodulator 31 and the data converter 32. When the detector 100 judges that the audio-frequency signal was modulated from the nibble stream DS1, by way of example, through the Y-modulation technique employed in the A manufacturer, the hardware implementation of the demodulating unit 30A is shown in FIG. 1, and the nibble stream DS1 is reproduced from the audio-frequency signal through the demodulator 31 and the data converter 32.

The demodulator 31 selects the demodulation technique corresponding to the Y-modulation, by way of example. The demodulator 31 extracts a clock signal synchronous with the bit string representative of the MIDI music data codes or the character synchronizing signal, and reproduce the nibble stream DS1 containing the MIDI music data codes and the synchronous nibbles. The nibble stream is supplied from the demodulator 31 to the data converter 32. The data converter 32 eliminates the synchronous nibbles from the nibble stream, and reproduces the MIDI music data codes.

Figure 35:
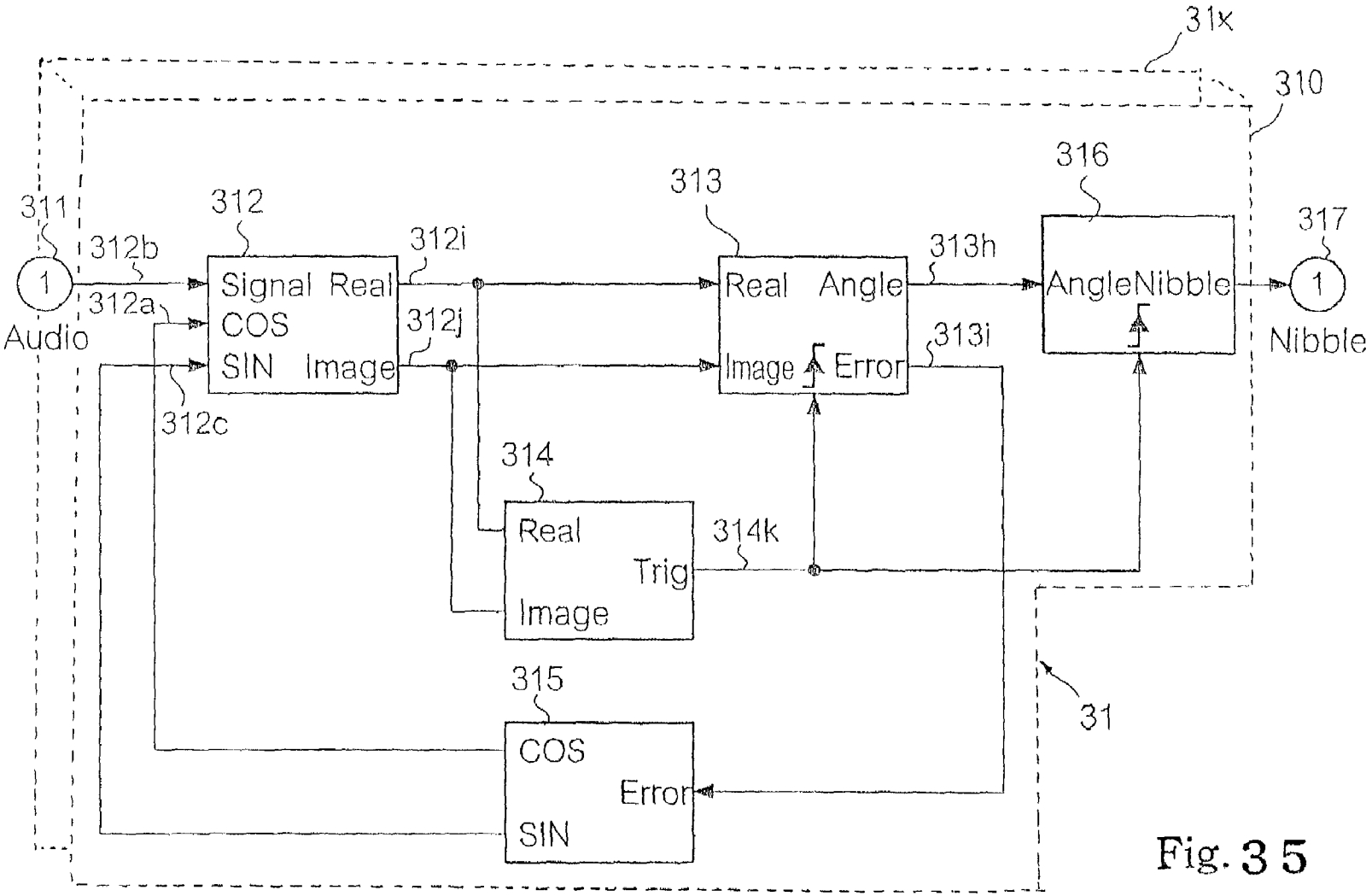
FIG. 35 is a block diagram showing the circuit configuration of a demodulator forming a part of the data reproducer.

Description is made on the demodulator 31 with reference to FIGS. 35 to 40. FIG. 35 shows the circuit configuration of the demodulator 31. The modulator 31 has plural function planes 310 to 31*x*. The plural functional planes 310 to 31*x* are assigned to demodulation techniques different from one another. In this instance, the functional plane 310 is assigned to the demodulation technique corresponding to the Y-modulation using the 16 DPSK. Another functional plane is assigned to a demodulation technique corresponding to the P-modulation, and yet another functional plane is assigned to a demodulation technique corresponding to the Q-modulation. The modulator 31 is responsive to the control data signal or the output signal of the detector 100 for selectively activating the plural function planes 310 to 31*x*. The control data signal is assumed to represent the 16 DPSK. With the control data signal the function plane 310 is activated. The function plane 310 is described hereinbelow in detail.

The function plane 310 includes a synchronous detector 312, a coordinate transformation circuit 313, a trigger signal generator 314, a phase-locked loop 315 and a reverse mapping circuit 316. The audio-frequency signal is supplied from an input port 311 to a signal input terminal 312*b* of the synchronous detector 312. The phase locked loop 315 supplies a cosine wave component signal representative of the cosine wave component of an oscillation signal and a sine wave component signal representative of the sine wave component of the oscillation signal to signal input terminals 312*a* and 312*c*, respectively. The cosine wave component and the sine wave component are representative of a waveform corresponding to the carrier signal, and the phase locked loop 315 controls the frequency of the oscillation signal so as to match the phase of the waveform with the phase of the carrier signal. The synchronous detector 312 extracts a series of momentary points from the audio-frequency signal, and determines a real part of each momentary point and an imaginary part of the momentary point. The synchronous detector 312 outputs an output signal representative of the real part and another output signal representative of the imaginary part from signal output terminals 312*i* and 312*j*, respectively. The real part and the imaginary part are indicative of the momentary point of the audio-frequency signal in the quadrature coordinate system, and, accordingly, are the coordinates in the quadrature coordinate system. The output signal representative of the real part and the output signal representative of the imaginary part are supplied from the signal output terminals 312*i* and 312*j* to both of the coordinate transformation circuit 313 and the trigger signal generator 314.

The trigger signal generator 314 is responsive to the output signals of the synchronous detector 312 for generating a trigger signal indicative of a synchronous timing. The trigger signal is supplied from the signal output terminal 314*k* to the coordinate transformation circuit 313. The coordinate transformation circuit 313 is responsive to the trigger signal for convert the coordinates in the quadrature coordinate system to corresponding coordinates in a polar coordinate system. One of the coordinates is indicative of the angle between zero to 2π in the polar coordinate system. The coordinate transformation circuit 313 produces an output signal representative of the angle, and supplies the output signal from the signal output terminal 313*h* to the reverse mapping circuit 316. The coordinate transformation circuit 313 further determines an error component introduced in the angle through a frequency multiplication technique, and produces another output signal representative of the error component. The coordinate transformation circuit 313 supplies the output signal representative of the error component from another signal output terminal 313*i* to a control terminal of the phase locked loop 315. The phase locked loop 315 is responsive to the output signal representative of the error component so as to correct the phase of the waveform.

The reverse mapping circuit 316 is responsive to the trigger signal so as to convert the approximate angle to a 4-bit data nibble corresponding to the 4-bit gray code at the approximate angle. Thus, the function plane 310 restores the carrier signal on the basis of the audio-frequency signal, and reproduces the series of data nibbles also from the audio-frequency signal through the coordinate transformation from the quadrature coordinate system to the polar coordinate system and through the data conversion from the approximate angle to the data nibble. In this instance, the demodulator 31 is broken down into a carrier restoring circuit 312/313/315, a data converter 312/313/314 for converting the quadrature data to the angular data and another data converter 316 for converting the angular data to the data nibble.

Figure 36:
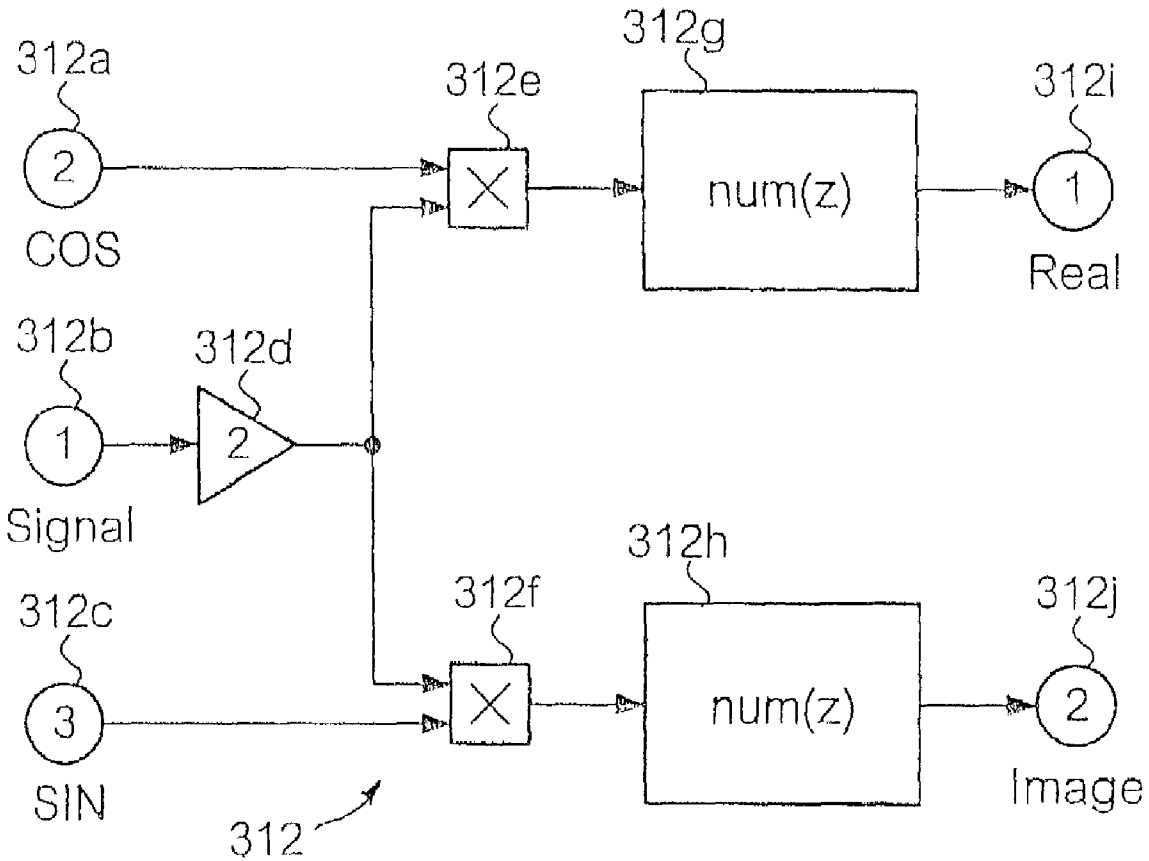
FIG. 36 is a block diagram showing the circuit configuration of a synchronous detector forming a part of the demodulator.

FIG. 36 shows the circuit configuration of the synchronous detector 312. The synchronous detector 312 has the three signal input terminals 312*a*/312*b*/312*c* and the two signal output terminals 312*i*/312*j*, and an amplifier 312*d*, multipliers 312*e*/312*f* and cosine roll-off filters 312*g*/312*h* are connected between the signal input terminals 312*a*/312*b*/312*c* and the signal output terminals 312*i*/312*j*. The cosine roll-off filter 312*g* is provided for the real part (R), and the other cosine roll-off filter 312*h* is provided for the imaginary part (I). The audio-frequency signal is supplied from the signal input terminal 312*b* through the amplifier 312*d* to both of the multipliers 312*e*/312*f*. The cosine wave component signal is supplied from the signal input terminal 312*a* to the multiplier 312*e*, and the multiplier 312*e* carries out the multiplication between the value of the audio-frequency signal and the value of the cosine wave component signal for producing an output signal representative of the product. On the other hand, the sine wave component signal is supplied form the signal input terminal 312*c* to the multiplier 12*f*, and the multiplier 312*f* carries out the multiplication between the value of the audio-frequency signal and the value of the sine wave component signal for producing an output signal representative of the product.

The output signal is supplied from the multiplier 312*e* to the cosine roll-off filter 312*g*, and the other output signal is supplied from the multiplier 312*f* to the other cosine roll-off filter 312*h*. The cosine roll-off filters 312*g*/312*h* have the roll-off ratio a of 1.0. The cosine roll-off filters 312*g*/12*h* restrict the frequency of the base band, and extracts the real part and the imaginary part. The cosine roll-off filters 312*g*/312*h* produces the output signal representative of the real part and the output signal representative of the imaginary part, and supplies the output signals to the signal output terminals 312*i*/312*j*, respectively.

Figure 37:
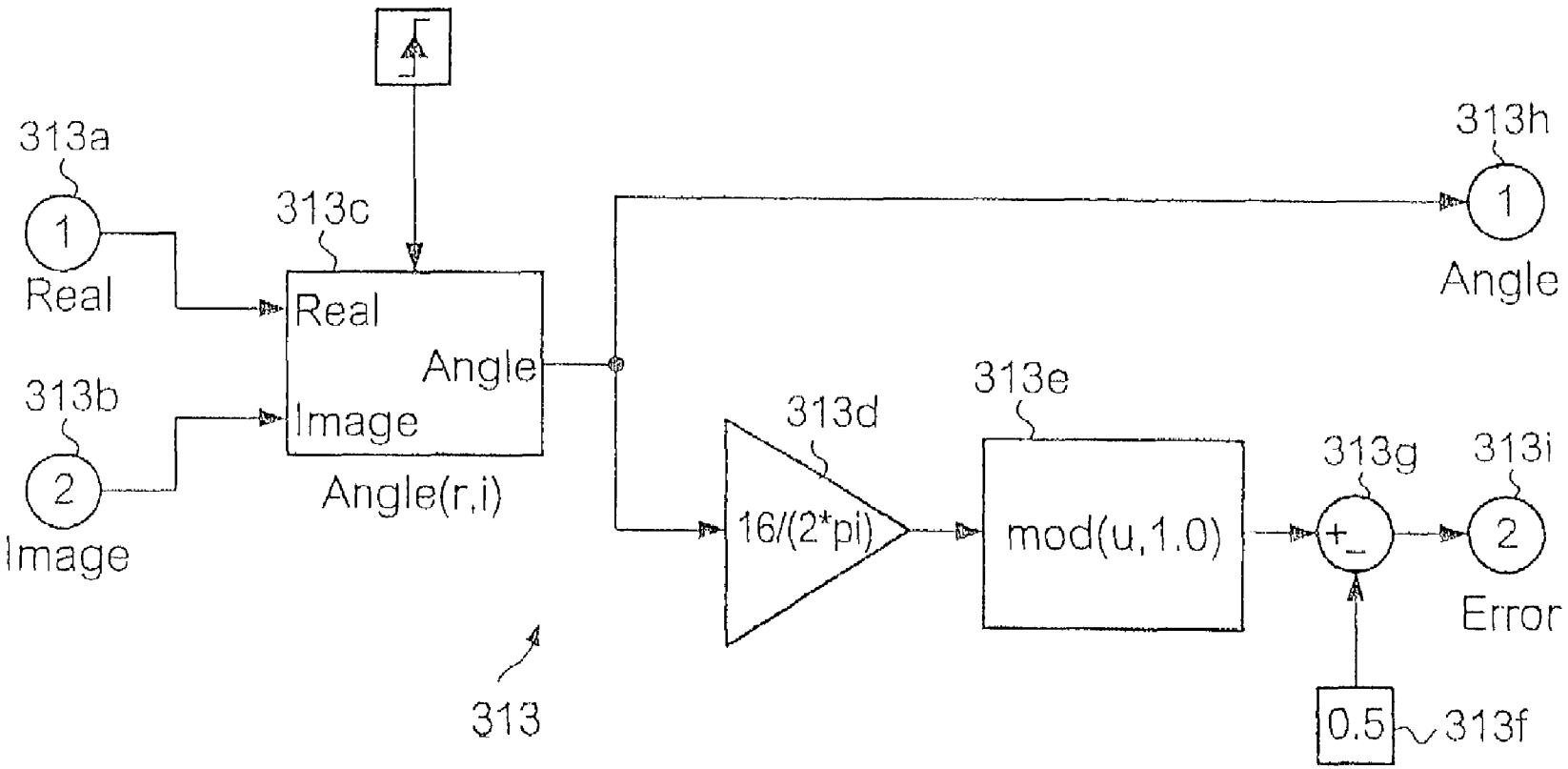
FIG. 37 is a block diagram showing the circuit configuration of a coordinate transformation circuit forming another part of the demodulator.

FIG. 37 shows the circuit configuration of the coordinate transformation circuit 313. The coordinate transformation circuit 313 has the signal input terminals 313*a*/313*b* respectively assigned to the output signals of the synchronous detector 312 and the signal output terminals 313*h*/313*i* assigned to the output signal representative of the angle and the output signal representative of the error component. A coordinate transformer 313*c*, a multiplication/division circuit 313*d*, a modulo function circuit 313*e*, a source 313*f* of constant and an addition/subtraction circuit 313*g* are connected between the signal input terminals 313*a*/313*b* and the signal output terminals 313*h*/313*i*.

The real part and the imaginary part are the coordinates assigned to a point in the quadrature coordinate system, and the coordinate transformer 313*c* is responsive to the trigger signal so as to convert the coordinates in the quadrature coordinate system to the corresponding coordinates in the polar coordinate system. One of the coordinates in the polar coordinate system is representative of the angle of the momentary point, and the coordinate transformer 313*c* supplies the output signal representative of the angle to the signal output terminal 313*h*.

The output signal representative of the angle is further supplied to the multiplication/division circuit 313*d*, and the angle is multiplied by 16/2π. The product ranges from zero to sixteen. The multiplication/division circuit 313*d* produces an output signal representative of the product, and supplies the output signal to the modulo function circuit 313*e*. The product usually consists of an integer and a decimal. The modulo function circuit 313*e* produces an output signal representative of the decimal, and supplies the output signal to the addition/subtraction circuit 313*g*. The source of constant 313*f* supplies an output signal representative of 0.5 to the addition/subtraction circuit 313*g*, and 0.5 is subtracted from the decimal. The addition/subtraction circuit 313*g* produces an output signal representative of the difference, and supplies the output signal to the signal output terminal 313*i*. Thus, the phase is multiplied by sixteen, and the piece of symbol information is degenerated through the modulo function unit 313*e* for extracting the error. This data processing is known as the frequency multiplication technique.

Figure 38:
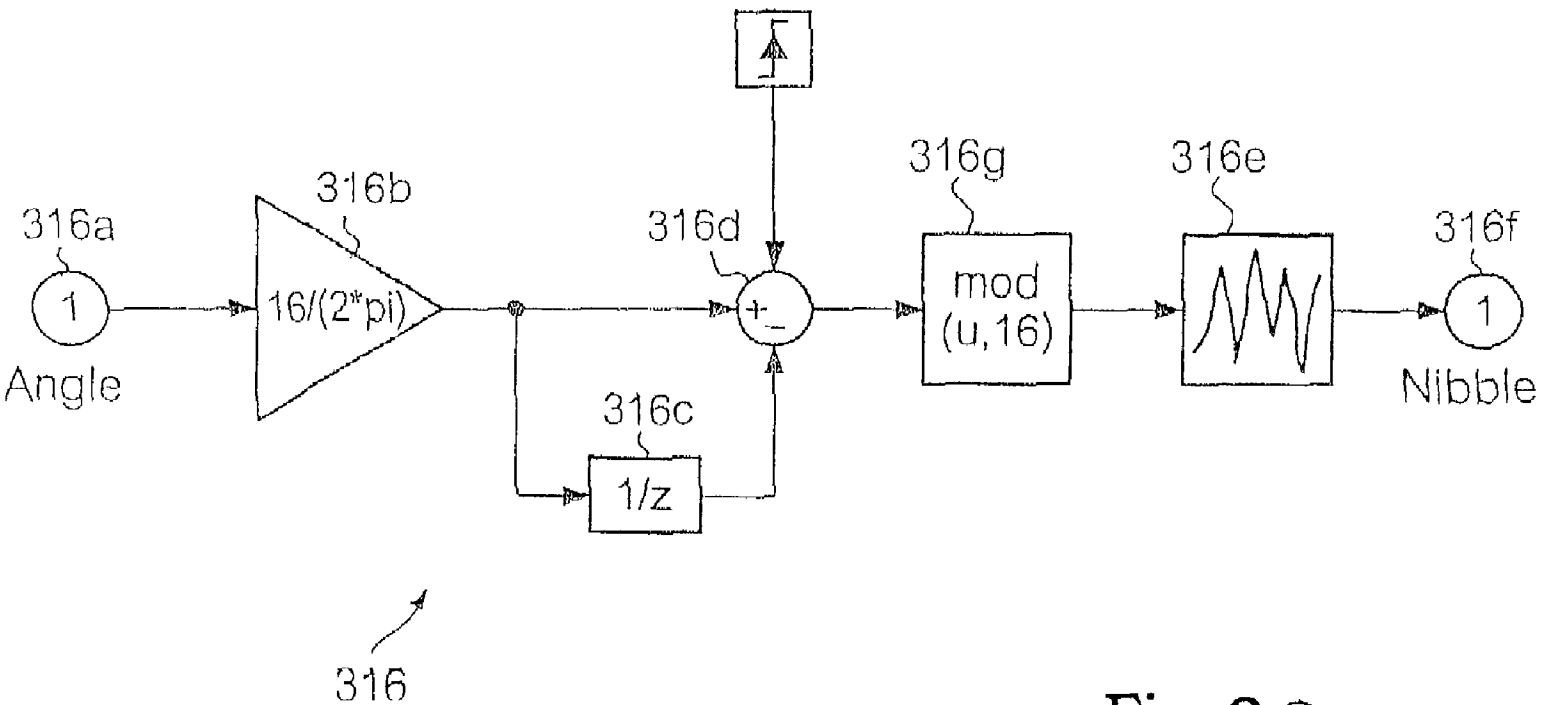
FIG. 38 is a block diagram showing the circuit configuration of a reverse mapping circuit forming yet another part of the demodulator.

FIG. 38 shows the circuit configuration of the reverse mapping circuit 316. The reverse mapping circuit 316 has the signal input terminal 316*a* and the signal output terminal 316*f*, and a multiplication/division circuit 316*b*, a delay circuit 316*c*, an addition/subtraction circuit 316*d*, a modulo function circuit 316*g* and a data converter 316*e* are connected between the signal input terminal 316*a* and the signal output terminal 316*f*. The output signal representative of the angle is supplied from the signal input terminal 316*a* to the multiplication/division circuit 316*b*, and the angle is multiplied by $16/2\pi$. The angle ranges from zero to $2\pi$, and the product ranges from zero to sixteen. The multiplication/division circuit 316*b* produces an output signal representative of the product, and supplies the output signal to the delay circuit 316 and the addition/subtraction circuit 316*d*. The delay circuit 316*c* introduces a time delay into the propagation of the output signal, and the product is subtracted from the next product. This means the data conversion from the absolute phase to the relative phase. The addition/subtraction circuit 316*d* produces an output signal representative of the difference between the product and the next product, i.e., the relative phase, and supplies the output signal to the modulo function circuit 316*g*. The difference is divided by sixteen, and the modulo function circuit 316*g* produces an output signal representative of the remainder obtained through the division. The output signal is supplied from the modulo function circuit 316*g* to the data conversion circuit 316*e*. The gate conversion circuit 316*e* carries out the reverse data conversion from the gray code to the corresponding data nibble, and supplies the data nibble to the signal output terminal 316*f*. Thus, the signal demodulation circuit 31 restores the nibble stream DS2 on the basis of the regenerative signal RG1.

Figure 39:
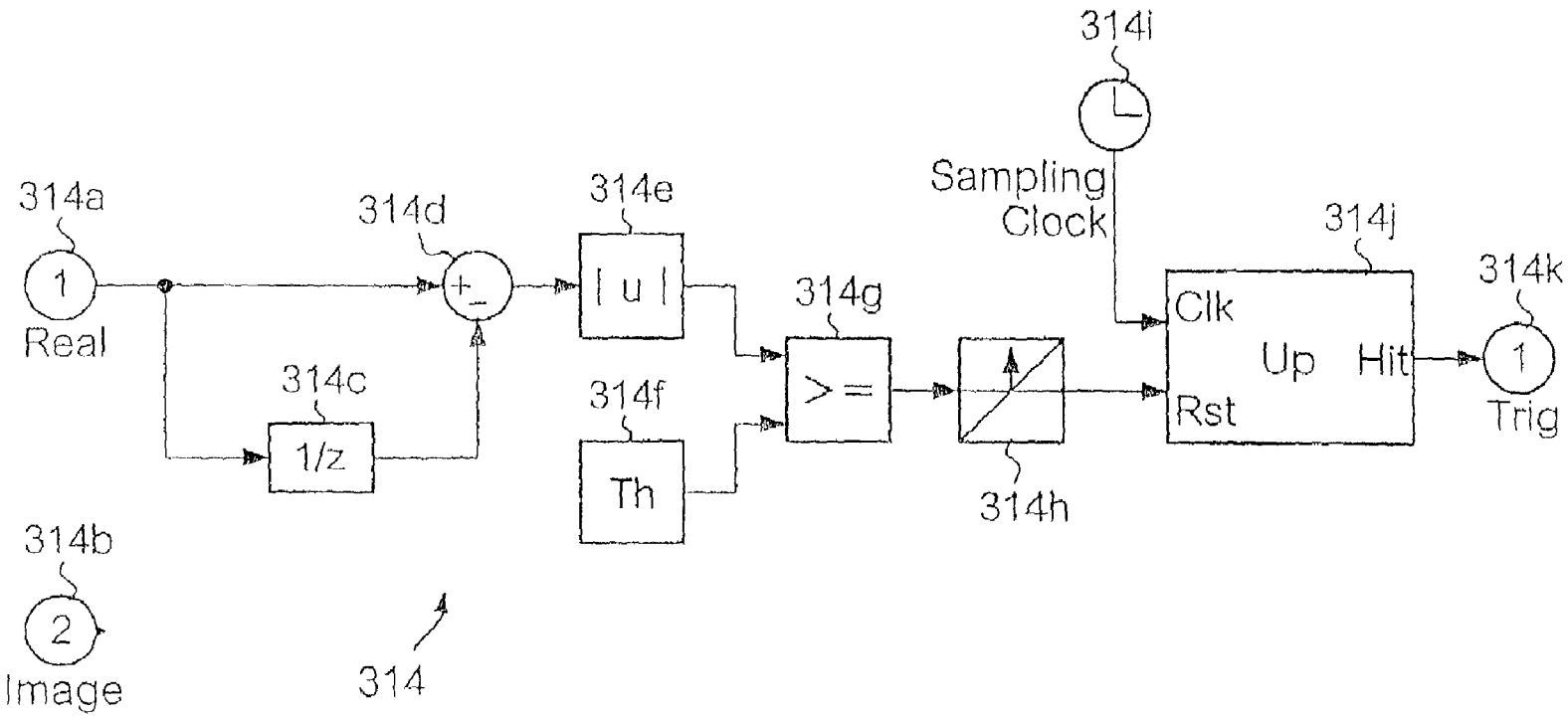
FIG. 39 is a block diagram showing the circuit configuration of a trigger circuit forming still another part of the demodulator.

FIG. 39 shows the circuit configuration of the trigger signal generator 314. The output signals representative of the real part and the imaginary part are supplied to the signal input terminals 314*a* and 314*b*, respectively. The trigger signal generator 314 further includes a delay circuit 314*c*, an addition/subtraction circuit 314*d*, an absolutizing circuit 314*e*, a threshold generator 314*f*, a comparator 314*g*, an edge detector 314*h*, a clock generator 314*i* and a counter 314*j*.

The output signal representative of the real part is supplied to the delay circuit 314*c* and the addition/subtraction circuit 314*d*. The delay circuit 314*c* introduces a time delay into the propagation of the real part, and supplies the real part to the addition/subtraction circuit 314*e*. The real part and the next real part reach the addition/subtraction circuit 314*d*, and the value of the real part is subtracted from the value of the next real part. The addition/subtraction circuit 314*d* produces an output signal representative of the difference, and supplies the output signal to the absolutizing circuit 314*e*. The absolutizing circuit 314*e* determines the absolute value of the difference, and produces an output signal representative of the absolute value. The output signal representative of the absolute value is supplied from the absolutizing circuit 314*e* to the comparator 314*g*. The threshold generator 314*f* supplies an output signal representative of a threshold to the comparator 314*g*, and the comparator 314*g* compares the absolute value with the threshold to see whether the absolute value exceeds the threshold. When the absolute value exceeds the threshold, the comparator 314*g* raises an output signal at the output node thereof. The output signal is supplied form the comparator 314*g* to the edge detector 314*h*. The edge detector 314*h* monitors the output signal of the comparator 314*g* to see whether or not the comparator 314*g* raises the output signal. When the edge detector 314*h* detects the leading edge of the output signal, the edge detector 314*h* changes a reset signal to active level, and supplies the reset signal to the reset node of the counter 314*j*. The clock generator 314*i* generates a clock signal equal in frequency to the sampling clock signal, and supplies the clock signal to the clock node of the counter 314*j*. In this instance, the sampling clock signal is 44100 kHz, and, accordingly, the clock signal is 44100 kHz. The carrier frequency is 6300 Hz. The sampling clock frequency is seven times larger than the carrier frequency. The up-counter 314*i* increments the count from zero to six, and returns to zero. Thus, the counter 314*i* reiterates the loop between zero to six. After the counter 314*j* is reset with the reset signal, the counter 314*j* increments the count stored therein. When the count reaches a predetermined value at the intermediate point in the loop, the counter 314*j* changes the trigger signal to the active level, and the trigger signal is supplied to the coordinate transforming circuit 313 and the reverse mapping circuit 316.

Figure 40:
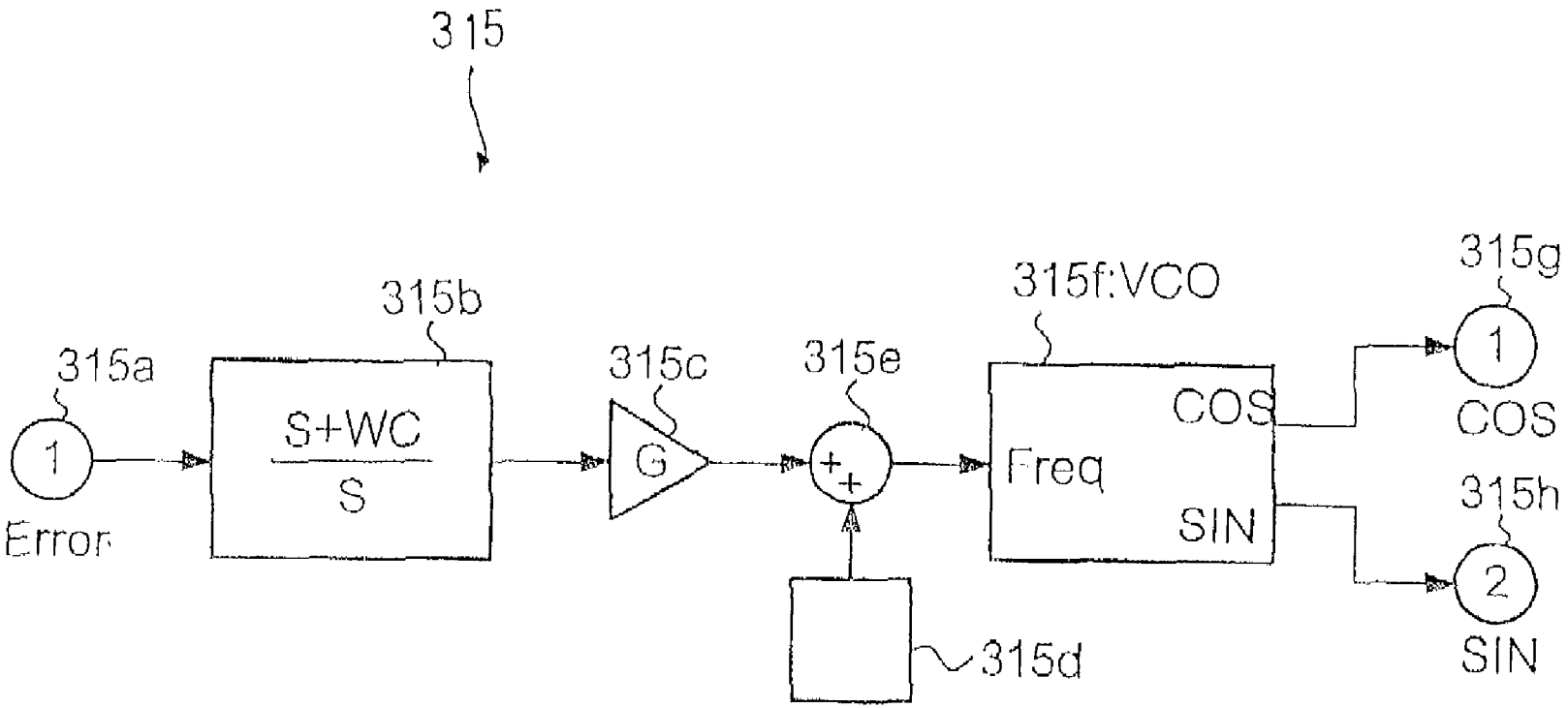
FIG. 40 is a block diagram showing the circuit configuration of a phase-locked loop forming yet another part of the demodulator.

FIG. 40 shows the circuit configuration of the phase-locked loop 315. The phase locked loop 315 includes a loop filter 315*b*, a loop gain amplifier 315*c*, a source of constant 315*d*, an adder 315*e* and a voltage-controlled oscillator 315*f*. The source of constant 315*d* produces an output signal representative of a value corresponding to the carrier frequency of 6300 Hz. The output pulse signal representative of the error component is supplied from the signal input terminal 315*a* to the loop filter 315*b*. The loop filter 315*b* is implemented by a low boost filter, which has a predetermined cut-off angular frequency $\omega c$. The output pulse signal is filtered by the loop filter 315*b*. The frequency components equal to or greater than the cut-off angular frequency $\omega c$ are output at gain equal to 1, and the frequency components less than the cut-off angular frequency $\omega c$ are output at gain greater than 1. The output signal of the loop filter 315*b* is amplified by the loop gain amplifier 315*c*, and the value of the output signal is added to the contact value corresponding to the carrier frequency of 6300 Hz by the adder 315*e*. The adder 315*e* produces an output signal representative of the sum, and supplies the output signal to the control node of the voltage-controlled oscillator 315*f*. The voltage-controlled oscillator 315*f* is responsive to the potential level at the control node Freq, and produces the oscillation signal at a frequency corresponding to the potential at the control node. The cosine wave component and the sine wave component are extracted from the oscillation signal, and produce the output signal representative of the cosine wave component and the output signal representative of the sine wave component. The voltage-controlled oscillator 315*f* supplies the output signals to the synchronous detector 312.

Data Converting 32

Figure 41:
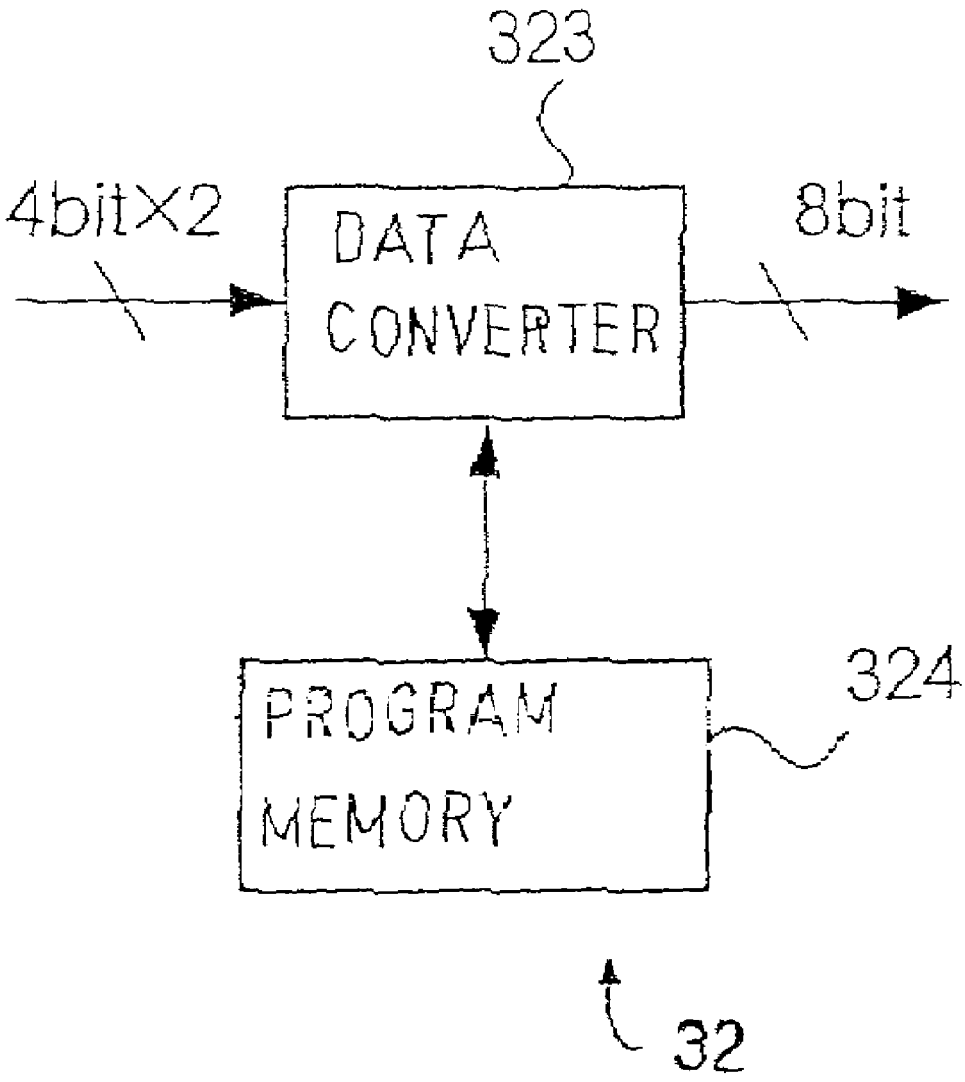
FIG. 41 is a block diagram showing the circuit configuration of a data converter incorporated in the data reproducer.

The data converting module 32 is equivalent to a data converter 323 accompanied with a program memory 324 as shown in FIG. 41. The data converter 323 is implemented by a data processor, and the data processor runs on a computer program stored in the program memory 324 for restoring the MIDI data words. The data converter 323 checks a nibble stream DS2 to see whether or not any one of the nibbles is identical in bit string with the synchronous nibble. If the nibble is identical in bit string with the synchronous data nibble, the data converter 323 ignores the nibble, and, accordingly, the synchronous data nibble or nibbles are eliminated from the nibble stream DS2. The data converter 323 further checks the nibble stream DS2 to see whether or not any one of the nibbles is identical in bit string with the nibble forming a part of the quasi MIDI status code. If the answer is given negative, the data converter 323 determines the number of the MIDI data bytes, and integrates the MIDI status byte with the MIDI data bytes for reproducing the MIDI music data word. On the other hand, if the answer is given affirmative, the data converter 323 replaces the nibble with an appropriate nibble so as to restore the MIDI status byte. The data converter 323 determines the number of MIDI data bytes, and integrates the MIDI status byte with the MIDI data bytes for reproducing the MIDI music data word.

Figure 42:
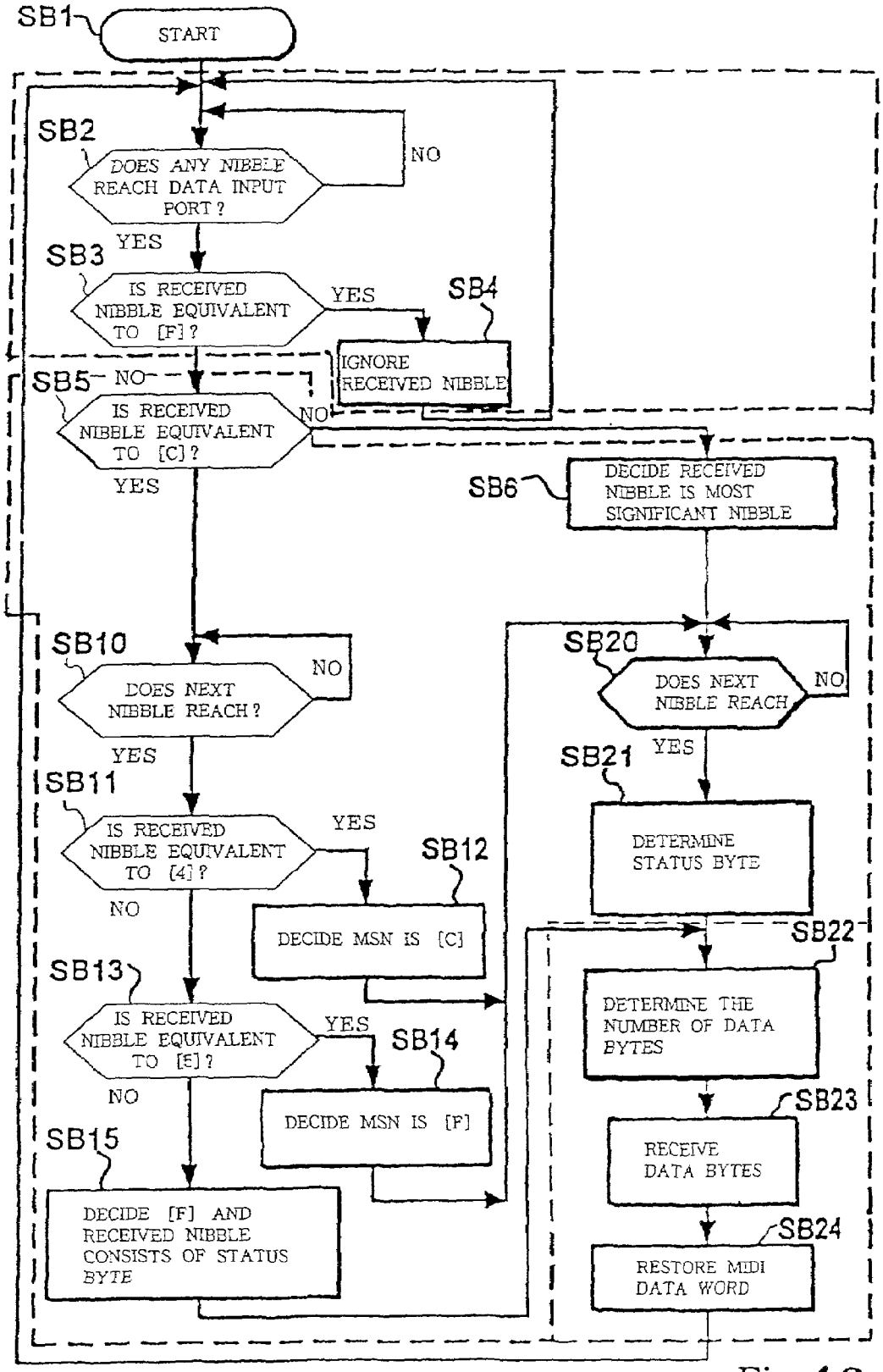
FIG. 42 is a flowchart showing a computer program for the data converter.

The jobs are detailed with reference to FIG. 42. FIG. 42 shows the computer program. The data converter 323 sequentially fetches the programmed instructions from the program memory 324. The data processor 323 extracts the quasi MIDI music data words from the nibble stream DS2 through execution of the computer program, and reproduces the MIDI music data words from the quasi MIDI music data words as described hereinbelow in detail.

Figure 43:
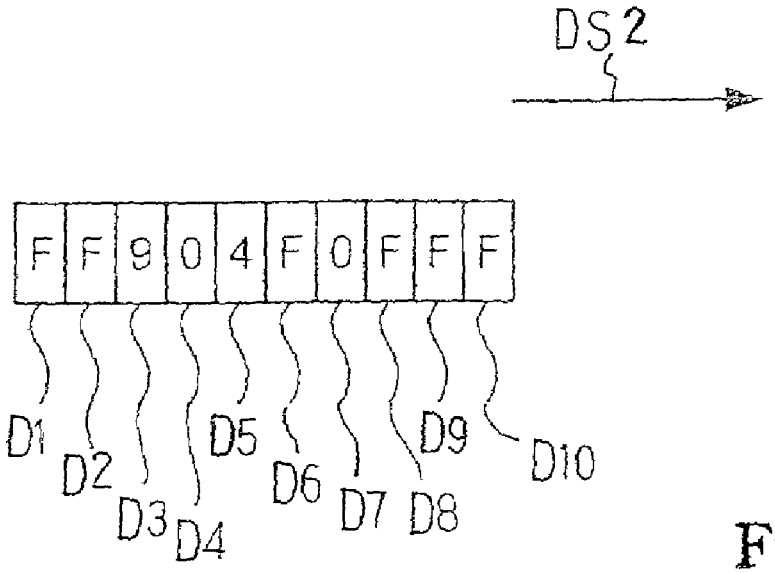
FIG. 43 is a view showing a nibble stream reproduced from an audio-frequency signal.

The nibble stream DS2 is assumed to contain a nibble string D1 to D10 shown in FIG. 43. The data converter 323 starts the execution at step SB1. The nibble string D1 to D10 contains a quasi MIDI data word QM10 equivalent to hexadecimal number [904F0F], and the other data nibbles D1, D2, D9 and D10 are the synchronous data nibbles [F].

The data converter 323 checks the data input port thereof to see whether or not any data nibble reaches as by step SB2. Before the demodulator 31 restores the nibble stream DS2, the nibble stream DS2 does not reach the data input port of the data converter 323, and the answer at step SB2 is given negative. The data converter 323 checks the data input port for the nibble stream DS2, again. Thus, the data converter 323 repeatedly executes the step SB2 until reception of the nibble stream DS2.

When the first data nibble D1 reaches the data input port, the answer at step SB2 is changed to the positive answer, and the data converter 323 proceeds to step SB3. The data converter 323 checks the received data nibble to see whether or not the received data nibble is the synchronous nibble [F] at step SB3. The first data nibble D1 is equivalent to hexadecimal number [F], and serves as the synchronous data nibble. Then, the data converter 323 makes a decision that the received nibble D1 is to be ignored as by step SB4, and returns to the step SB2. Thus, the data converter 323 eliminates the synchronous nibble [F] from the nibble stream DS2 through the loop consisting of steps SB2, SB3 and SB4, and, accordingly, a data processing for eliminating the synchronous nibble [F] is achieved through the loop consisting of steps SB2 to SB4.

Subsequently, the second data nibble D2 reaches the data converter 323, and the data converter 323 also decides to ignore the second data nibble D2 through the loop consisting of steps SB2, SB3 and SB4.

When the third data nibble D3 reaches the data converter 323, the answers at steps SB2 is given affirmative, but the answer at step SB3 is given negative. Then, the data converter 323 checks the received data nibble to see whether or not the received data nibble is equivalent to hexadecimal number [C] as by step SB5. The third data nibble is equivalent to hexadecimal number [9], and the answer at step SB5 is given negative. The data converter 323 decides that the third data nibble D3 is the most significant nibble of the received quasi MIDI data word QM10.

With the positive decision at step SB6, the data converter 323 proceeds to step SB20, and checks the data input port to see whether or not the next data nibble reaches there. While the next data nibble does not appear, the data converter 323 repeatedly checks the data input port for the next data nibble, and waits for it. When the next data nibble reaches the data input port, the answer at step SB20 is given affirmative, and the data converter 323 determines that the received data nibble and the previous data nibble form the MIDI status byte as by step SB21. In this instance, the fourth data nibble D4 is equivalent to hexadecimal number [0], and the data converter 323 determines the MIDI status byte is equivalent to hexadecimal number [90]. The data converter 323 determines that the first data nibble except [C] immediately after the synchronous data nibble [F] is the first data nibble of the MIDI status byte in the data stream DS2 through the data processing at steps SB5, SB6, SB20 and SB21.

Figure 44:
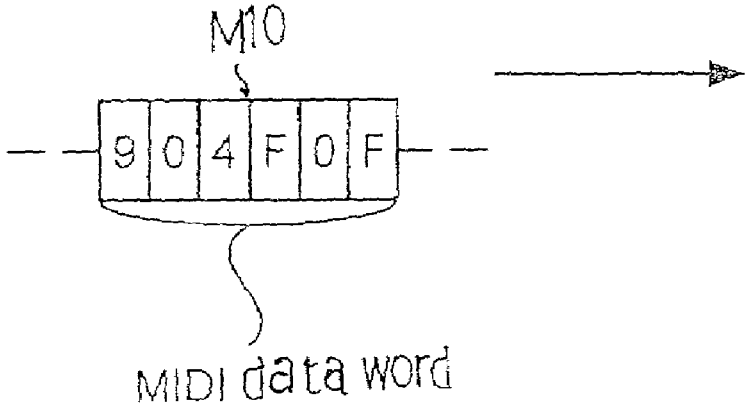
FIG. 44 is a view showing a MIDI data code restored through the sequence shown in FIG. 42.
Figure 45:
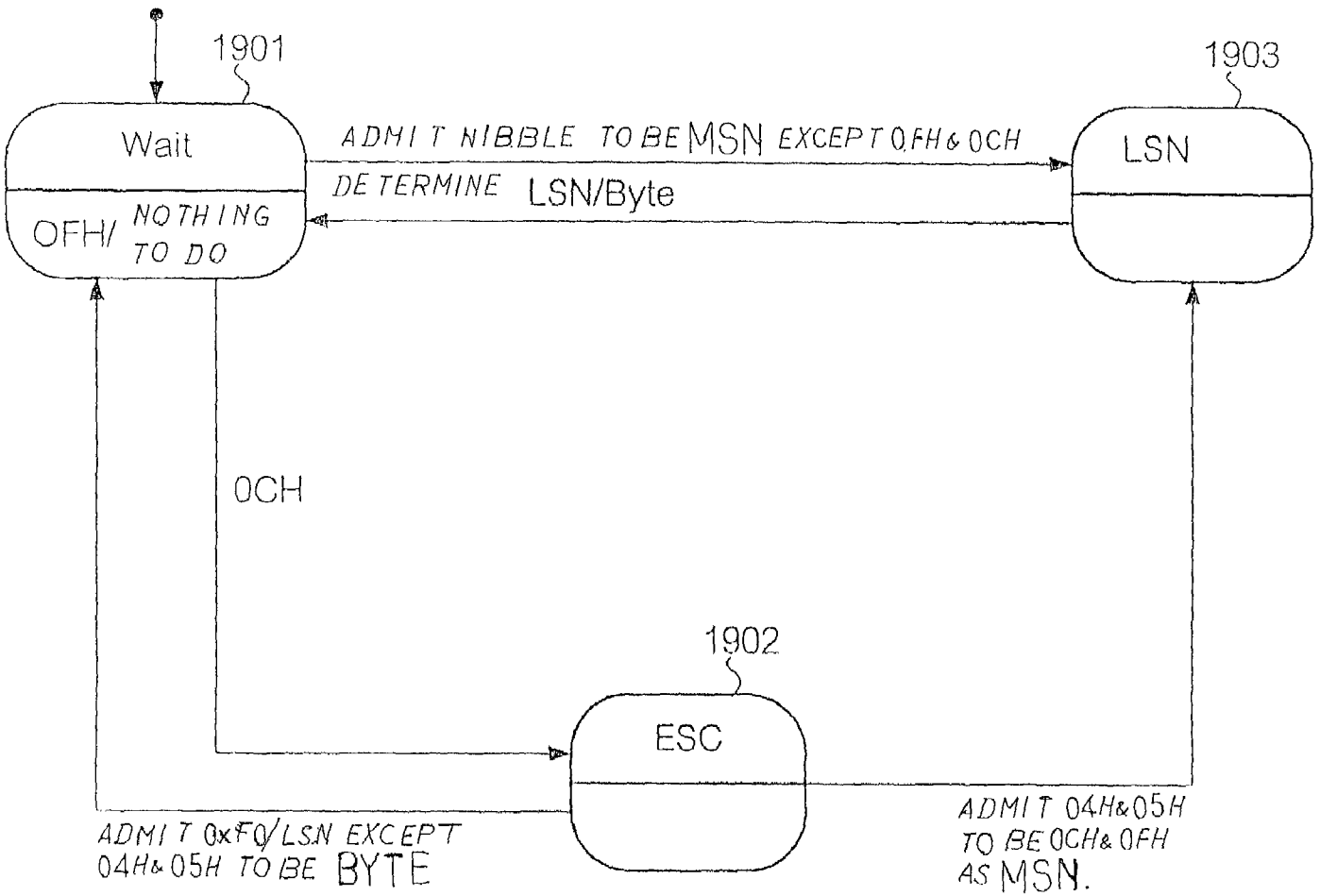
FIG. 45 is a block diagram showing jobs achieved through the execution of the computer program.

The MIDI standards define the number of the MIDI data bytes to follow the MIDI status byte, and the data converter 323 has a list defining the relation between the MIDI status bytes and the associated MIDI data bytes. The data converter 323 checks the list for the MIDI data bytes to decide how many MIDI data bytes follow the MIDI status byte [90], and finds that two MIDI data bytes are to follow as by step SB22. The data converter 323 receives the data nibbles D5, D6, D7 and D8 as by step SB23. The quasi MIDI data word QM10 has not been subjected to the data conversion, and the data converter 323 decides that the nibble string D3 to D8 [904F0F] represents the MIDI data word M10 (see FIG. 44) as by step SB24. Thus, the data converter 323 selects the MIDI data bytes from the data stream DS2 through the data processing at steps SB22, SB23 and SB24.

Upon completion of restoration of the MIDI data word [904F0F], the data converter 323 returns to step SB2, and eliminates the synchronous data nibbles [F] from the data stream DS2 through the loop consisting of steps SB2 to SB4.

When the received nibble is equivalent to hexadecimal number [C], the answers at steps SB2, SB3 and SB5 are given positive. Then, the data converter 323 checks the data input port to see whether or not the next data nibble is received as by step SB10, and waits for it. When the next data nibble reaches the data converter 323, the answer at step SB10 is given affirmative, and the data converter 323 checks the received data nibble to see whether or not it is equivalent to hexadecimal number [4] as by step SB1. If the data nibble is equivalent to hexadecimal number [4], the answer at step SB1 is given affirmative. Then, the data converter 323 decides that the previous received data nibble [C] is the most significant nibble of the next MIDI status byte as by step SB12, and proceeds to step SB20. The data processor restores a MIDI music data word through the loop consisting of steps SB20 to SB24.

If, on the other hand, the received data nibble is different from the hexadecimal number [4], the answer at step SB11 is given negative, and the data processor checks the received data nibble to see whether or not it is equivalent to the hexadecimal number [5] as by step SB 13. When the received data nibble is equivalent to the hexadecimal number [5], the answer at step SB13 is given affirmative, the data processor decides that the received data nibble equivalent to hexadecimal number [F] is the most significant nibble as by step SB14, and proceeds to step SB20. A MIDI music data word is restored through the loop consisting of steps SB20 to SB24.

When the answer at step SB13 is given negative, the data processor decides that the data nibble equivalent to the hexadecimal number [F] and the next data nibble consist of the status byte, and proceeds to step SB20. A MIDI data word is restored through the loop consisting of steps SB20 to SB24.

The computer program shown in FIG. 42 is broken down into three jobs, i.e., SB2 to SB4, SB5 to SB21 and SB22 to SB24. The synchronous nibbles [F] are eliminated from the nibble stream in the job at steps SB2 to SB4, the MIDI status byte is restored in the job at steps SB5 to SB21, and the MIDI music data word is determined in the job at steps SB22 to SB24. However, the computer program may be broken down into jobs 1901, 1902 and 1903 from another point of view (see FIG. 43). The jobs consist of steps SB2 to SB6, SB10 to SB15 and SB20 to SB24, respectively. The data processor waits for pieces of music data information through the job 1901 consisting of steps SB2 to SB6. The data processor waits for the dummy nibble with which the most significant nibble of the MIDI status byte is replaced through the job 1902 consisting of steps SB10 to SB15. The data processor waits for the next nibble through the job 1903 consisting of steps SB20 to SB24.

As will be understood from the foregoing description, although the various kinds of modulation techniques are employed in the data recorder to produce the audio-frequency signal from the nibble stream containing music data codes asynchronously generated, the detector discriminates the modulation technique employed in the data recorder from other modulation techniques, and the audio-frequency signal is demodulated through the corresponding demodulating technique. Thus, the data reproducer reproduces the music data codes regardless of the modulation technique employed in the data recorder.

Although the nibble stream and the external audio signal are selectively modulated to the audio-frequency signal, the detector 100 exactly decides the modulating technique used in the data recorder 10 or the external audio signal on the basis of more than one feature of the audio-frequency signal such as the edge-to-edge intervals, waveform and signal level. The detector 100 notifies the judge to the demodulating circuit 30A, and the demodulating circuit 30A restores the MIDI data words through the appropriate demodulating technique. Thus, even if the different modulating techniques are employed in the sound recorders, they are available for the information transmission system according to the present invention.

In the above-described embodiment, the wave discriminators 101/105, level analyzers 102/106, p-modulation discriminator 103, Y-modulation discriminator 104, Q-modulation discriminator 107 and A-discriminator 108*b* as a whole constitute an analyzer defined in independent claim focused on "discriminator", and the data processing unit 108*a* serves as a judging unit in the independent claim.

Although a particular embodiment of the present invention has been shown and described, it will be apparent to those skilled in the art that various changes and modifications may be made without departing from the spirit and scope of the present invention.

For example, the 16 DPSK does not set any limit on the Y-modulation. Any multi-value, i.e., more than 1 DPSK may be employed in the Y-modulation. When 8 (=23) DPSK is employed, the data codes are to be 3 bits long. 2-bit data codes are required for 4 (=22) DPSK. The carrier frequency, the transition technique and the spacious phase arrangement may be different from those employed in the above-described embodiment.

In the above-described embodiment, the judging circuit 108 judges the modulation technique on the basis of the waveform, signal level and edge-to-edge intervals. However, the three features may make the judging circuit too complicate. On the other hand, if the judging circuit judges the modulation technique on the basis of the edge-to-edge intervals, the judge may be less reliable. For this reason, the present invention proposes to judge the modulation technique on the basis of at least two features of the audio-frequency signal.

The detector 108 determines the modulation technique on the basis of the peak-to-peak intervals and the analogy to reference waveform. Another feature of the waveform may be used in the judge. One of the features available for the judge is the difference in signal level between the demodulated signal and a reference signal such as, for example, a sine wave.

The present invention may be applied to an image-carrying signal. Even though the modulation technique is unknown, the data reproducer judges the modulation technique from the reproduced signal on the basis of a feature of the waveform, and demodulates the image-carrying signal through the corresponding demodulation technique.

The computer programs may be sold in the form of a set of instruction codes stored in an information storage medium. Otherwise, the set of instruction codes may be down loaded from a program source to users through a communication network.

In the above-described embodiment, the PCM codes are stored in a compact disc, and the audio-frequency signal is demodulated from the PCM codes read out from the compact disc. The compact disc serves as an information transmission means. However, the compact disc does not set any limit on the information transmission means. The PCM codes may be transferred to the data reproducer 30 through a communication line or the free space. In order to propagate the PCM codes through the communication line, a suitable private/pubic communication network is required. On the other hand, when a provider distributes the PCM codes to users through the free space, the PCM codes may ride on the electromagnetic wave through a secondary modulator, and the users need corresponding demodulators.

What is claimed is:

1. A discriminator for discriminating a sort of modulation technique to produce an information carrying signal, comprising an analyzer supplied with said information carrying signal, and evaluating at least one feature of said information carrying signal found in a waveform of said information carrying signal; and a judging unit connected to said analyzer, and investigating the evaluation supplied from said analyzer to see what sort of modulation technique exhibits said at least one feature so as to determine the sort of modulation technique employed in said information carrying signal, wherein said at least one feature is a similarity of said waveform to plural reference waveforms.

2. The discriminator as set forth in claim 1, in which said analyzer further evaluates another feature of said information carrying signal found in said waveform of said information carrying signal, and said judging unit determines said sort of modulation technique on the basis of the evaluation of said at least one feature and another feature.

3. The discriminator as set forth in claim 2, in which said at least one feature and said another feature are said similarity of said waveform to said plural reference waveforms and peak-to-peak intervals found in said waveform.

4. The discriminator as set forth in claim 1, in which said analyzer includes a wave discriminator comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ratio between said first time period and said second time period.

5. The discriminator as set forth in claim 4, in which said wave discriminator includes a rectifier supplied with said information carrying signal and making said information carrying signal vary the amplitude in one of the positive and negative ranges, an averaging circuit connected to said rectifier for determining an average value of said amplitude, a comparator having two thresholds defining said predetermined amplitude range and comparing said information carrying signal with said two thresholds to produce an output signal representative of said first time period and said second time period, and a signal generator connected to said comparator and producing an output signal representative of said similarity.

6. The discriminator as set forth in claim 1, in which said information carrying signal is produced from an analog signal representative of sound or a data stream containing music data codes and meaningless codes, and said judging unit further determines that said information carrying signal was produced from said analog signal in the absence of the features unique to plural sorts of modulation techniques.

7. A discriminator for discriminating a sort of modulation technique to produce an information carrying signal, comprising:

an analyzer supplied with said information carrying signal, and evaluating at least one feature of said information carrying signal found in a waveform of said information carrying signal; and a judging unit connected to said analyzer, and investigating the evaluation supplied from said analyzer to see what sort of modulation technique exhibits said at least one feature so as to determine the sort of modulation technique employed in said information carrying signal, wherein said at least one feature is a similarity of said waveform to plural reference waveforms, and wherein said analyzer includes a wave discriminator comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ratio between said first time period and said second time period, said wave discriminator including a rectifier supplied with said information carrying signal and making said information carrying signal vary the amplitude in one of the positive and negative ranges, an averaging circuit connected to said rectifier for determining an average value of said amplitude, a comparator having two thresholds defining said predetermined amplitude range and comparing said information carrying signal with said two thresholds to produce an output signal representative of said first time period and said second time period, one of said two thresholds being 80 percent of said average value, the other of said two thresholds being 120 percent of said average value, and a signal generator connected to said comparator and producing an output signal representative of said similarity.

8. A discriminator for discriminating a sort of modulation technique to produce an information carrying signal, comprising:

an analyzer supplied with said information carrying signal, and evaluating at least one feature and another feature of said information carrying signal found in a waveform of said information carrying signal, and a judging unit connected to said analyzer, and investigating the evaluation supplied from said analyzer to see what sort of modulation technique exhibits said at least one feature and said another feature so as to determine the sort of modulation technique employed in said information carrying signal, wherein said at least one feature and said another feature are a similarity of said waveform to plural reference waveforms and peak-to-peak intervals found in said waveform, wherein said analyzer includes a wave discriminator supplied with said information carrying signal, comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ratio between said first time period and said second time period; and plural modulation discriminators supplied with said information carrying signal, determining said peak-to-peak intervals of said information carrying signal, and producing output signals each representative of either consistency or inconsistency with one of plural sorts of modulation techniques, said output signal of said wave discriminator and said output signals of said plural modulation discriminators being supplied to said judging unit.

9. A discriminator for discriminating a sort of modulation technique to produce an information carrying signal produced from an analog signal representative of sound or a data stream containing music data codes and meaningless codes, comprising;

an analyzer supplied with said information carrying signal, and evaluating at least one feature of said information carrying signal found in a waveform of said information carrying signal, and a judging unit connected to said analyzer, investigating the evaluation supplied from said analyzer to see what sort of modulation technique exhibits said at least one feature so as to determine the sort of modulation technique employed in said information carrying signal, and further determining that said information carrying signal was produced from said analog signal in the absence of the features unique to plural sorts of modulation techniques, wherein said at least one feature is a similarity of said waveform to plural reference waveforms, and wherein said analyzer includes a wave discriminator supplied with said information carrying signal, comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ratio between said first time period and said second time period;

plural modulation discriminators supplied with said information carrying signal, determining said peak-to-peak intervals of said information carrying signal, and producing output signals each representative of either consistency or inconsistency with one of plural sorts of modulation techniques;

an analog signal discriminator supplied with said output signals of said plural modulation discriminators, and producing an output signal representative of said analog signal when said plural modulation discriminators determines that said plural sorts of modulation techniques are not found in said information carrying signal; and a level analyzer supplied with said information carrying signal, and checking said information carrying signal to see whether or not the amplitude is wider than a predetermined range so as to produce an output signal representative of silence or sound, said output signal of said wave discriminator, said output signals of said plural modulation discriminators, said output signal of said analog signal discriminator and said output signal of said level analyzer being supplied to said judging unit.

10. The discriminator as set forth in claim 9, further comprising a signal separator for separating said information carrying signal into a first-channel signal and a second-channel signal, and said level analyzer and said wave discriminator are duplicated so that said first-channel signal and said second channel signal are supplied separately to said level analyzers and said wave discriminators and selectively to said plural modulation discriminators.

11. A method for discriminating a sort of modulation technique employed in an information carrying signal from other sorts of modulation techniques, comprising the steps of:

a) receiving said information carrying signal;

b) analyzing said information carrying signal so as to evaluate at least one feature of a waveform of said information carrying signal; and c) investigating the evaluation to see what sort of modulation technique exhibits said at least one feature so as to determine the sort of modulation technique employed in said information carrying signal, wherein said at least one feature is a similarity of said waveform to plural reference waveforms.

12. The method as set forth in claim 11, in which another feature of said waveform is further evaluated in said step b), and said sort of modulation technique is determined on the basis of both of said at least one feature and another feature.

13. The method as set forth in claim 12, in which said at least one feature and said another feature are said similarity of said waveform to said reference waveforms and peak-to-peak intervals found in said waveform.

14. The method as set forth in claim 13, in which said information carrying signal is decided to be directly produced from an analog signal when said peak-to-peak intervals are not unique to plural sorts of modulation techniques.

15. A signal demodulator for reproducing an original signal from an information carrying signal, comprising:

a detector supplied with said information carrying signal, and including an analyzer supplied with said information carrying signal and evaluating at least one feature of said information carrying signal found in a waveform of said information carrying signal and a judging unit connected to said analyzer and investigating the evaluation supplied from said analyzer to see what sort of modulation technique exhibits said at least one feature so as to produce a control data signal representative of the sort of modulation technique employed in said information carrying signal, wherein said at least one feature is a similarity of said waveform to plural reference waveforms; and a demodulator responsive to said control data signal so as to select one of plural function planes respectively assigned to plural sorts of demodulation techniques, and reproducing said original signal from said information carrying signal through the demodulation technique on said one of said plural function planes.

16. The signal demodulator as set forth in claim 15, in which said analyzer further evaluates another feature of said information carrying signal found in said waveform of said information carrying signal, and said judging unit determines said sort of modulation technique on the basis of the evaluation of said at least one feature and another feature.

17. The signal demodulator as set forth in claim 16, in which said at least one feature and said another feature are said similarity of said waveform to said plural reference waveforms and peak-to-peak intervals found in said waveform.

18. The signal demodulator as set forth in claim 15, in which said analyzer includes a wave discriminator comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ratio between said first time period and said second time period.

19. The signal demodulator as set forth in claim 18, in which said wave discriminator includes a rectifier supplied with said information carrying signal and making said information carrying signal vary the amplitude in one of the positive and negative ranges, an averaging circuit connected to said rectifier for determining an average value of said amplitude, a comparator having two thresholds defining said predetermined amplitude range and comparing said information carrying signal with said two thresholds to produce an output signal representative of said first time period and said second time period, and a signal generator connected to said comparator and producing an output signal representative of said similarity.

20. The signal demodulator as set forth in claim 15, in which said information carrying signal is produced from an analog signal representative of sound or a data stream containing music data codes and meaningless codes, and said judging unit further determines that said information carrying signal was produced from said analog signal in the absence of the features unique to plural sorts of modulation techniques.

21. A signal demodulator for reproducing an original signal from an information carrying signal comprising:

a detector supplied with said information carrying signal, and including an analyzer supplied with said information carrying signal and evaluating at least one feature of said information carrying signal found in a waveform of said information carrying signal and a judging unit connected to said analyzer and investigating the evaluation supplied from said analyzer to see what sort of modulation technique exhibits said at least one feature so as to produce a control data signal representative of the sort of modulation technique employed in said information carrying signal, wherein said at least one feature is a similarity of said waveform to plural reference waveforms; and a demodulator responsive to said control data signal so as to select planes respectively assigned to plural sorts of demodulation techniques, and reproducing said original signal from said information carrying signal through the demodulation technique on said one of said plural function planes, wherein said analyzer includes a wave discriminator comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ration between said first time period and said second time period, said wave discriminator including a rectifier supplied with said information carrying signal and making said information carrying signal vary the amplitude in one of the positive and negative ranges, an averaging circuit connected to said rectifier for determining an average value of said amplitude, a comparator having two thresholds defining said predetermined amplitude range and comparing said information carrying signal with said two thresholds to produce an output signal representative of said first time period and said second time period, one of said two thresholds being 80 percent of said average value, the other of said two thresholds being 120 percent of said average value, and a signal generator connected to said comparator and producing an output signal representative of said similarity.

22. A signal demodulator for reproducing an original signal from an information carrying signal comprising:

a detector supplied with said information carrying signal, and including an analyzer supplied with said information carrying signal and evaluating at least one feature and another feature of said information carrying signal found in a waveform of said information carrying signal and a judging unit connected to said analyzer and investigating the evaluation supplied from said analyzer to see what sort of modulation technique exhibits said at least one feature and said another feature so as to produce a control data signal representative of the sort of modulation technique employed in said information carrying signal, wherein said at least one feature and said another feature are a similarity of said waveform to plural reference waveforms and peak-to-peak intervals found in said waveform; and a demodulator responsive to said control data signal so as to select one of plural function planes respectively assigned to plural sorts of demodulation techniques, and reproducing said original signal from said information carrying signal through the demodulation technique on said one of said plural function planes, wherein said analyzer includes a wave discriminator supplied with said information carrying signal, comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ratio between said first time period and said second time period; and plural modulation discriminators supplied with said information carrying signal, determining said peak-to-peak intervals of said information carrying signal, and producing output signals each representative of either consistency or inconsistency with one of plural sorts of modulation techniques, said output signal of said wave discriminator and said output signals of said plural modulation discriminators being supplied to said judging unit.

23. A signal demodulator for reproducing an original signal from an information carrying signal produced from an analog signal representative of sound or a data stream containing music data codes and meaningless codes, comprising:

a detector supplied with said information carrying signal, and including an analyzer supplied with said information carrying signal and evaluating at least one feature of said information carrying signal found in a waveform of said information carrying signal and a judging unit connected to said analyzer, investigating the evaluation supplied from said analyzer to see what sort of modulation technique exhibits said at least one feature so as to produce a control data signal representative of the sort of modulation technique employed in said information carrying signal and determining that said information carrying signal was produced from said analog signal in the absence of the features unique to plural sorts of modulation techniques, wherein said at least one feature is a similarity of said waveform to plural reference waveforms; and a demodulator responsive to said control data signal so as to select one of plural function planes respectively assigned to plural sort of demodulation techniques, and reproducing said original signal from said information carrying signal through the demodulation technique on said one of said plural function planes, wherein said analyzer includes a wave discriminator supplied with said information carrying signal, comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ratio between said first time period and said second time period;

plural modulation discriminators supplied with said information carrying signal, determining said peak-to-peak intervals of said information carrying signal, and producing output signals each representative of either consistency or inconsistency with one of plural sorts of modulation techniques;

an analog signal discriminator supplied with said output signals of said plural modulation discriminators, and producing an output signal representative of said analog signal when said plural modulation discriminators determines that said plural sorts of modulation techniques are not found in said information carrying signal; and a level analyzer supplied with said information carrying signal, and checking said information carrying signal to see whether or not the amplitude is wider than a predetermined range so as to produce an output signal representative of silence or sound, said output signal of said wave discriminator, said output signals of said plural modulation discriminators, said output signal of said analog signal discriminator and said output signal of said level analyzer being supplied to said judging unit.

24. The signal demodulator as set forth in claim 23, further comprising a signal separator for separating said information carrying signal into a first-channel signal and a second-channel signal, and said level analyzer and said wave discriminator are duplicated so that said first-channel signal and said second channel signal are supplied separately to said level analyzers and said wave discriminators and selectively to said plural modulation discriminators.

25. A method for reproducing an original signal from an information carrying signal, comprising the steps of:

a) receiving said information carrying signal;

b) analyzing said information carrying signal so as to evaluate at least one feature of a waveform of said information carrying signal;

c) investigating the evaluation to see what sort of modulation technique exhibits said at least one feature so as to determine the sort of modulation technique employed in said information carrying signal, wherein said at least one feature is a similarity of said waveform to plural reference waveforms;

d) selecting a demodulation technique corresponding to said sort of modulation technique from plural candidates; and e) reproducing said original signal from said information carrying signal through said demodulation technique.

26. The method as set forth in claim 25, in which another feature of said waveform is further evaluated in said step b), and said sort of modulation technique is determined on the basis of both of said at least one feature and another feature.

27. The method as set forth in claim 26, in which said at least one feature and said another feature are said similarity of said waveform to said reference waveforms and peak-to-peak intervals found in said waveform.

28. The method as set forth in claim 27, in which said information carrying signal is decided to be directly produced from an analog signal when said peak-to-peak intervals are not unique to plural sorts of modulation techniques.

29. A sound reproducing apparatus for reproducing an original signal carrying pieces of music data information from an information carrying signal, comprising:

a detector supplied with said information carrying signal, and including an analyzer supplied with said information carrying signal and evaluating at least one feature of said information carrying signal found in a waveform of said information carrying signal and a judging unit connected to said analyzer and investigating the evaluation supplied from said analyzer to see what sort of modulation technique exhibits said at least one feature so as to produce a control data signal representative of the sort of modulation technique employed in said information carrying signal, wherein said at least one feature is a similarity of said waveform to plural reference waveforms;

a demodulator connected to said detector, responsive to said control data signal so as to select one of plural function planes respectively assigned to plural sorts of demodulation techniques, and reproducing a continuous signal containing a first sub-signal representative of said pieces of music data information and a second sub-signal supplemented in the absence of said first sub-signal from said information carrying signal through the demodulation technique on said one of said plural function planes;

a data converter connected to said demodulator, and eliminating said second sub-signal from said continuous signal so as to reproduce said original signal from said continuous signal; and a signal converter connected to said data converter, and producing an analog audio signal carrying said pieces of music data information from said original signal.

30. The sound reproducing apparatus as set forth in claim 29, in which said analyzer further evaluates another feature of said information carrying signal found in said waveform of said information carrying signal, and said judging unit determines said sort of modulation technique on the basis of the evaluation of said at least one feature and another feature.

31. The sound reproducing apparatus as set forth in claim 30, in which said at least one feature and said another feature are said similarity of said waveform to said plural reference waveforms and peak-to-peak intervals found in said waveform.

32. The sound reproducing apparatus as set forth in claim 29, in which said analyzer includes a wave discriminator comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ratio between said first time period and said second time period.

33. The sound reproducing apparatus as set forth in claim 32, in which said wave discriminator includes a rectifier supplied with said information carrying signal and making said information carrying signal vary the amplitude in one of the positive and negative ranges, an averaging circuit connected to said rectifier for determining an average value of said amplitude, a comparator having two thresholds defining said predetermined amplitude range and comparing said information carrying signal with said two thresholds to produce an output signal representative of said first time period and said second time period, and a signal generator connected to said comparator and producing an output signal representative of said similarity.

34. The sound reproducing apparatus as set forth in claim 29, in which said information carrying signal is produced from an analog signal representative of sound or a data stream containing music data codes and meaningless codes, and said judging unit further determines that said information carrying signal was produced from said analog signal in the absence of the features unique to plural sorts of modulation techniques.

35. A sound reproducing apparatus for reproducing an original signal carrying pieces of music data information from an information carrying signal, comprising:

a detector supplied with said information carrying signal, and including an analyzer supplied with said information carrying signal and evaluating at least one feature of said information carrying signal found in a waveform of said information carrying signal and a judging unit connected to said analyzer and investigating the evaluation supplied from said analyzer to see what sort of modulation technique exhibits said at least one feature so as to produce a control data signal representative of the sort of modulation technique employed in said information carrying signal, wherein said at least one feature is a similarity of said waveform to plural reference waveforms;

a demodulator connected to said detector, response to said control data signal so as to select one of the plural function planes respectively assigned to plural sorts of demodulation techniques, and reproducing a continuous signal containing a first sub-signal representative of said pieces of music data information and a second sub-signal supplemented in the absence of said first sub-signal from said information carrying signal through the demodulation technique on said one of said plural function planes;

a data converted connected to said demodulator, and eliminating said second sub-signal from said continuous signal so as to reproduce said original signal from said continuous signal; and a signal converter connected to said data converter, and producing an analog audio signal carrying said pieces of music data information from said original signal, wherein said analyzer includes a wave discriminator comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ratio between said first time period and said second time period, said wave discriminator including a rectifier supplied with said information carrying signal and making said information carrying signal vary the amplitude in one of the positive and negative ranges, an averaging circuit connected to said rectifier for determining an average value of said amplitude, a comparator having two thresholds defining said predetermined amplitude range and comparing said information carrying signal with said two thresholds to produce an output signal representative of said first time period and said second time period, one of said two thresholds being 80 percent of said average value, the other of said two thresholds being 120 percent of said average value, and a signal generator connected to said comparator and producing an output signal representative of said similarity.

36. A sound reproducing apparatus for reproducing an original signal carrying pieces of music data information from an information carrying signal, comprising:

a detector supplied with said information carrying signal, and including an analyzer supplied with said information carrying signal and evaluating at least one feature and another feature of said information carrying signal found in a waveform of said information carrying signal and a judging unit connected to said analyzer and investigating the evaluation supplied from said analyzer to see what sort of modulation technique exhibits said at least one feature and said another feature so as to produce a control data signal representative of the sort of modulation technique employed in said information carrying signal, wherein said at least one feature and another feature are a similarity of said waveform to plural reference waveforms and peak-to-peak intervals found in said waveform;

a demodulator connected to said detector, responsive to said control data signal so as to select one of plural function planes respectively assigned to plural sorts of demodulation techniques, a reproducing a continuous signal containing a first sub-signal representative of said pieces of music data information and a second sub-signal supplemented in the absence of said first sub-signal from said information carrying signal through the demodulation technique on said one of said plural function planes;

a data converter connected to said demodulator, and eliminating said second sub-signal from said continuous signal so as to reproduce said original signal from said continuous signal; and a signal converted connected to said data converter, carrying said pieces of music data information from said original signal, wherein said analyzer includes a wave discriminator supplied with said information carrying signal, comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ratio between said first time period and said second time period; and plural modulation discriminators supplied with said information carrying signal, determining said peak-to-peak intervals of said information carrying signal, and producing output signals each representative of either consistency or inconsistency with one of plural sorts of modulation techniques, said output signal of said wave discriminator and said output signals of said plural modulation discriminators being supplied to said judging unit.

37. A sound reproducing apparatus for reproducing an original signal carrying prices of music data information from an information carrying signal produced from an analog signal representative of sound or a data stream containing music data codes and meaningless codes, comprising:

a detector supplied with said information carrying signal, and including an analyzer supplied with said information carrying signal and evaluating at least one feature of said information carrying signal found in a waveform of said information carrying signal and a judging unit connected to said analyzer, investigating the evaluation supplied from said analyzer to see what sort of modulation technique exhibits said at least one feature so as to produce a control data signal representative of the sort of modulation technique employed in said information carrying signal and determining that said information carrying signal was produced from said analog signal in the absence of the features unique to plural sorts of modulation techniques, wherein said at least one feature is a similarity of said waveform to plural reference waveforms;

a demodulator connected to said detector, responsive to said control data signal so as to select one of plural function planes respectively assigned to plural sorts of demodulation techniques, and reproducing a continuous signal containing a first sub-signal representative of said pieces of music data information and a second sub-signal supplemented in the absence of said first sub-signal from said information carrying signal through the demodulation technique on said one of said plural function planes;

a data converter connected to said demodulator, and eliminating said second sub-signal from said continuous signal so as to reproduce said original signal from said continuous signal; and a signal converter connected to said data converter, and producing an analog audio signal carrying said pieces of music data information from said original signal, wherein said analyzer includes a wave discriminator supplied with said information carrying signal, comparing said waveform with a predetermined amplitude range to see whether or not said information carrying signal falls within said predetermined amplitude range so as to determine a first time period in which said information carrying signal is within said predetermined amplitude range and a second time period in which said information carrying signal is out of said predetermined amplitude range, and determine said similarity on the basis of a ratio between said first time period and said second time period;

plural modulation discriminators supplied with said information carrying signal, determining said peak-to-peak intervals of said information carrying signal, and producing output signals each representative of either consistency or inconsistency with one of plural sorts of modulation techniques;

an analog signal discriminator supplied with said output signals of said plural modulation discriminators, and producing an output signal representative of said analog signal when said plural modulation discriminators determines that said plural sorts of modulation techniques are not found in said information carrying signal; and a level analyzer supplied with said information carrying signal, and checking said information carrying signal to see whether or not the amplitude is wider than a predetermined range so as to produce an output signal representative of silence or sound, said output signal of said wave discriminator, said output signals of said plural modulation discriminators, said output signal of said analog signal discriminator and said output signal of said level analyzer being supplied to said judging unit.

38. The sound reproducing apparatus as set forth in claim 37, further comprising a signal separator for separating said information carrying signal into a first-channel signal and a second-channel signal, and said level analyzer and said wave discriminator are duplicated so that said first-channel signal and said second channel signal are supplied separately to said level analyzers and said wave discriminators and selectively to said plural modulation discriminators.

39. A method for reproducing an original signal representative of pieces of music data information from an information carrying signal, comprising the steps of:

a) receiving said information carrying signal;

b) analyzing said information carrying signal so as to evaluate at least one feature of a waveform of said information carrying signal;

c) investigating the evaluation to see what sort of modulation technique exhibits said at least one feature so as to determine the sort of modulation technique employed in said information carrying signal, wherein said at least one feature is a similarity of said waveform to plural reference waveforms;

d) selecting a demodulation technique corresponding to said sort of modulation technique from plural candidates;

e) reproducing a continuous signal containing a first sub-signal representative of said pieces of music data information and a second sub-signal supplemented in the absence of said first sub-signal from said information carrying signal through said demodulation technique;

f) eliminating said second sub-signal from said continuous signal for reproducing said original signal; and g) producing an analog audio signal carrying said pieces of music data information from said continuous signal.

40. The method as set forth in claim 39, in which another feature of said waveform is further evaluated in said step b), and said sort of modulation technique is determined on the basis of both of said at least one feature and another feature.

41. The method as set forth in claim 40, in which said at least one feature and said another feature are said similarity of said waveform to said reference waveforms and peak-to-peak intervals found in said waveform.

42. The method as set forth in claim 41, in which said information carrying signal is decided to be directly produced from an analog signal when said peak-to-peak intervals are not unique to plural sorts of modulation techniques.

* * * * *